US007900293B2

(12) United States Patent
Sato et al.

(10) Patent No.: US 7,900,293 B2
(45) Date of Patent: Mar. 8, 2011

(54) SHOWER BATHING APPARATUS

(75) Inventors: Minoru Sato, Kanagawa-ken (JP); Yutaka Aihara, Kanagawa-ken (JP); Tomohisa Kato, Kanagawa-ken (JP); Hiroyoshi Matsushita, Kanagawa-ken (JP); Minami Okamoto, Kanagawa-ken (JP)

(73) Assignee: Toto, Ltd., Fukuoka (JP)

( * ) Notice: Subject to any disclaimer, the term of this patent is extended or adjusted under 35 U.S.C. 154(b) by 230 days.

(21) Appl. No.: 11/694,201

(22) Filed: Mar. 30, 2007

(65) Prior Publication Data

US 2007/0226895 A1 Oct. 4, 2007

(30) Foreign Application Priority Data

Mar. 31, 2006 (JP) ..... 2006-100279
Dec. 26, 2006 (JP) ..... 2006-349749

(51) Int. Cl.
*A47K 3/022* (2006.01)

(52) U.S. Cl. ..... 4/596; 4/611; 4/615

(58) Field of Classification Search ..... 4/596, 611, 4/601, 605, 612–61
See application file for complete search history.

(56) References Cited

U.S. PATENT DOCUMENTS

| | | | | |
|---|---|---|---|---|
| 3,832,740 | A * | 9/1974 | McClarrin | 4/611 |
| 3,902,200 | A * | 9/1975 | Pratt | 4/579 |
| 6,195,814 | B1 * | 3/2001 | Yoshida et al. | 4/601 |
| 6,408,456 | B1 * | 6/2002 | Fike et al. | 4/560.1 |

FOREIGN PATENT DOCUMENTS

| | | | |
|---|---|---|---|
| GB | 2149299 | | 6/1985 |
| JP | 54-110434 | | 8/1979 |
| JP | 3002967 | | 8/1994 |
| JP | 635071 | Y2 | 9/1994 |
| JP | 09098898 | A | 4/1997 |
| JP | 10-262853 | | 10/1998 |
| JP | 10-309242 | | 11/1998 |
| JP | 11276374 | A | 10/1999 |
| JP | 2000-107058 | | 4/2000 |
| JP | 3076097 | | 12/2000 |
| JP | 2001-286408 | | 10/2001 |
| JP | 2001-299862 | | 10/2001 |
| JP | 2002136566 | A | 5/2002 |
| JP | 2002-325696 | | 11/2002 |
| JP | 2004-049842 | | 2/2004 |
| WO | 9730619 | | 8/1997 |

OTHER PUBLICATIONS

Office Action from the Japanese patent office for counterpart Japanese application No. 2007-093726 dtd. Oct. 26, 2007.
English Translation of Japanese Application No. JP6-035071, previously submitted to U.S. Patent and Trademark Office via EFS Web on Oct. 5, 2007.

* cited by examiner

*Primary Examiner* — Khoa D Huynh
*Assistant Examiner* — Karen Younkins
(74) *Attorney, Agent, or Firm* — Banner & Witcoff, Ltd

(57) ABSTRACT

A shower bathing apparatus includes: a concave seat; and a water discharger provided rearwardly and upwardly to the seat and configured to discharge water in a forward direction of the seat. A water discharge direction from the water discharger and positional relationship between the water discharger and the seat are adjusted so that at least part of the discharged water directly reaches the seat with no seat occupant seated on the seat.

11 Claims, 47 Drawing Sheets

SHOWER BATHING APPARATUS

CROSS-REFERENCE TO RELATED APPLICATIONS

This application is based upon and claims the benefit of priorities from the prior Japanese Patent Application No.2006-100279, filed on Mar. 31, 2006, and the prior Japanese Patent Application No.2006-349749, filed on Dec. 26, 2006; the entire contents of which are incorporated herein by reference.

BACKGROUND OF THE INVENTION

1. Field of the Invention

This invention relates to a shower bathing apparatus, and more particularly to a shower bathing apparatus enabling a user to take a shower bath in a sitting posture.

2. Description of the Related Art

A shower bathing apparatus enabling a user to take a shower bath in a sitting posture is disclosed, for example, in International Publication WO 97/30619 (hereinafter referred to as "Patent Document 1"). According to this Patent Document 1, an arm extending forward from behind the user in a sitting posture over the user's shoulder has a spray nozzle, which sprays mist toward the user.

Recently, with the growing diversity of lifestyle, bathing style has been also diversified. In a conventional way of bathing, the body is washed with a shower and warmed in a bathtub. However, even for a shower, there are demands for a sense of bathing like soaking in a bathtub and a function of sufficiently warming the body.

The shower bathing apparatus is expected to also serve for warming the body in addition to simply washing the body, particularly for elderly and physically challenged users who are difficult to move into and out of a bathtub. However, in a sitting position on a seat, the water flow discharged from above the seat is obstructed by the seat and is difficult to reach the legback. Thus it is difficult to provide a high hyperthermic effect on the entire body.

SUMMARY OF THE INVENTION

According to an aspect of the invention, there is provided a shower bathing apparatus including a concave seat; and a water discharger provided rearwardly and upwardly to the seat and configured to discharge water in a forward direction of the seat, a water discharge direction from the water discharger and positional relationship between the water discharger and the seat are adjusted so that at least part of the discharged water directly reaches the seat with no seat occupant seated on the seat.

DETAILED DESCRIPTION OF THE INVENTION

Figure 1:
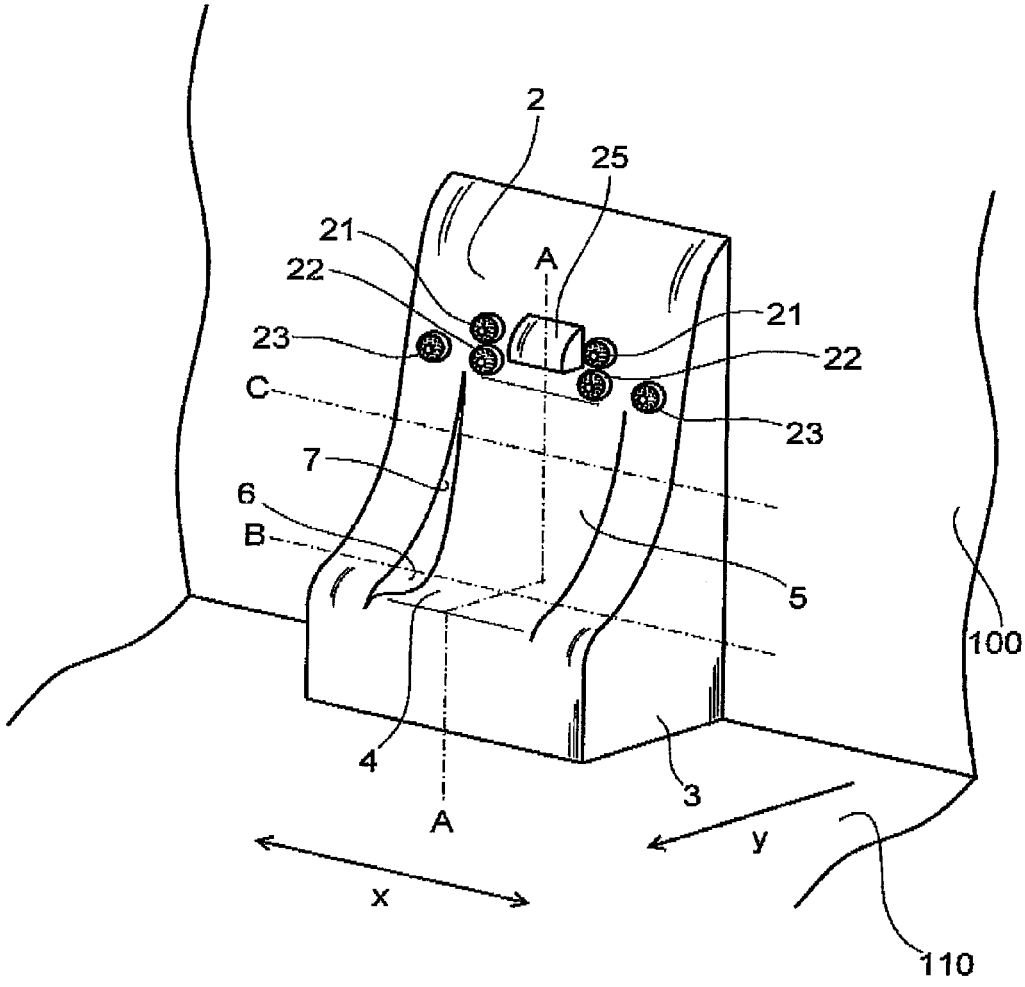
FIG. 1 is a perspective view schematically illustrating the appearance of a shower bathing apparatus according to a first embodiment of the invention.

Embodiments of the invention will now be described with reference to the drawings, where like elements are marked with like reference numerals.

First Embodiment

FIG. 1 is a perspective view schematically illustrating the appearance of a shower bathing apparatus according to a first embodiment of the invention.

Figure 2:
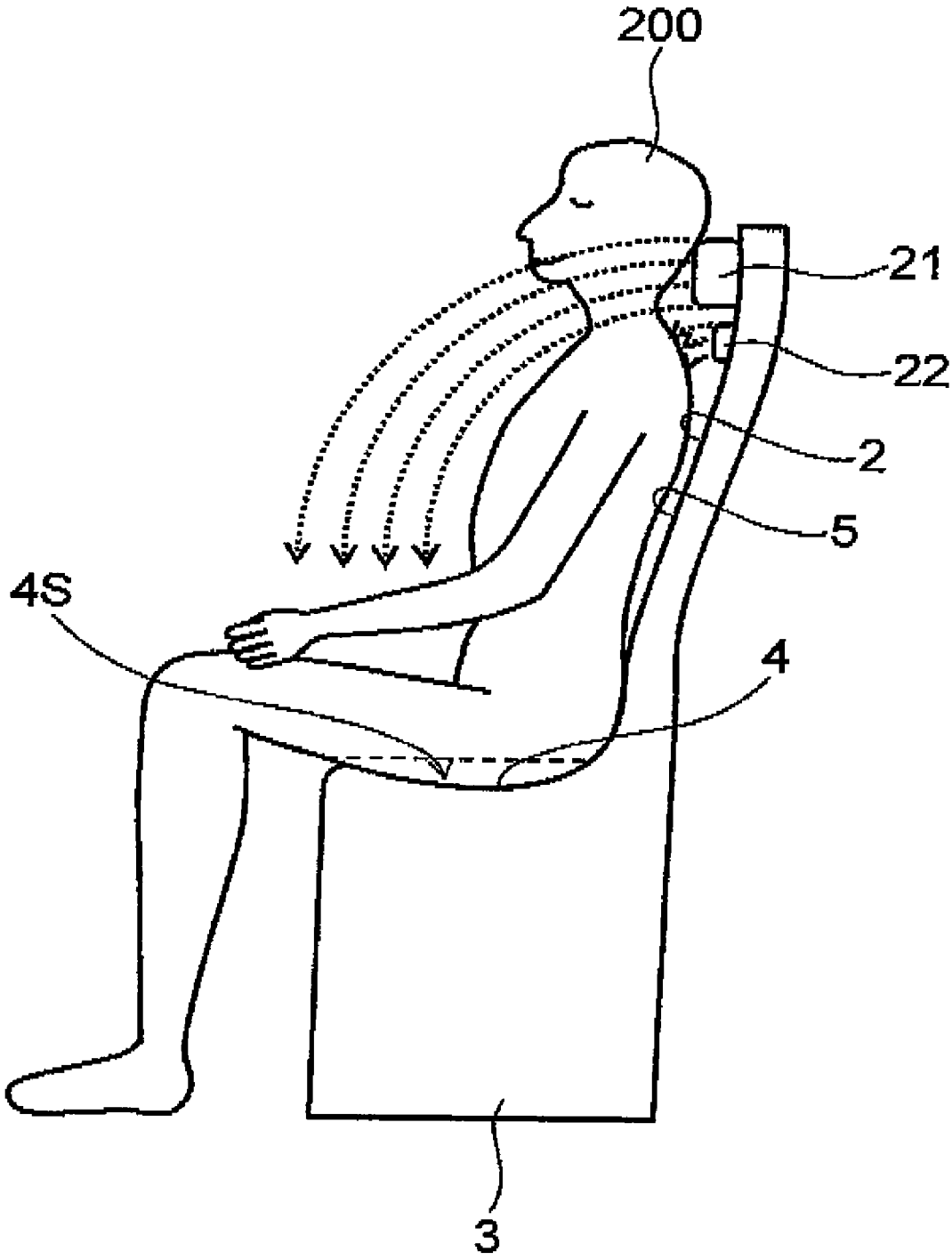
FIG. 2 is the A-A cross-sectional view of FIG. 1.

FIG. 2 is the A-A cross-sectional view of FIG. 1.

FIG. 3 is the B-B cross-sectional view of FIG. 1.

Figure 4:
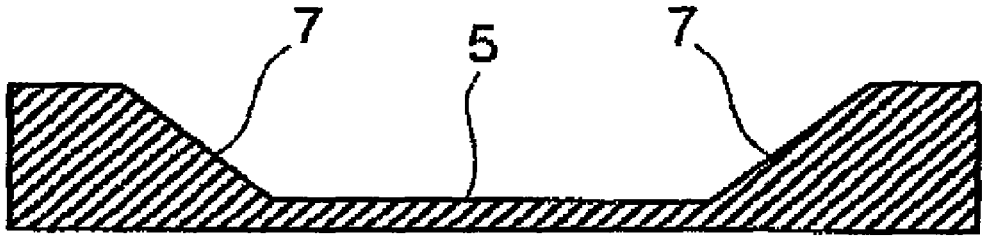
FIG. 4 is the C-C cross-sectional view of FIG. 1.

FIG. 4 is the C-C cross-sectional view of FIG. 1.

The shower bathing apparatus according to this embodiment primarily comprises a back portion 2 provided on a wall 100 of a bathroom and a base portion 3 provided on a floor 110 of the bathroom. In this example, the base portion 3 is integrated with the bottom of the back portion 2. However, the invention is not limited thereto, but the base portion 3 and the back portion 2 may be provided separately.

The base portion 3 protrudes forward (in the direction of arrow y in FIG. 1) of the back portion 2. On the top face of the base portion 3 is formed a concave seat 4, which is recessed toward the floor 110 relative to the other part of the top face. That is, as viewed in a first direction x (along the width of the base portion 3) generally parallel to the bathroom wall 100 and the bathroom floor 110, a step is formed across a wall portion 6 between each end of the top face of the base portion 3 and the seat 4, and operates as a part of weirs pooling water. A slope portion 4S is provided on the seat 4, which is sloped with respect to the vertically upward direction from the backside to the front.

The back portion 2 has a concave backrest 5, which is recessed toward the bathroom wall 100 relative to the other part of the back portion 2. That is, as viewed in the first direction x, a step is formed across a wall portion 7 between each end of the back portion 2 and the backrest 5.

The backrest 5 and the seat 4 are formed as a continuous recess. The wall portion 7 on each end of the backrest 5 as viewed in the first direction x (along the width) and the wall portion 6 on each end of the seat 4 as viewed in the first direction x (along the width) are also continuous with each other.

Figure 3A:
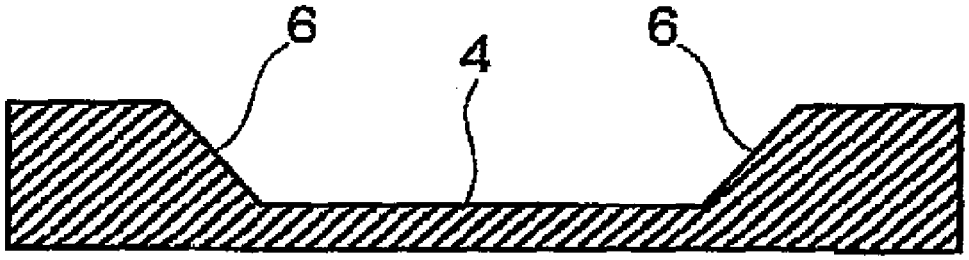
FIG. 3 is the B-B cross-sectional view of FIG. 1.
Figure 3B:
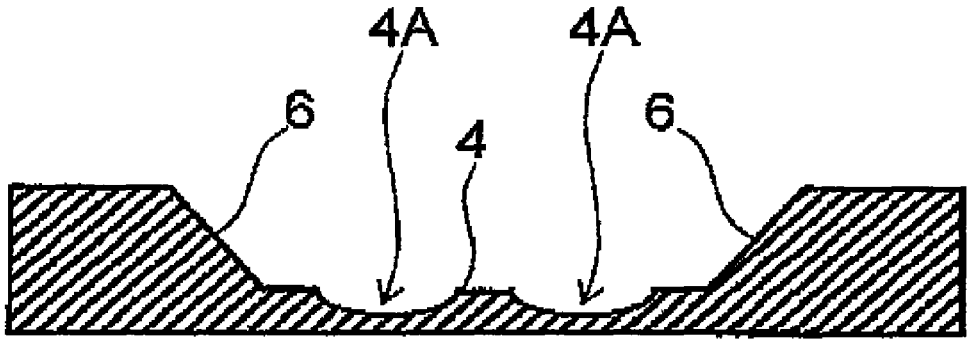

As shown in FIGS. 3A and 3B, the seat 4 is concaved as viewed in the first direction x (along the width). The seat 4 is concaved also as viewed in a second direction y (see FIG. 1). That is, weirs for pooling water are formed around the seat 4. Among these weirs, the weir facing the backrest 5, that is, the front weir is lower than the other three weirs. Hence the water pooled in the seat 4 falls toward the feet of a seat occupant 200 without leaking out laterally.

Furthermore, a pair of recesses 4A may be provided as shown in FIG. 3B. These recesses 4A extend in the second direction y and correspond to the thighs of a seat occupant seated on the seat 4. These recesses 4A serve to support the thighs of the seat occupant more stably, and allow the water pooled in the seat 4 to flow toward the legs of the seat occupant.

As shown in FIG. 2, the seat 4 is sloped down along the depth (toward the backrest 5). That is, the recess of the seat 4 gradually deepens along the depth (toward the backrest 5).

At the upper part of the back portion 2 and generally at its center as viewed in the first direction x (along the width) is provided a head support 25 for supporting the head, or a portion from the neck to the head, of the seat occupant seated on the seat 4. The head support 25 protrudes in the second direction y (the protruding direction of the base portion 3) from the back portion 2.

A pair of first water dischargers 21 is provided on the back portion 2 upwardly to the backrest 5. The first water dischargers 21 are provided on both sides, one for each side, of the head support 25 so as to interpose the head support 25 as viewed in the first direction x. When a user is seated on the seat 4, the first water dischargers 21 are located upwardly to the shoulders of the seated user. The height between the seat 4 and the first water discharger 21 is larger than the height from the bathroom floor 110 to the seat 4. The two first water dischargers 21 are spaced from each other in the first direction x so that the face or head of the seated user can be located between the pair of first water dischargers 21. That is, the pair of first water dischargers 21 is located so as to interpose the face or head of the user seated on the seat. However, the first water dischargers 21 may be provided at a higher position than the head of the user seated on the seat 4. The water discharge direction of the first water discharger 21 is configured to be a generally horizontal direction, or a slightly downward direction relative to the horizontal.

The term "generally horizontal direction" used herein is preferably within ±45°, more preferably within ±30°, and even more preferably within ±20°, relative to the horizontal.

More specifically, as described later in detail, the first water dischargers 21 provided upwardly to the shoulders of the seat occupant seated on the seat 4 discharge a shower flow falling around the legs of the seat occupant. Here, if the first water dischargers 21 are attached at a low position, the shower flow can be discharged nearly horizontally over the shoulders of the seat occupant and dropped around the legs of the seat occupant. On the other hand, if the first water dischargers 21 are attached at a high position, a horizontally discharged shower flow would fall far from the legs of the seat occupant. Hence water needs to be discharged downward relative to the horizontal. That is, water needs to be discharged nearly horizontally for a low attachment position of the first water dischargers 21, and the water discharge direction needs to be made more downward relative to the horizontal as the attachment position becomes higher.

For example, if the first water dischargers 21 are attached at a low position and discharge water generally horizontally, the flying distance traveled by the shower flow to fall around the legs of the seat occupant decreases, and consequently the shower flow is less prone to temperature decrease. Furthermore, the shower bathing apparatus can be downsized by lowering the attachment position of the first water dischargers 21. Moreover, the speed of the shower flow falling around the legs of the seat occupant decreases (because the shower flow is less affected by acceleration, which would be greater for downward water discharge). This reduces irritation and water splash of the shower flow to the seat occupant and enables the seat occupant to comfortably take a full body shower for a long time.

In this example, the apparatus includes a pair of first water dischargers 21 on the left and right side. However, the invention is not limited thereto, but the apparatus may be provided with a single first water discharger 21. In this case, the first water discharger 21 may extend to both the left and right side of the head support 25, and/or may be provided upwardly to the head support 25.

A pair of second water dischargers 22 is provided on the back portion 2 upwardly to the backrest 5 and below the pair of first water dischargers 21, respectively. The water discharge direction of the second water discharger 22 is configured to be more downward than the water discharge direction of the first water discharger 21 and to discharge water toward the shoulders of the seat occupant. In this example, the apparatus includes a pair of second water dischargers 22 on the left and right side. However, the invention is not limited thereto, but the apparatus may be provided with a single second water discharger 22. In this case, the second water discharger 22 is provided around the center.

A pair of third water dischargers 23 is provided on the back portion 2 nearly as high as or slightly upwardly to the second water dischargers 22 and outside the first and second water dischargers 21, 22 and the backrest 5 as viewed in the first direction x (along the width of the backrest 5). The water discharge direction of the third water discharger 23 is configured to be more inward than the water discharge direction of the first water discharger 21 as viewed in the first direction x and to discharge water toward the acromia of the seat occupant.

Figure 5:
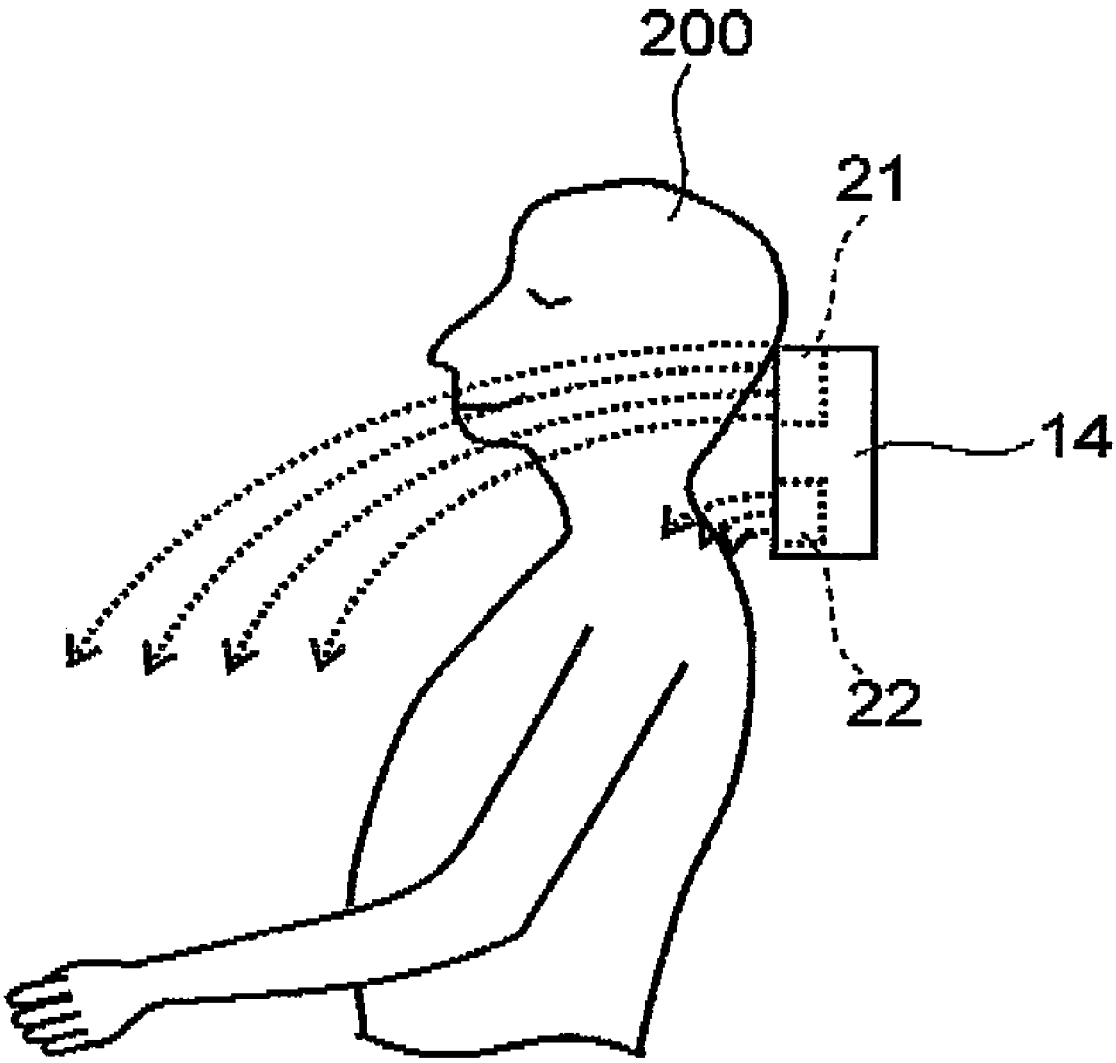
FIG. 5 is a schematic side view showing another example of the water discharger.

Each water discharger 21-23 discharges a shower flow of e.g. about 40 to 45° C. Note that two or more pairs of water dischargers 21-23 may be provided. In the example shown, each water discharger 21-23 separately protrudes from the back portion 2. However, as shown in FIG. 5, the water dischargers (FIG. 5 illustratively shows first and second water dischargers 21, 22) may be built in a single unit body 14.

Next, the function of the shower bathing apparatus according to this embodiment is described.

Figure 6:
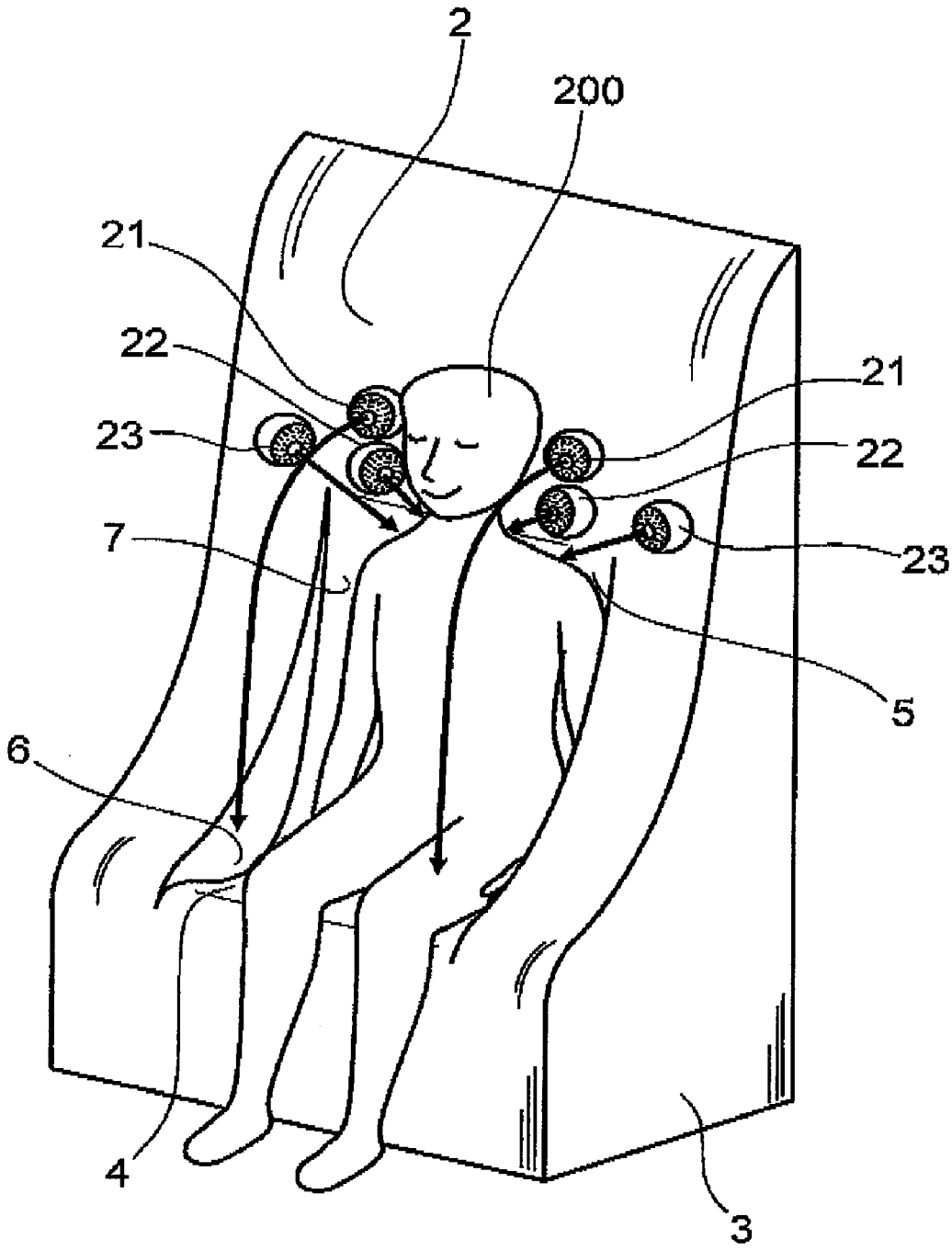
FIG. 6 is a perspective view schematically showing the water discharge of a shower flow from each water discharger to a seat occupant.

FIG. 6 is a perspective view schematically showing the water discharge of a shower flow from each water discharger 21-23 to a seat occupant 200.

As shown in FIGS. 2 and 6, the first water discharger 21 discharges a shower flow that is ejected generally horizontally and falling around the front edge of the seat 4. That is, a shower flow is discharged over the shoulder of the seat occupant 200 along an arc extending forward of the seat occupant 200 under its own weight, and falls around the leg particularly centering on the thigh of the seat occupant 200. Here the shower flow may fall also on the abdomen in addition to the leg of the seat occupant 200. The shower flow flows on the surface of the leg from the knee toward the foot of the seat occupant 200. This configuration of the water discharge direction enables the water discharge flow to reliably reach the leg without being blocked by the seat occupant 200 and to warm also the leg below the knee by discharging water over the shoulder of the seat occupant 200, despite the configuration where the first water dischargers 21 are provided rearwardly to the seat occupant 200 and near the head, which is distant from the legs of the seat occupant 200. Furthermore, the water discharged from such a high position can provide a massage effect by the shower flow acting on the legs like the so-called "Utaseyu" (water falling down on a user's body like a waterfall). Depending on the angle of the backrest 5 and the posture of the seat occupant 200, the shower flow discharged from the first water discharger 21 can be dropped on the lower abdomen of the seat occupant 200.

The "water discharge over the shoulder" used herein is not limited to the case where the shower flow from the first water discharger 21 passes directly upward to the shoulder of the seat occupant 200, but also includes the case of passing near the shoulder tip of the seat occupant 200. However, the shower flow passing directly upward to the shoulder of the seat occupant 200 can reach the leg from the first water discharger 21 provided on the backside of the seat occupant 200 in the shortest distance. That is, it can reduce the temperature decrease of the shower flow discharged from the first water discharger 21 during flying to the leg, and warm the leg with the shower flow at a desired temperature.

The second water discharger 22 discharges a shower flow toward the shoulder near the base of the neck of the seat occupant 200. Part of the shower flow impinging on the shoulder flows on the front surface of the body of the seat occupant 200 centering on the lateral portion extending from the chest to the trunk, and the other part of the shower flow is wrapped around to the back. Thus both the front and back of the body of the seat occupant 200 can be warmed. Furthermore, the massage effect by the shower flow can also be allowed to act on the shoulder. When only a single second water discharger 22 is provided as described above, it discharges a shower flow, for example, from rearward the neck of the seat occupant 200 toward both the shoulders near the base of the neck to achieve the same effect.

By discharging the shower flow from the second water discharger 22 toward the shoulder near the base of the neck of the seat occupant 200 and allowing the shower flow to flow on the front and back of the upper body of the seat occupant 200, the entire upper body of the seat occupant 200 can be efficiently warmed with only a pair of second water dischargers 22 provided rearwardly to the seat occupant 200. That is, the number of water dischargers can be minimized to reduce cost while providing a high hyperthermic effect.

The water wrapped around to the backside of the seat occupant 200 continuously flows along the back of the seat occupant 200 or the backrest 5 toward the seat 4. That is, a continuous flow of water discharged from the second water discharger 22 into the backrest 5 avoids occurrence of a temperature boundary layer between the back of the seat occupant 200 and the backrest 5 and facilitates conduction of heat from the water to the back of the seat occupant 200. Simultaneous warming of the backside in addition to the front of the body can enhance the hyperthermic effect even at a low flow rate, and also save water and energy by saving the amount of water used.

The backrest 5 is partitioned by the wall portions 7 formed on both ends in the first direction x (along the width) and is formed in a concave configuration continued to the seat 4. Hence it is possible to prevent splash and outflow of the water flowing into the backrest 5 and to reliably guide the water to the seat 4 without waste. That is, the hyperthermic effect is not compromised even at a low flow rate, and it is also possible to save water and energy by saving the amount of water used.

The third water discharger 23 discharges a shower flow toward the acromion (point of the shoulder) of the seat occupant 200. The shower flow impinging on the acromion flows on and warms the part around the center of the arm that cannot be covered by the shower flow from the first and second water dischargers 21, 22. Furthermore, the shower flow can be applied also beyond the acromion toward the chest. The shower flow discharged from only a pair of third water dischargers 23 toward the acromia can cover the arms and other parts that cannot be covered by the first and second water dischargers 21, 22, and thus the cost can be reduced.

The water discharged from the first to third water discharger 21-23 flows along the body surface of the seat occupant 200 or the backrest 5 and is pooled in the concave seat 4. In fact, weirs for pooling water are formed around the seat 4. The water pooled in the seat 4 ensures that at least the rear side of the buttocks and thighs of the seat occupant 200 is in contact with water. Thus it is possible to efficiently warm the vicinity of the waist where the discharged water flow from the water dischargers 21-23 does not directly reach. Furthermore, warming the waist and the buttocks also serves to promote healthy intestinal motility.

The seat 4 is partitioned by the wall portions 6 formed on both ends in the first direction x (along the width) and is formed as a recess continued from the backrest 5. Hence it is possible to prevent lateral leakage of water and to efficiently use the water from the water dischargers 21-23 without waste. That is, it is possible to save water and energy by saving the amount of water used.

Along the body surface of the seat occupant 200 or the backrest 5, water continuously flows also into the seat 4. This flow avoids developing a temperature boundary layer between the seat occupant 200 and the seat 4 and facilitates conduction of heat from the water to the buttocks and thighs of the seat occupant 200. Thus the hyperthermic effect can be enhanced.

Furthermore, the water pooled in the seat 4 flows out forward (in the direction y in FIG. 1) and down the legs to the feet of the seat occupant 200. As a result, the feet are also warmed without wasting water. In particular, the recesses 4A as illustrated in FIG. 3B increase efficiency because the water pooled in the seat 4 is then easier to flow toward the legs of the seat occupant 200.

Moreover, the user can take a shower flow from the first to third water discharger 21-23 throughout the body while soaking in the water pooled in the seat 4. Thus the user can enjoy a sense of soaking in water similar to that felt at bathing in a bathtub (a sense of bathing), and a high hyperthermic effect is achieved despite shower bathing. Furthermore, water pressure applied to the body is lower than that for soaking in a bathtub and places less strain on the body. Because the apparatus can be used in a seated position without the need to move into and out of the bathtub, elderly and physically challenged users can also easily enjoy a high hyperthermic effect. Furthermore, because the user can take a shower simultaneously throughout the body rather than separately on each part of the body, the user can warm the body by taking a shower in a short time with saving water.

Each water discharger 21-23 discharges a continuous shower flow of water rather than mist. Hence the ambient space is not filled with an atmosphere of high temperature and humidity as in the case of spraying mist, and dizziness can be prevented. Furthermore, because the temperature decrease of discharged water due to heat of vaporization is small, there is no need to set the shower temperature higher than needed, achieving greater economy.

The shower flow discharged from the first to third water discharger 21-23 in the shower bathing apparatus of this embodiment is discharged from a plurality of shower holes provided in each water discharger. The hole diameter is preferably in the range of e.g. 0.2 to 4 mm. In this range, a wide area can be efficiently warmed at a low flow rate.

In Patent Document 1, an arm having a plurality of water dischargers extends forward of a seat occupant. In contrast, according to this embodiment, the water dischargers 21-23 are integrated with the bathroom wall rearwardly to the seat occupant 200. Thus the footprint can be reduced in the limited bathroom space. The compact and simple configuration eliminates annoyance in the bathroom without compromising the design. Furthermore, because the apparatus has no arm extending forward, a user in a wheelchair, for example, can be safely and easily transferred to the seat 4 of the shower bathing apparatus and enjoy high user friendliness.

It is possible to provide a shower bath for efficiently warming the entire body of a seat occupant 200 with a small amount of water by suitably configuring the water discharge direction of the shower flow from each water discharger 21-23 as described above. There is no need for many water dischargers in front of the seat occupant 200, but only a minimum number of water dischargers are needed rearwardly to the seat occupant. Minimizing the number of water dischargers also leads to cost reduction. Furthermore, reducing the needed amount of water also serves to save water and energy.

Figure 7:
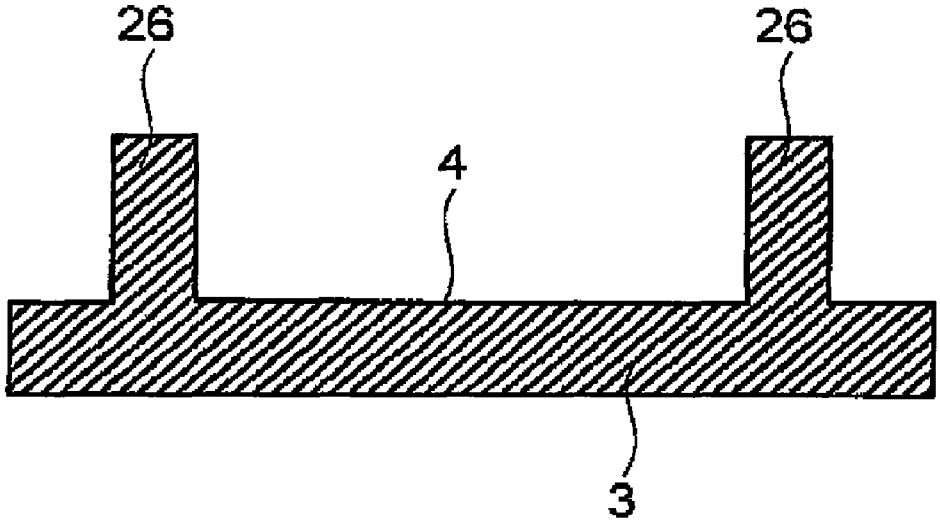
FIG. 7 is a schematic cross-sectional view showing another example of the seat.

FIG. 7 is a schematic cross-sectional view showing another example of the seat.

In this example, wall portions 26 are provided upright on the upper face of the base portion 3 to provide a concave seat 4 partitioned by the wall portions 26 from the other upper face of the base portion 3.

In the following, other embodiments of the invention are described. Elements similar to those described earlier are marked with like reference numerals and not described in detail.

Second Embodiment

Figure 8:
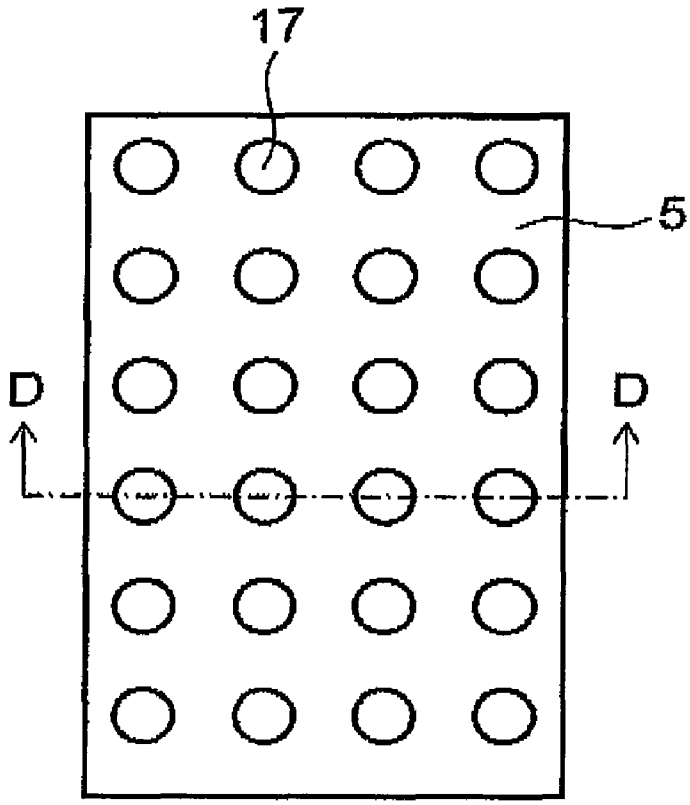
FIG. 8 is a schematic front view of a backrest of a shower bathing apparatus according to a second embodiment of the invention.

FIG. 8 is a schematic front view of a backrest 5 of a shower bathing apparatus according to a second embodiment of the invention.

Figure 9:
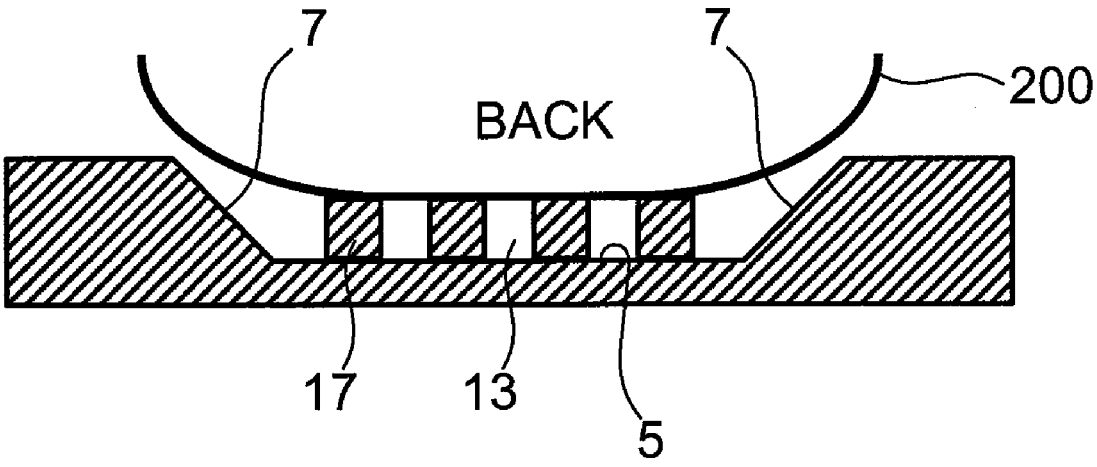
FIG. 9 is the D-D cross-sectional view of FIG. 8.

FIG. 9 is the D-D cross-sectional view of FIG. 8.

In this embodiment, the backrest 5 has irregularity. In the example shown in FIG. 8, the backrest 5 has a plurality of cylindrical protrusions 17, for example.

Figure 10:
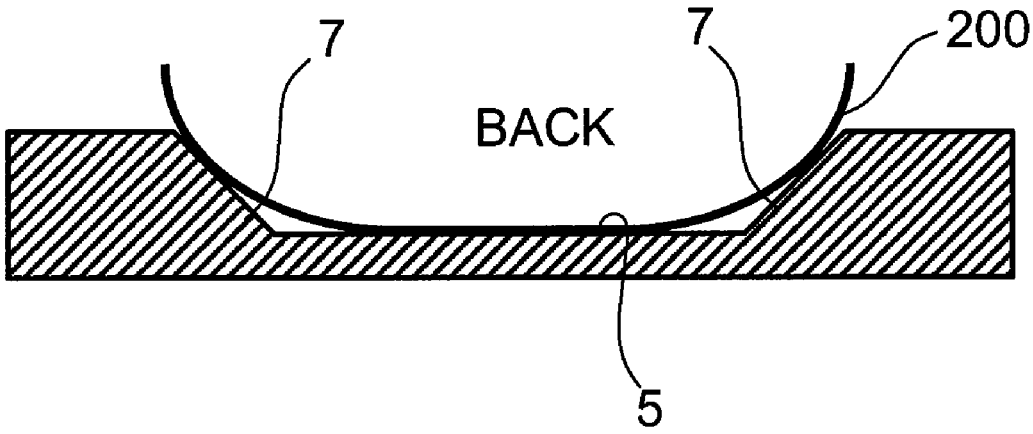
FIG. 10 is a schematic cross-sectional view of a backrest without irregularity.

As shown in FIG. 10, the backrest 5 without irregularity is in close contact with the back of the seat occupant 200, and water is difficult to flow on the back of the seat occupant 200. In contrast, as shown in FIG. 9, the backrest 5 with irregularity (protrusions 17) can ensure channels 18 for the water flowing between the backrest 5 and the back of the seat occupant 200. Thus a flow of water flowing in contact with the back of the seat occupant 200 can be ensured. The flow of water can be allowed to flow into the seat 4 while warming the back of the seat occupant 200.

The number and arrangement of the protrusions 17 are not limited to this example. For example, in contrast to the example illustrated in FIG. 8, the protrusions 17 may be placed in a staggered configuration. Then the vertical channel is interrupted, and water is easy to spread laterally. Hence the back of the seat occupant 200 can be warmed entirely and uniformly.

Furthermore, the protrusion 17 is not limited in shape and size to this example, but may be provided with various shapes such as elliptic or rectangular cylinder. Furthermore, its tip and/or corner can be suitably rounded to adjust stimuli applied to the seat occupant 200. The protrusion 17 may be composed of a curved surface such as hemisphere. Suitable placement of such protrusions 17 also provides a "pressure point massage" effect.

Figure 11:
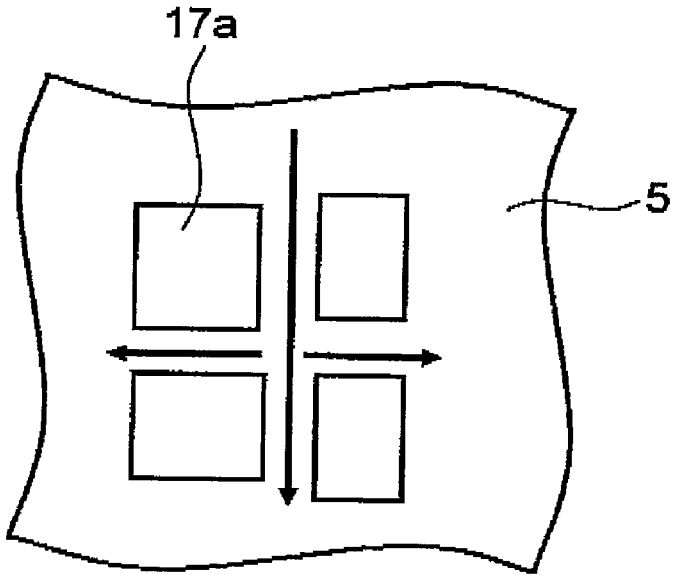
FIG. 11 is a schematic plan view showing another example where irregularity is provided on the backrest.
Figure 12:
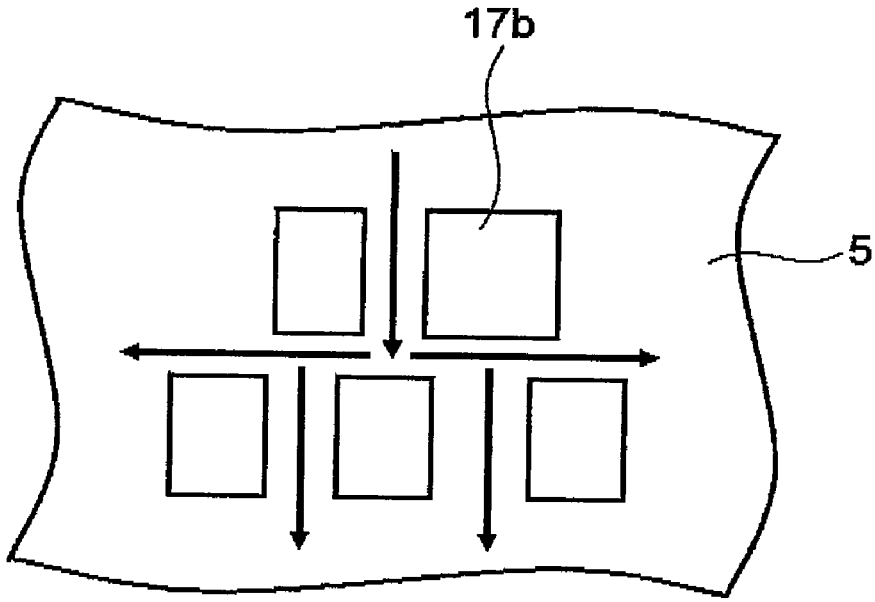
FIG. 12 is a schematic plan view showing still another example where irregularity is provided on the backrest.
Figure 13:
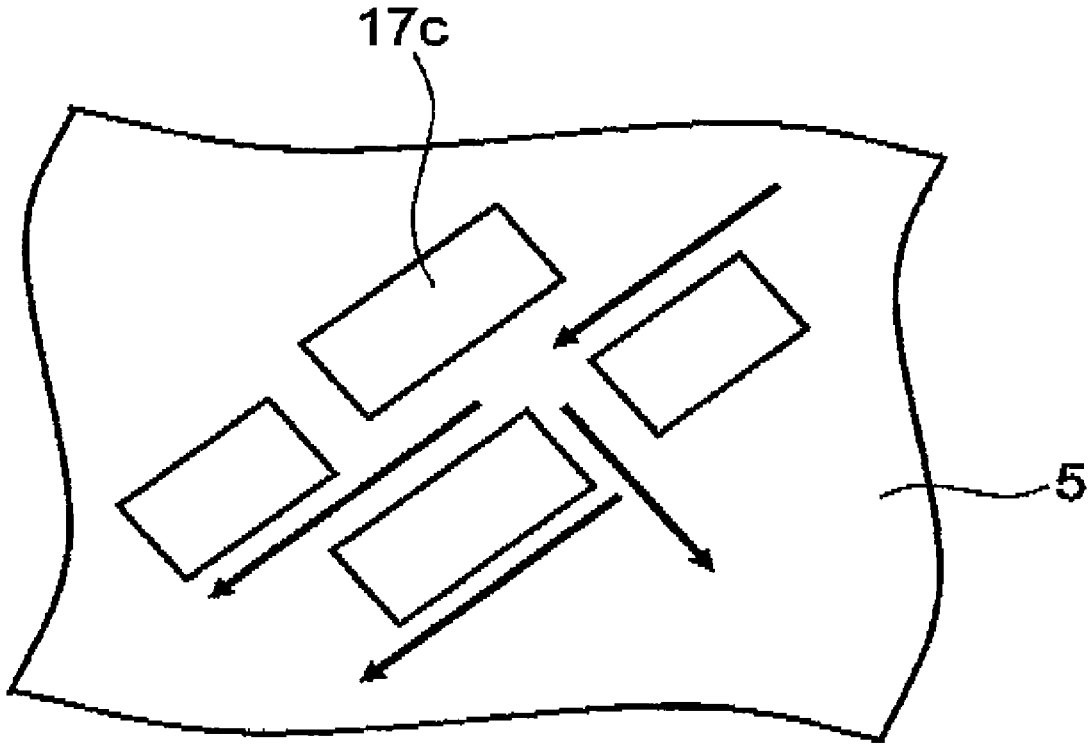
FIG. 13 is a schematic plan view showing still another example where irregularity is provided on the backrest.

FIGS. 11 to 13 show other examples of irregularity provided on the backrest 5.

FIG. 11 shows an example where the backrest 5 has rectangular protrusions 17*a*.

FIG. 12 also shows rectangular protrusions 17*b* as in FIG. 11. However, the vertical channel (the channel along the height of the backrest 5) formed between the protrusions 17*b* is interrupted by another protrusion 17*b*. Thus the channel does not extend continuously from top to bottom, and flowing water is easy to laterally spread on the backrest 5. That is, streams of flowing water are formed entirely on the backrest 5, and the back of the seat occupant 200 can be warmed entirely and uniformly.

In FIG. 13, the channel between the protrusions 17*c* is sloped with respect to the height direction of the backrest 5. This configuration also facilitates forming streams of flowing water entirely on the backrest 5.

Third Embodiment

Figure 14:
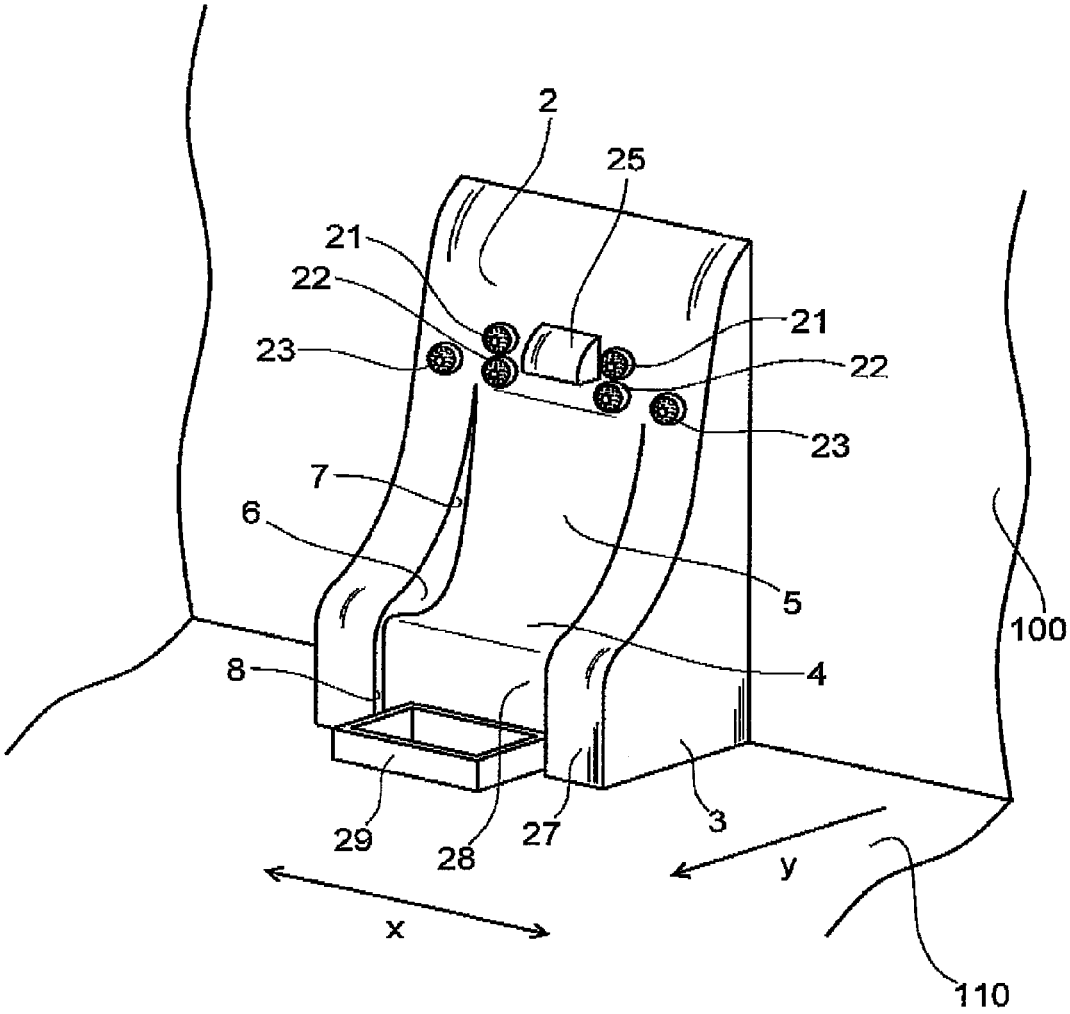
FIG. 14 is a perspective view schematically illustrating the appearance of a shower bathing apparatus according to a third embodiment of the invention.

FIG. 14 is a perspective view schematically illustrating the appearance of a shower bathing apparatus according to a third embodiment of the invention.

In this embodiment, the base portion 3 has a recess 28 on the front portion 27 located on the frontside as viewed in the projecting direction (second direction y) of the base portion 3. The recess 28 is recessed toward the bathroom wall 100. As viewed in the first direction x, a step is formed across a wall portion 8 between each end of the front portion 27 and the recess 28. The recess 28 is continued from the seat 4, and the wall portion 8 is continued from the wall portion 6 formed at each end of the seat 4.

Furthermore, a foot bathtub 29 is provided on the bathroom floor 110 in front of the recess 28. The water discharged from the first to third water discharger 21-23 flows along the body surface of the seat occupant or along the backrest 5 and the seat 4 and is pooled in the foot bathtub 29.

Figure 15:
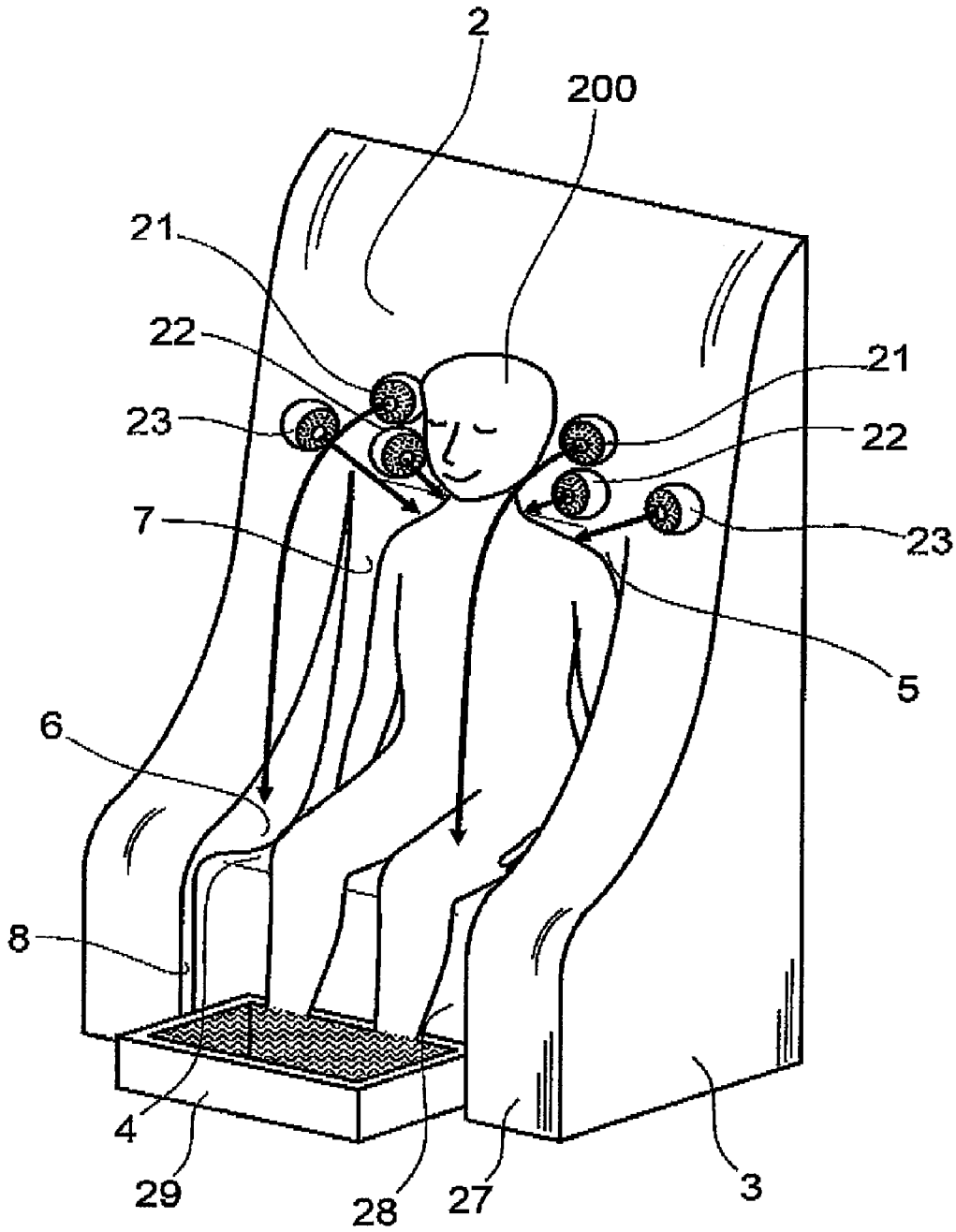
FIG. 15 is a perspective view schematically showing the water discharge of a shower flow from each water discharger to a seat occupant in the third embodiment.

As shown in FIG. 15, the seat occupant 200 can soak the feet in the water pooled in the foot bathtub 29 to enhance the hyperthermic effect on the feet, which are most distant from the first to third water discharger 21-23 and where blood flow is likely to stagnate with low skin temperature. Furthermore, the feet have arteriovenous anastomoses (AVA). Soaking the feet in the water in the foot bathtub 29 results in opening AVA to increase blood flow, thereby further enhancing the hyperthermic effect on the entire body.

Because the recess 28 continued from the seat 4 is provided on the front portion 27 of the base portion 3, the water overflowing the seat 4 can flow along the recess 28 and be pooled in the foot bathtub 29 without lateral leakage. Hence the water from the water dischargers 21-23 can be efficiently used without waste.

Fourth Embodiment

Figure 16:
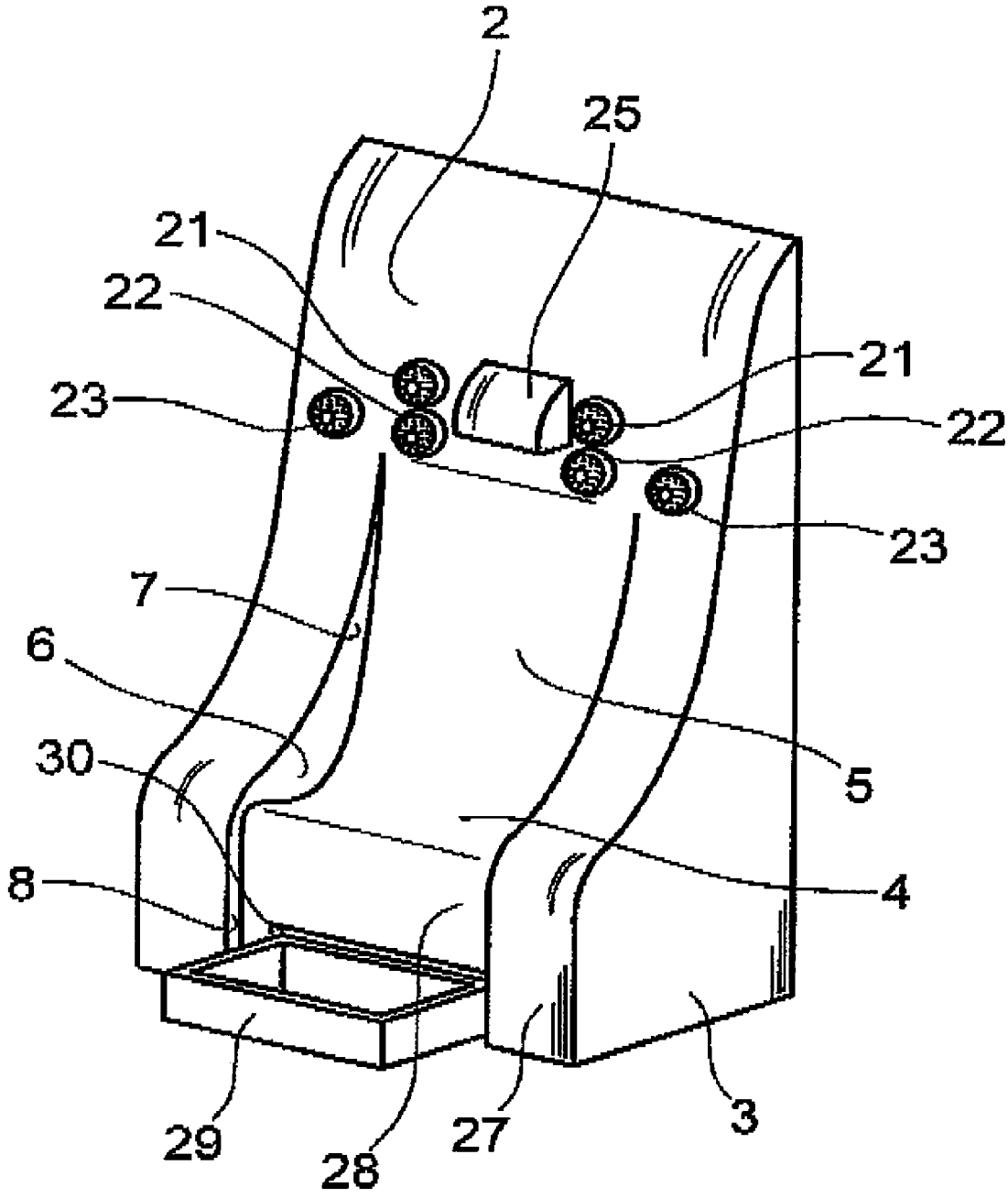
FIG. 16 is a perspective view schematically illustrating the appearance of a shower bathing apparatus according to a fourth embodiment of the invention, where a foot bathtub is placed on the bathroom floor.
Figure 17:
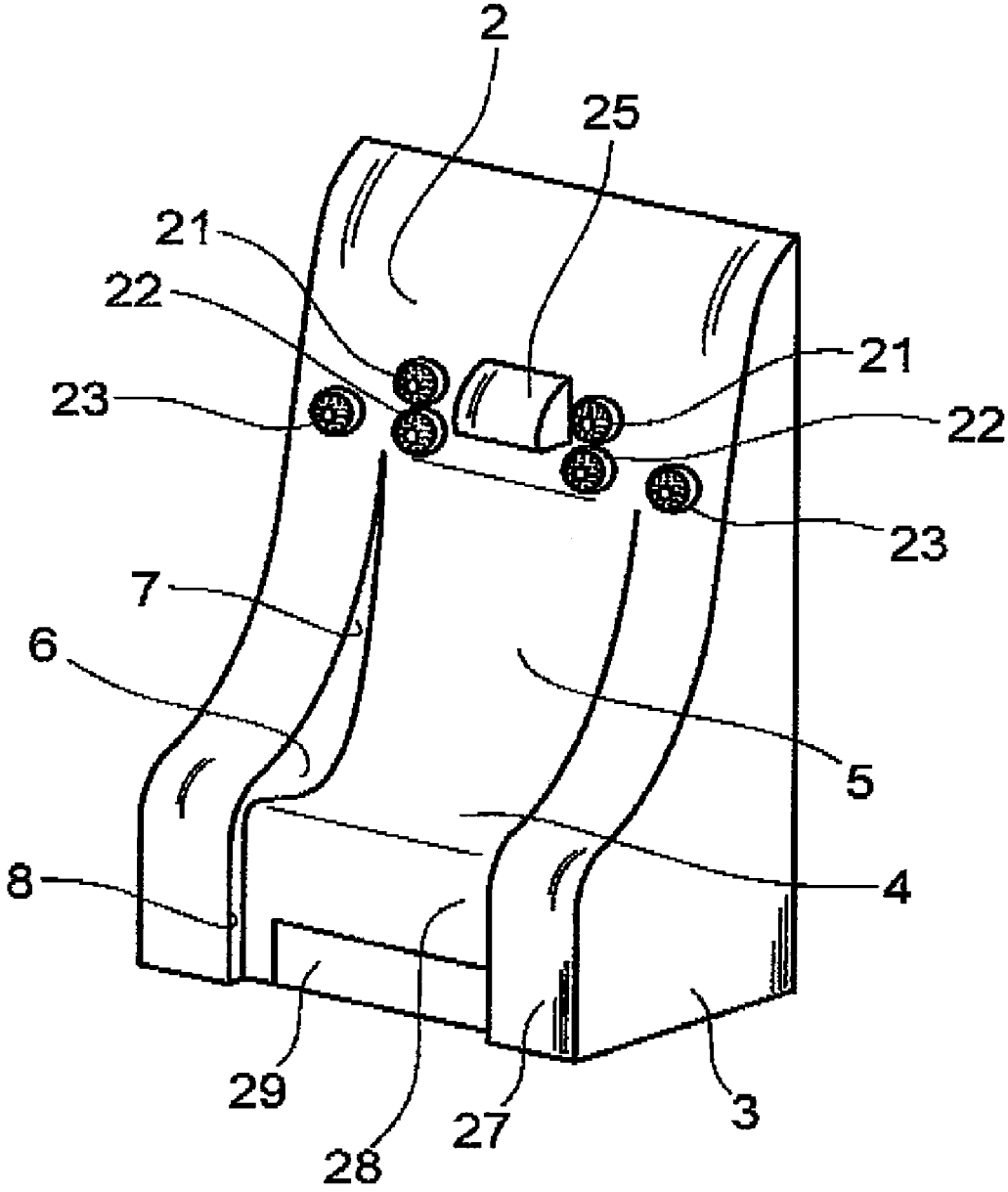
FIG. 17 is a perspective view schematically illustrating the appearance of the shower bathing apparatus according to the fourth embodiment of the invention, where the foot bathtub is housed in the base portion.

FIGS. 16 and 17 are perspective views schematically illustrating the appearance of a shower bathing apparatus according to a fourth embodiment of the invention.

In this embodiment, an opening 32 continued to the space inside the base portion 3 is formed in the recess 28 of the base portion 3 so that the foot bathtub 29 can be moved into and out of the base portion 3 through the opening 32.

When the shower bathing apparatus is not in use, the foot bathtub 29 can be housed in the base portion 3 as shown in FIG. 17. Thus the foot bathtub 29 disappears from the bathroom floor and does not obstruct cleaning, for example. Furthermore, the design is simplified and does not compromise the appearance inside the bathroom. Moreover, the foot bathtub 29 is not obstructive, for example, to the transfer of a user between a wheelchair and the seat 4, thus improving transferability.

Figure 18:
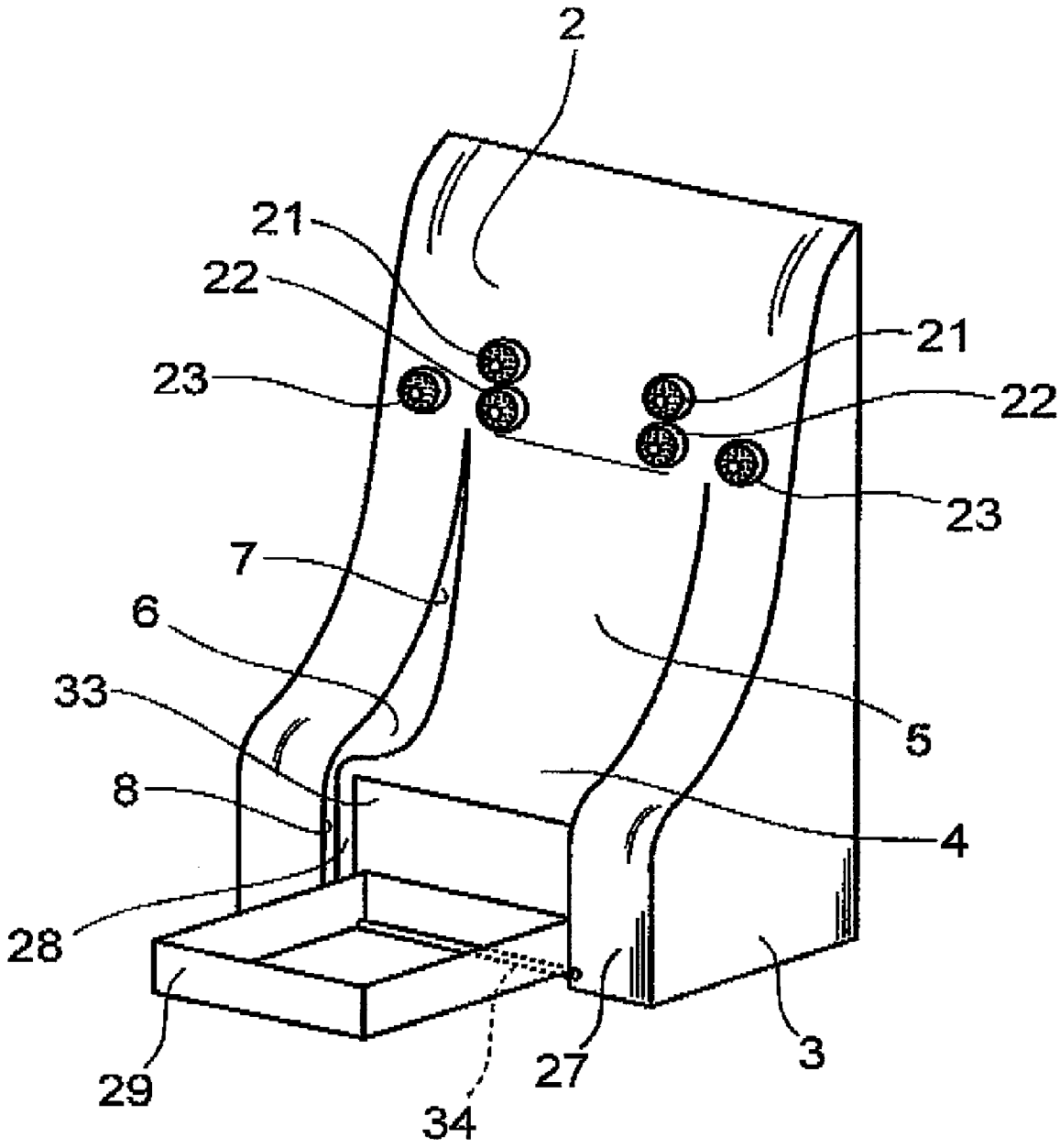
FIG. 18 is a perspective view showing another example structure for housing a foot bathtub, where the foot bathtub is placed on the bathroom floor.
Figure 19:
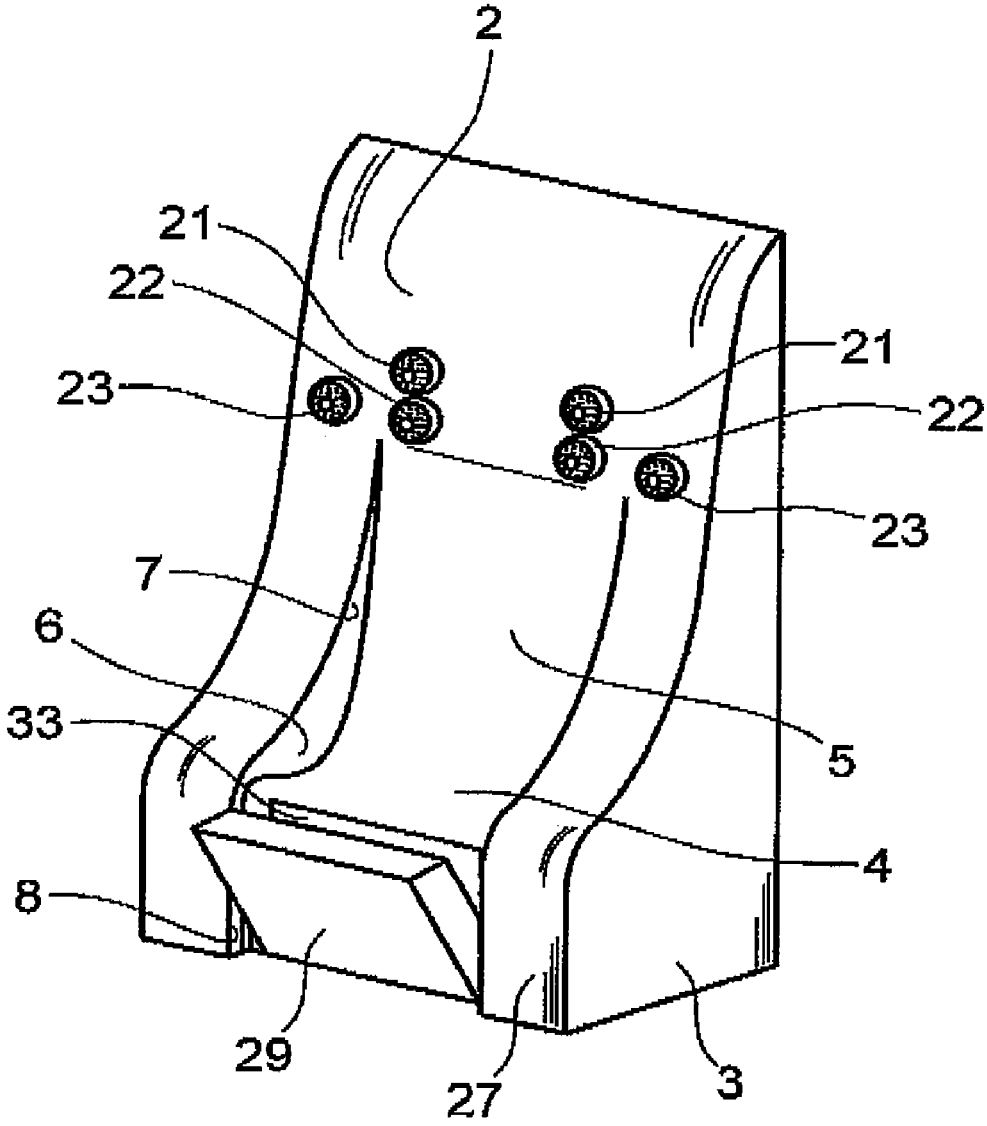
FIG. 19 is a perspective view where the foot bathtub shown in FIG. 18 is in rotation.

FIGS. 18 and 19 show another example structure for housing the foot bathtub 29.

In this example, the foot bathtub 29 is rotatable about a shaft 34 provided at its rear edge. The foot bathtub 29 can be housed in the base portion 3 and placed on the bathroom floor by rotation about the shaft 34. Also in this configuration, the foot bathtub 29 does not obstruct cleaning and has a simplified design and superior transferability.

Fifth Embodiment

Figure 20:
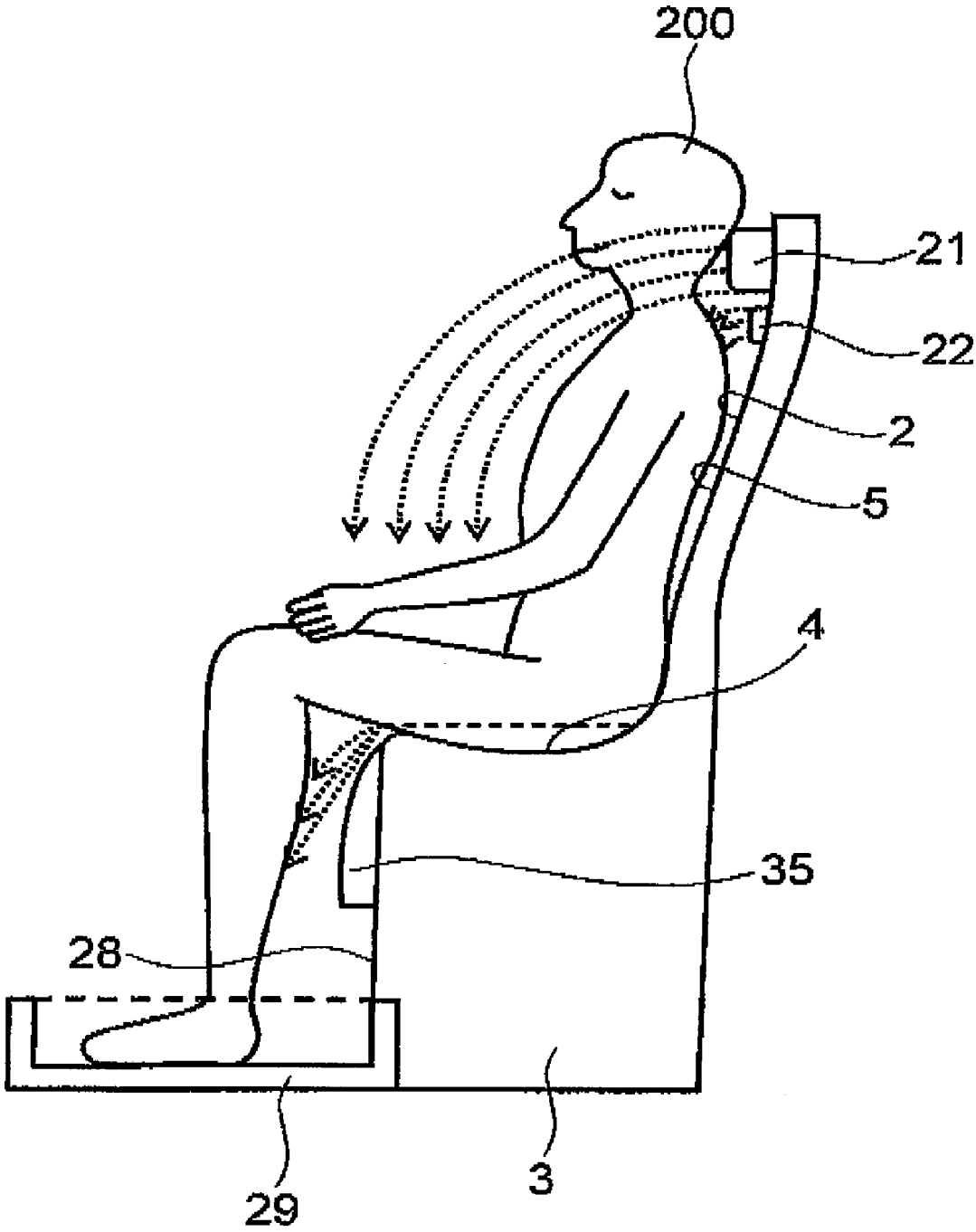
FIG. 20 is a schematic side cross-sectional view of a shower bathing apparatus according to a fifth embodiment of the invention.

FIG. 20 is a schematic side cross-sectional view of a shower bathing apparatus according to a fifth embodiment of the invention.

The recess 28 formed on the front portion of the base portion 3 serves as a guide portion for guiding water from the seat 4 to the foot bathtub 29. Additionally, in this embodiment, a guide portion 35 sloped forward and downward is provided upwardly to the recess 28 so as to guide the water falling from the seat 4 to the calves of the seat occupant 200. That is, the water from the seat 4 is allowed to flow in contact with the calves of the seat occupant 200 to the foot bathtub 29. Thus the hyperthermic effect on the calves is enhanced, and massage effect is achieved by the flow of water sweeping the calves.

Furthermore, wall portions 6 as illustrated in FIGS. 3A and 3B, for example, can be provided on both sides of the guide portion 35. Then the water overflowing forward of the seat 4 can be applied to the calves of the seat occupant 200 and guided to the foot bathtub 29 without lateral leakage. Any apparatus including such a guide portion 35 is also encompassed within the scope of the invention.

Sixth Embodiment

Figure 21:
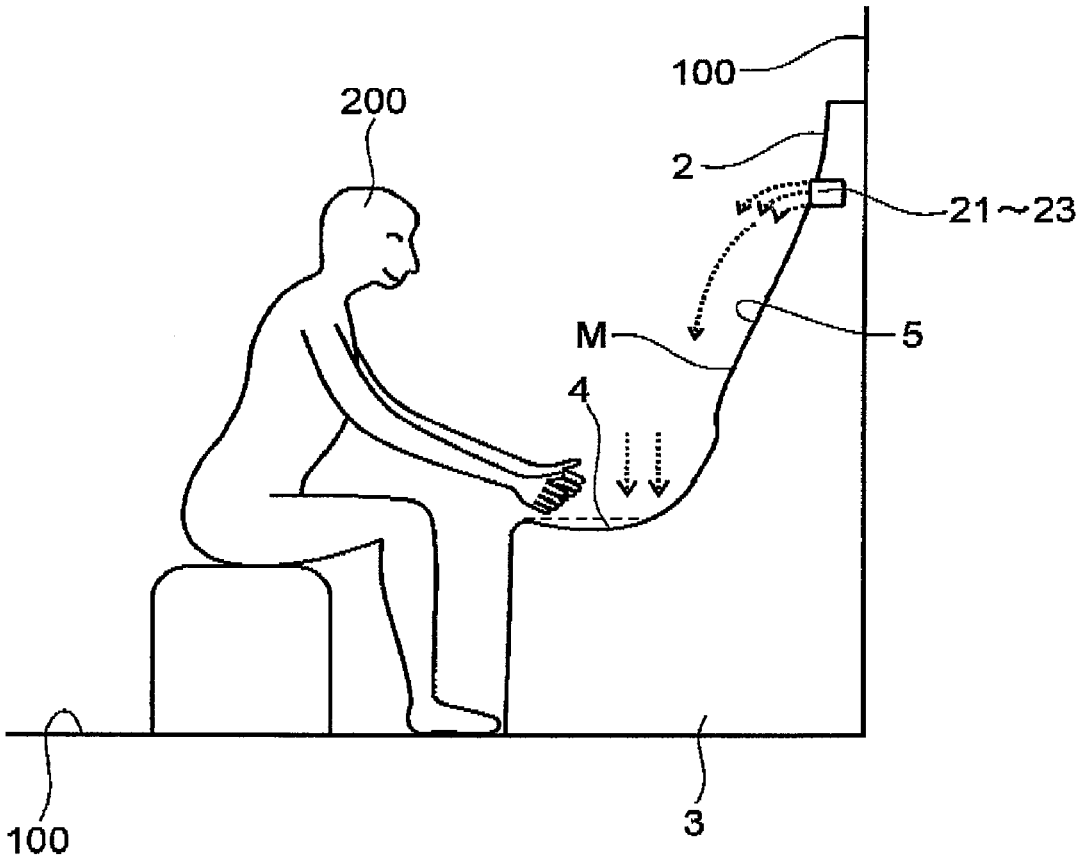
FIG. 21 is a schematic side cross-sectional view of a shower bathing apparatus according to a sixth embodiment of the invention.

FIG. 21 is a schematic side cross-sectional view of a shower bathing apparatus according to a sixth embodiment of the invention.

In this embodiment, a mirror M is provided as needed on the backrest 5 so that the shower bathing apparatus can be used as a washstand. That is, because of the concave configuration, the seat 4 can pool water and serve as a washbasin. This results in space savings and cost reduction because there is no need to prepare a separate washstand and washbasin. Furthermore, the seat 4 can also serve as a handrail, since it is designed to have sufficient strength for supporting a seat occupant seated thereon.

EXAMPLE

TABLE 1 summarizes the results of measuring the skin surface temperature of the back of a seat occupant in taking a shower bath with the backrest 5 and the seat 4 being concave ("Recessed") and flat ("Unrecessed"). TABLE 2 summarizes the results of measuring the skin surface temperature of the feet of a seat occupant in taking a shower bath with and without the foot bathtub 29 ("With foot bathtub" and "Without foot bathtub").

TABLE 1

| | Back skin surface temperature |
|---|---|
| Recessed | 35.3° C. |
| Unrecessed | 33.7° C. |

TABLE 2

| | Foot skin surface temperature |
|---|---|
| With foot bathtub | 26.9° C. |
| Without foot bathtub | 28.1° C. |

According to the results in TABLE 1, the hyperthermic effect on the back is greater for the concave backrest 5 and seat 4 than for flat ones. According to the results in TABLE 2, the hyperthermic effect on the feet is greater in the case with the foot bathtub 29 than in the case without the foot bathtub 29.

Figure 22:
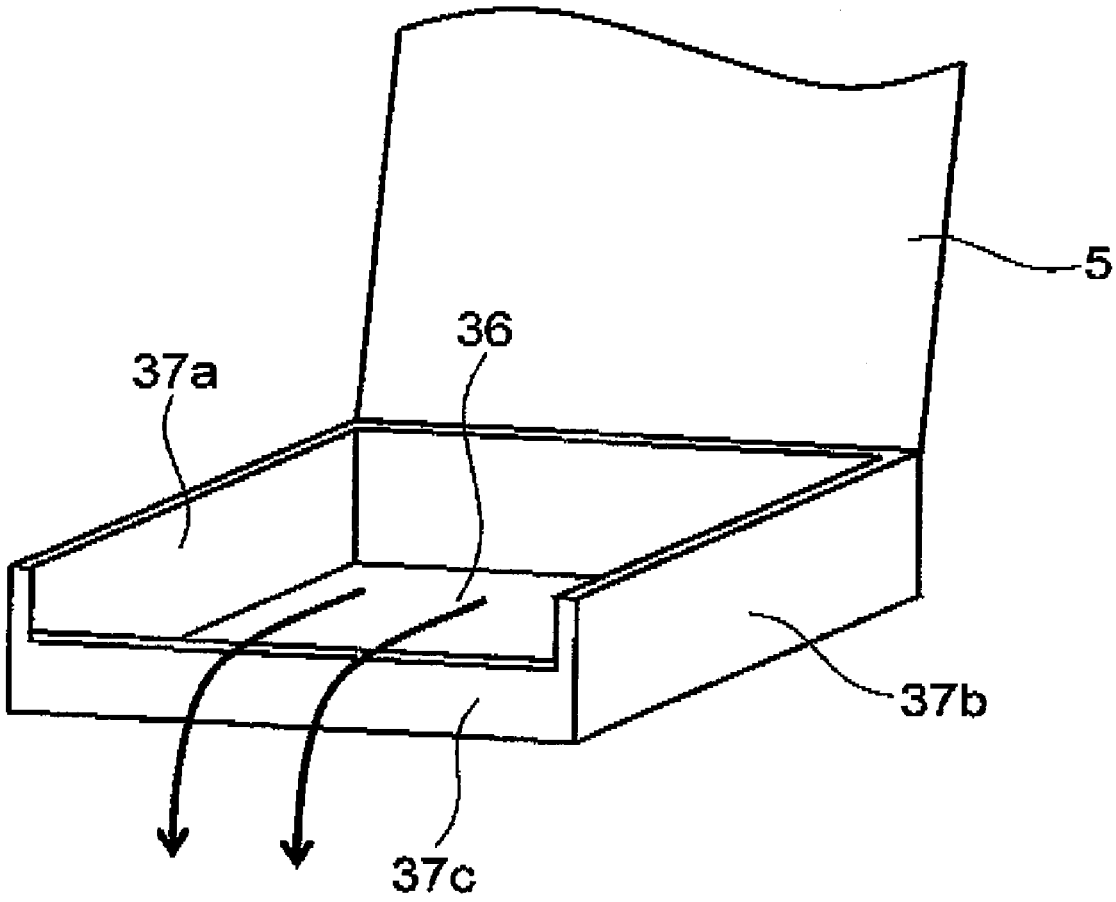
FIG. 22 is a schematic perspective view showing another example of the seat.

As shown in FIG. 22, the seat 36 may be configured as a box surrounded by wall portions 37*a*-37*c* on all four sides. Here, the wall portion 37*c* on the front-end side (on the side of the feet of the seat occupant) is lower than the lateral wall portions 37*a*, 37*b*. Then the water pooled in the seat 36 flows beyond the front-end wall portion 37*c* to the feet of the seat occupant and the foot bathtub without lateral leakage. Thus the feet can be warmed without wasting water.

Seventh Embodiment

Figure 23:
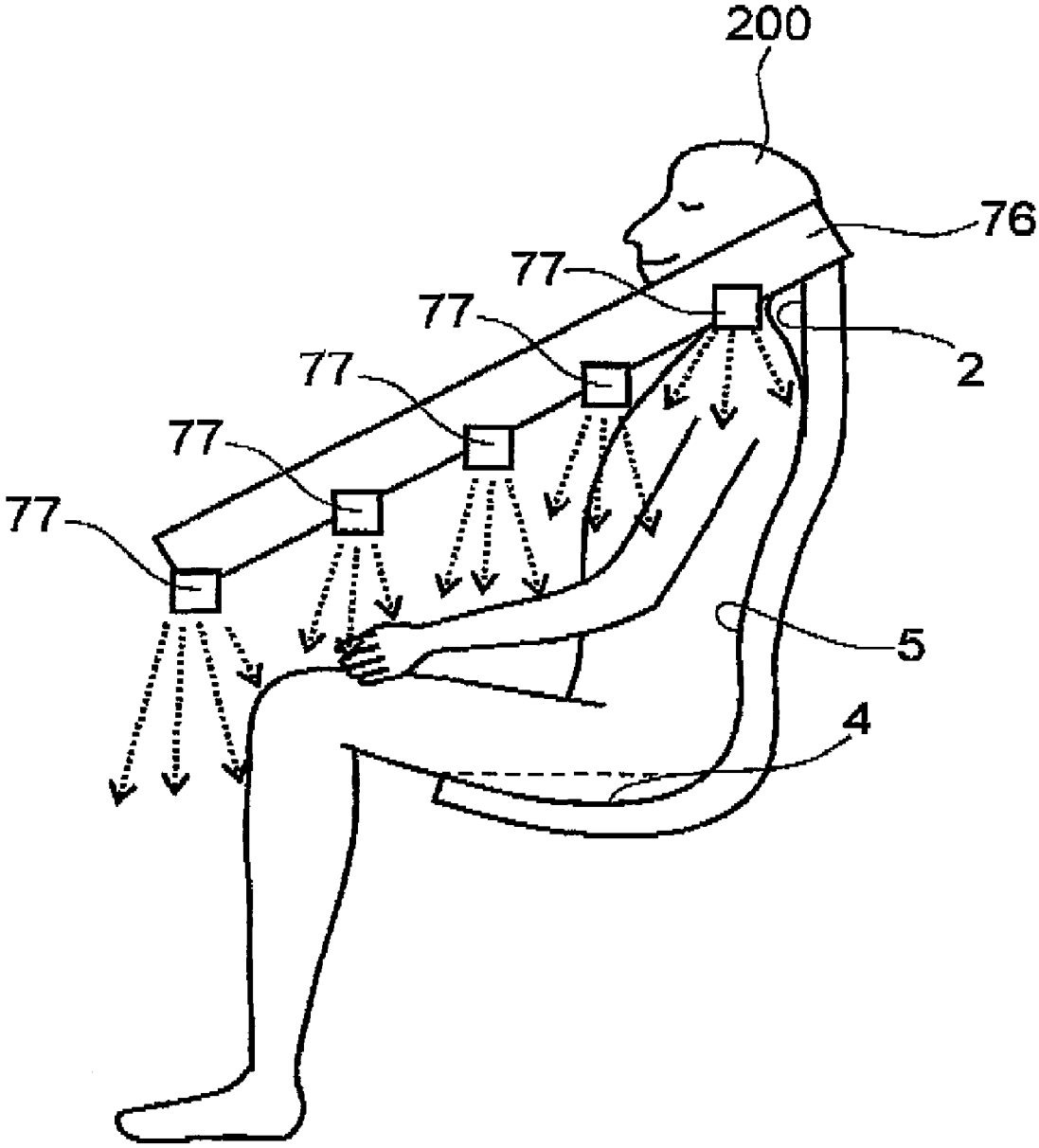
FIG. 23 is a schematic side cross-sectional view of a shower bathing apparatus according to a seventh embodiment of the invention.

FIG. 23 is a side view schematically showing a shower bathing apparatus according to a seventh embodiment of the invention.

In this embodiment, instead of the water dischargers 21-23 provided on the back portion 2 described above, an arm 76 extending forward of the back portion 2 is provided at the upper part of the back portion 2, and a plurality of water dischargers 77 are provided in the arm 76. The plurality of water dischargers 77 discharge shower flows toward the shoulders, arms, chest, and legs of a seat occupant seated on the seat 4.

Also in this embodiment, a user can take a shower flow discharged from the water dischargers 77 throughout the body while soaking in the water pooled in the seat 4. Thus the user can enjoy a sense of soaking in water similar to that felt in bathing in a bathtub (a sense of bathing), and a high hyperthermic effect is achieved despite shower bathing. Furthermore, water pressure applied to the body is lower than that for soaking in a bathtub and places less strain on the body. Because the apparatus can be used in a seated position without the need to move into and out of the bathtub, elderly and physically challenged users can also easily enjoy a high hyperthermic effect. Furthermore, because the user can take a shower simultaneously throughout the body rather than separately on each part of the body, the user can warm the body by taking a shower in a short time with saving water.

Eighth Embodiment

Figure 24:
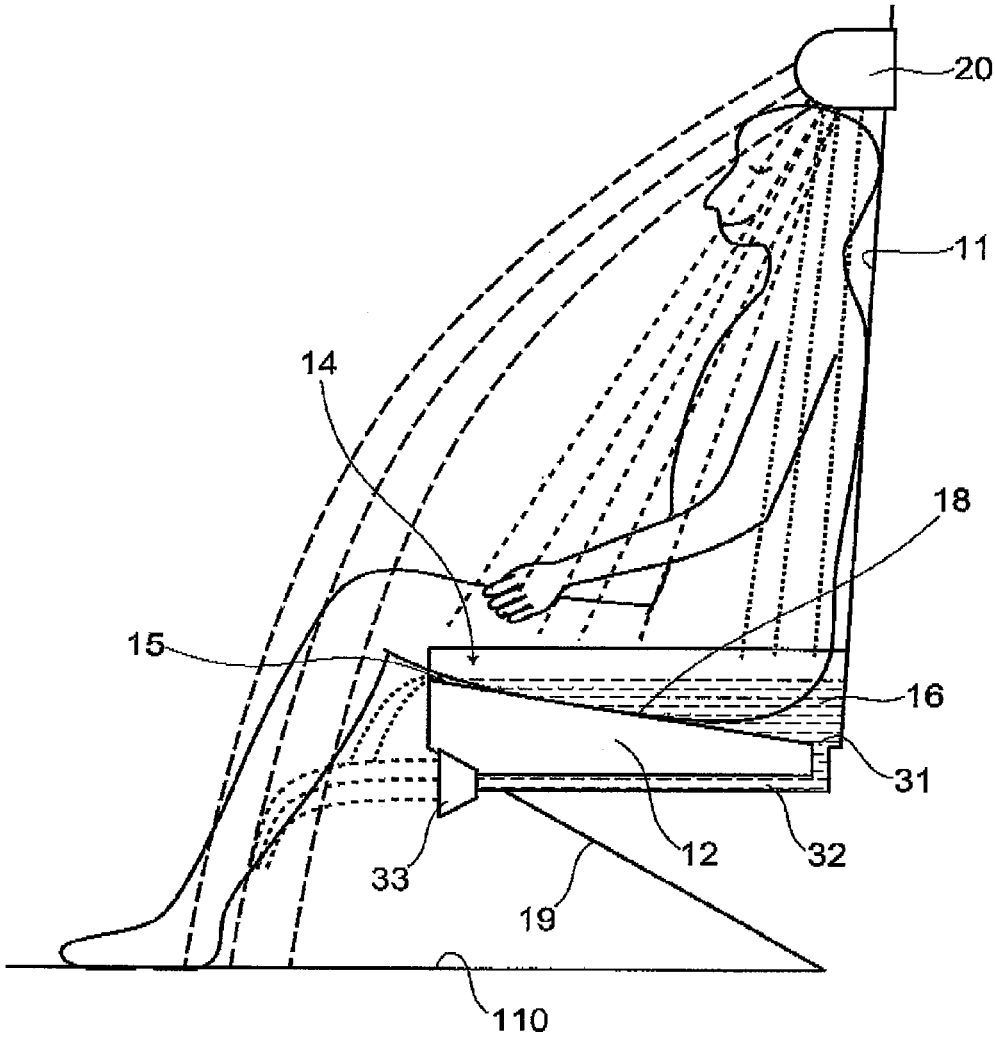
FIG. 24 is a schematic view of a shower apparatus according to an eighth embodiment of the invention as viewed from the lateral side.

FIG. 24 is a schematic view of a shower apparatus according to an eighth embodiment of the invention as viewed from the lateral side.

Figure 25:
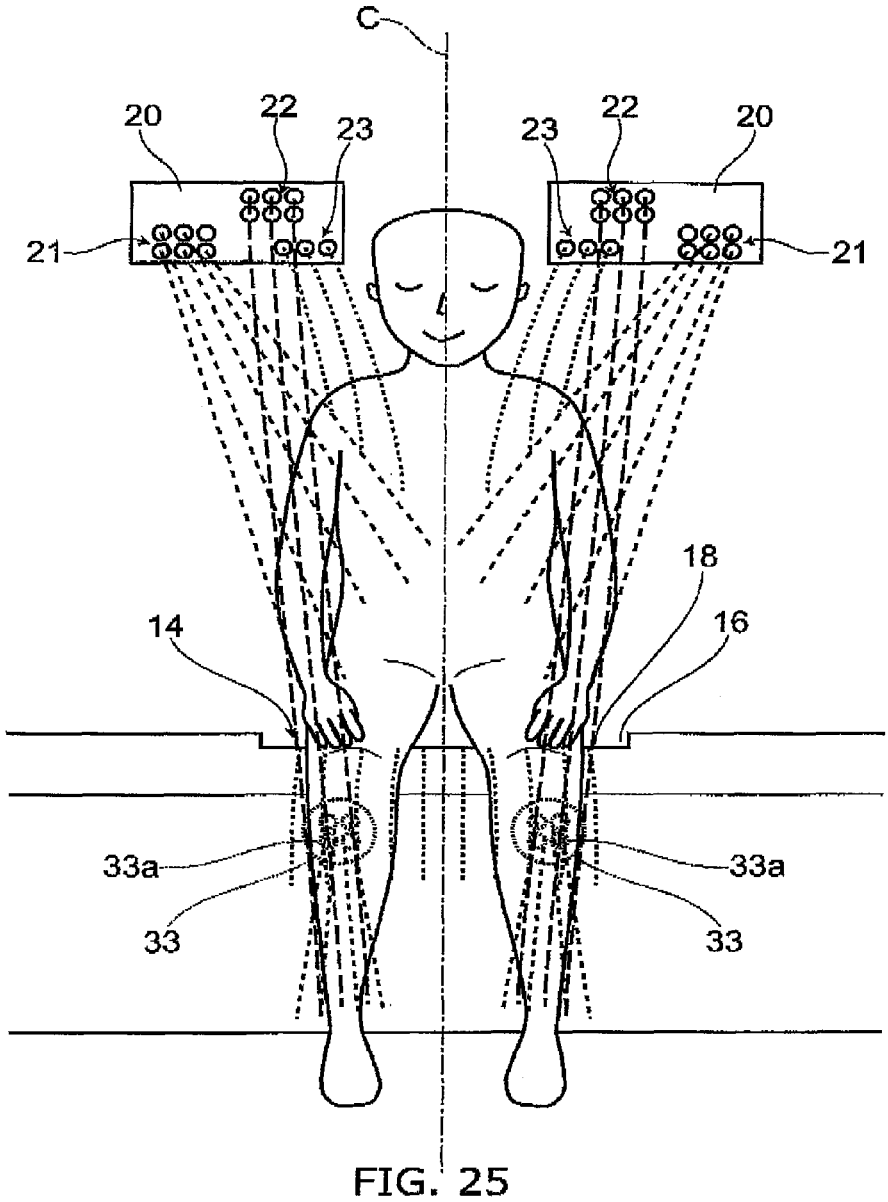
FIG. 25 is a schematic view of the shower apparatus as viewed from the frontside.

FIG. 25 is a schematic view of the shower apparatus as viewed from the frontside.

Figure 26:
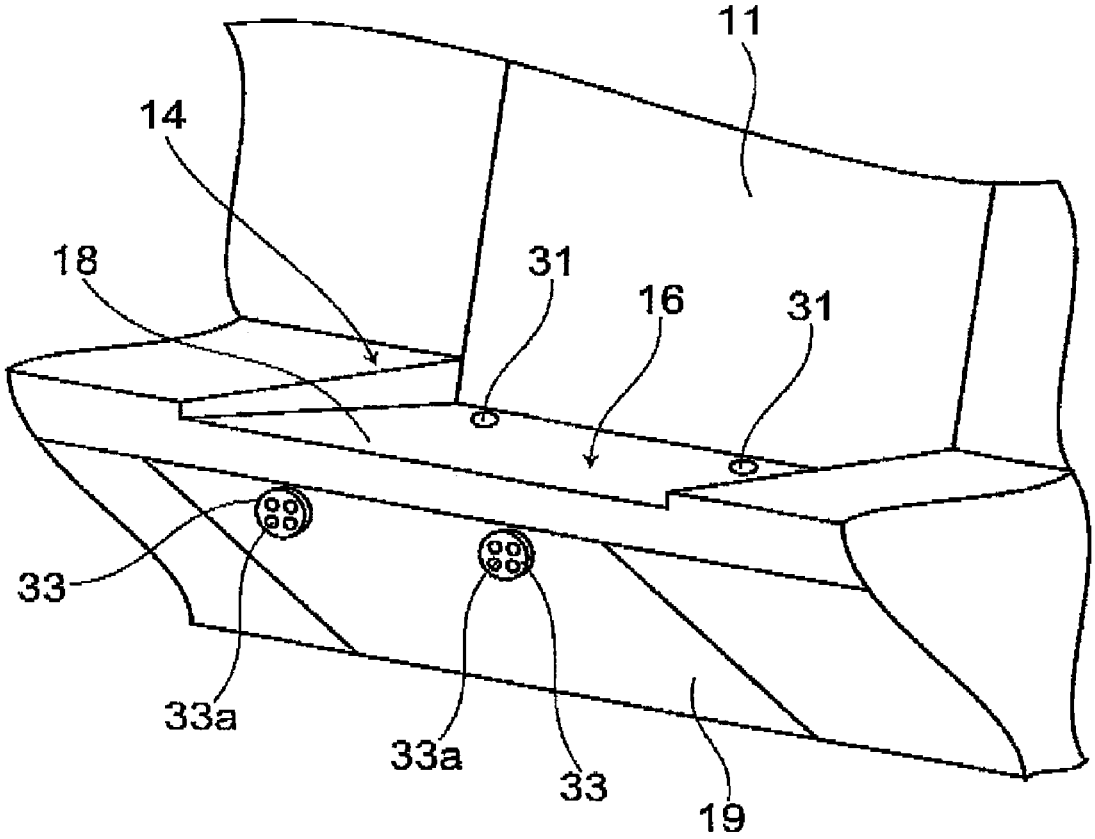
FIG. 26 is a perspective view schematically showing the main part of the shower apparatus.

FIG. 26 is a perspective view schematically showing the main part of the shower apparatus.

The shower apparatus according to this embodiment comprises a back portion 11 provided on a bathroom wall and a base portion 12 provided at the lower part of the bathroom wall on which the back portion 11 is provided. The back portion 11 may be constituted by the bathroom wall. That is, the bathroom wall itself may be used to serve as a back portion 11 for receiving the back of a seat occupant.

The base portion 12 protrudes inward of the bathroom from the back portion 11. On the top face of the base portion 12 is formed a seat 14, which has a recessed pool portion 16. The bottom face of the pool portion 16 serves as a seat surface 18 on which a user is seated with the buttocks being in contact therewith.

The seat surface 18 is sloped down along the depth (toward the back portion 11). That is, the recess of the pool portion 16 gradually deepens along the depth (toward the back portion 11).

As shown in FIG. 25, a pair of water dischargers 20 is provided on the back portion 11 upwardly to the seat 14. The pair of water dischargers 20 is provided on both sides of the center C of the seat 14. The user can place the head between the pair of water dischargers 20 with being seated on the seat 14. When the user is seated on the seat 4, the water dischargers 20 are located upwardly to the shoulders of the seated user.

Each water discharger 20 has a first to third water discharger 21-23. The first to third water dischargers 21-23 are arranged in a lateral direction generally perpendicular to the height. Each of the first to third water discharger 21-23 has a plurality of water discharge ports.

With respect to the center C of the seat 14, the third water discharger 23 is placed innermost, the second water discharger 22 is placed outside the third water discharger 23, and the first water discharger 21 is placed outside the second water discharger 22. The first to third water dischargers 21-23 are placed generally at the same height. Alternatively, the second water discharger 22 is placed slightly higher than the first water discharger 21 and the third water discharger 23. Each water discharger 21-23 discharges a water shower flow of e.g. about 40 to 45° C.

The water discharge direction of the shower flow from the second water discharger 22 is configured to be slightly downward relative to the horizontal.

The water discharge direction of the shower flow from the first water discharger 21 is configured to be directed from outside the seat occupant seated on the seat 14 (outside as viewed laterally in FIG. 25) to the vicinity of the acromion of the seat occupant.

The water discharge direction of the shower flow from the third water discharger 23 is configured to be directed to the shoulder near the base of the neck of the seat occupant seated on the seat 14.

The above water dischargers 21-23 discharge a shower flow from upward to the seat 14 and applies the shower flow to the frontside of the body (below the neck) of the seat occupant seated on the seat 14. Furthermore, this embodiment includes a legback warming means for warming the rear side of the legs of the seat occupant where the shower flow from the above water dischargers 21-23 is difficult to reach.

Specifically, the legback warming means has an opening 31 facing the pool portion 16, a legback feedwater channel 32 with its one end communicating with the opening 31, and a legback water discharger 33 provided below the seat surface 18 and communicating with the other end of the legback feedwater channel 32. The legback feedwater channel 32 is a piping provided inside the base portion 12 below the seat surface 18 and connecting the opening 31 to the legback water discharger 33, for example.

As shown in FIG. 26, two openings 31, for example, are provided on the bottom face (seat surface) 18 of the pool portion 16 on the back portion 11 side (near the boundary between the back portion 11 and the seat surface 18). Corresponding to the two openings 31, two legback water dischargers 33 and two legback feedwater channels 32 are provided. However, the number of openings 31, legback feedwater channels 32, and legback water dischargers 33 is not limited to two, but may be one, or three or more.

Below the seat 14, the base portion 12 has a sloped portion 19 sloped downward from the front facing the bathroom to the back where the bathroom wall is provided. Between the sloped portion 19 and the bathroom floor 110, there is a space having a height gradually decreasing backward (toward the bathroom wall). This space enables the seat occupant seated on the seat to avoid hitting the heel against the base portion 12 when retracting the leg backward.

The legback water discharger 33 is provided at the upper part (frontside) of the sloped portion 19 and placed nearly as high as the seat surface 18. The legback water discharger 33 is placed below the opening 31 and the level of water pooled in the pool portion 16. As described later, the water head difference between the level of water pooled in the pool portion 16 and the legback water discharger 33 causes the water pooled in the pool portion to flow through the opening 31 and the legback feedwater channels 32 and to be discharged forward (on the bathroom side) of the legback water discharger 33. Hence the legback water discharger 33 only needs to be placed below the level of water pooled in the pool portion, and may be placed as high as or higher than the opening 31.

Furthermore, the legback water discharger 33 is placed backward (on the bathroom wall side) of the front edge 15 of the seat 14 (base portion 12), and does not protrude forward (on the bathroom side) from the front edge 15 of the seat 14 (base portion 12).

As shown in FIG. 25, a pair of legback water dischargers 33 is placed generally at the same height, and spaced in a lateral direction generally perpendicular to the height. Each legback water discharger 33 has a plurality of water discharge ports 33*a*.

Next, the function of the shower apparatus according to this embodiment is described.

In FIGS. 24 and 25, the shower flow discharged from each water discharger 21-23, 33 and the falling water overflowing the front edge of the pool portion 16 are shown by dashed lines.

In the pair of water dischargers 20 provided on the back portion 11 upwardly to the seat 14, each second water discharger 22 discharges a shower flow of water that is ejected slightly downward relative to the horizontal and falling around the front edge 15 of the seat 14. From another viewpoint, the second water discharger 22 discharges a shower flow over the shoulder of the seat occupant along an arc extending forward of the seat occupant under its own weight, and the shower flow falls around the leg particularly centering on the thigh of the seat occupant. Here the shower flow may fall also on the abdomen in addition to the leg of the seat occupant. The shower flow flows on the surface of the leg from the knee toward the foot of the seat occupant.

The second water dischargers 22 are provided rearwardly to the seat occupant and near the head, which is distant from the legs of the seat occupant. Even in this configuration, the water discharge flow can reliably reach the leg without being blocked by the seat occupant and to warm also the leg below the knee by discharging water over the shoulder of the seat occupant.

The third water discharger 23 discharges a shower flow toward the shoulder near the base of the neck of the seat occupant. Part of the shower flow impinging on the shoulder flows on the front and lateral portion of the body extending from the chest to the trunk of the seat occupant, and the other part of the shower flow impinging on the shoulder is wrapped around to the back. Thus both the front and back of the body of the seat occupant can be warmed. Furthermore, the massage effect by the shower flow can also be allowed to act on the shoulder.

The first water discharger 21 discharges a shower flow toward the acromion of the seat occupant. The shower flow impinging on the acromion flows on and warms the part around the center of the arm and the lateral portion of the trunk that cannot be covered by the shower flow from the second water dischargers 22 and the third water dischargers 23.

The water wrapped around to the backside of the seat occupant continuously flows along the back of the seat occupant or the back portion 11 toward the seat 14. This avoids developing a temperature boundary layer between the back of the seat occupant and the back portion 11 and facilitates conduction of heat from the water to the back of the seat occupant. Simultaneous warming of the backside in addition to the front of the body can enhance the hyperthermic effect even at a low flow rate, and also save water and energy by saving the amount of water used.

The water discharged from the water dischargers 21-23 flows along the body surface of the seat occupant or the back portion 11 and is pooled in the concave pool portion 16 provided in the seat 14. The water pooled in the pool portion 16 ensures that at least the rear side of the buttocks and thighs of the seat occupant is in contact with water. Thus it is possible to efficiently warm the buttocks and the vicinity of the waist where the shower flow from the water dischargers 21-23 does not directly reach. Furthermore, warming the waist and the buttocks also serves to promote healthy intestinal motility.

Along the body surface of the seat occupant or the back portion 11, water continuously flows into the pool portion 16. This flow avoids developing a temperature boundary layer between the seat occupant and the seat surface 18 and facilitates conduction of heat from the water to the buttocks and thighs of the seat occupant. Thus the hyperthermic effect can be enhanced.

As shown in FIG. 26, the pool portion 16 is formed as a recess surrounded on three sides other than the front edge on the bathroom side. Hence it is possible to prevent lateral leakage of water and to efficiently use the water from the water dischargers 21-23 without waste.

Part of the water pooled in the pool portion 16 flows out of the front edge on the bathroom side toward the legback of the seat occupant and warms the legback. However, because this uses the water spontaneously overflowing the pool portion 16, the water may fail to flow out swiftly and to reach on the legback depending on the amount of water discharged from the water dischargers 21-23 and the amount of water pooled in the pool portion 16.

However, in this embodiment, the water head difference between the level of water pooled in the pool portion 16 and the legback water discharger 33 causes the water pooled in the pool portion 16 to flow through the opening 31 and the legback feedwater channels 32 and to be discharged from the legback water discharger 33. This does not use spontaneous overflow of water from the pool portion 16, but uses the above water head difference to actively eject a shower flow from the legback water discharger 33 provided at the portion facing the rear side of the legs. Thus the shower flow can reliably reach on the legback of the seat occupant.

As a result, in a sitting position on the seat 14, it is possible to warm the legback (back of calves, Achilles tendons, heels, etc.) where the shower flow from upward to the seat 14 cannot reach because it is obstructed by the seat 14. Thus promotion of blood circulation and alleviation of lymph stagnation and edema can be achieved in the legs.

In general, in sitting with the buttocks being in contact with the seat surface 18, the kneeback is located nearly as high as (the front edge of) the seat surface 18. Hence the legback water discharger 33 placed nearly as high as (the front edge of) the seat surface 18 allows the water discharge flow from the legback water discharger 33 to easily reach on the calves and to reliably warm the calves. Furthermore, if the water discharge flow reaches on the calves, the water also naturally flows down the calves to the heels and toes, which can be warmed indirectly even if the water discharge flow does not directly reach thereon. The water discharge angle (with reference to the vertical) of the water discharge flow from the legback water discharger 33 is preferably designed to be larger than the water discharge angle (with reference to the vertical) of the water discharge flow from the water dischargers 21-23 in which the shower flow is dropped from upward and reaches the frontside of the body.

From the viewpoint of preventing the interference with the legs of the seat occupant seated on the seat 14, the legback water discharger 33 is preferably placed more backward (toward the bathroom wall) than the front edge 15 of the seat 14.

As shown in FIG. 25, two legback water dischargers 33 are spaced in a lateral direction generally perpendicular to the height. The distance between the two legback water dischargers 33 is typically designed to correspond to the spacing between the legs of a seat occupant seated on the seat 14. Hence it is possible to apply water simultaneously to both legs of the seat occupant.

Figure 27:
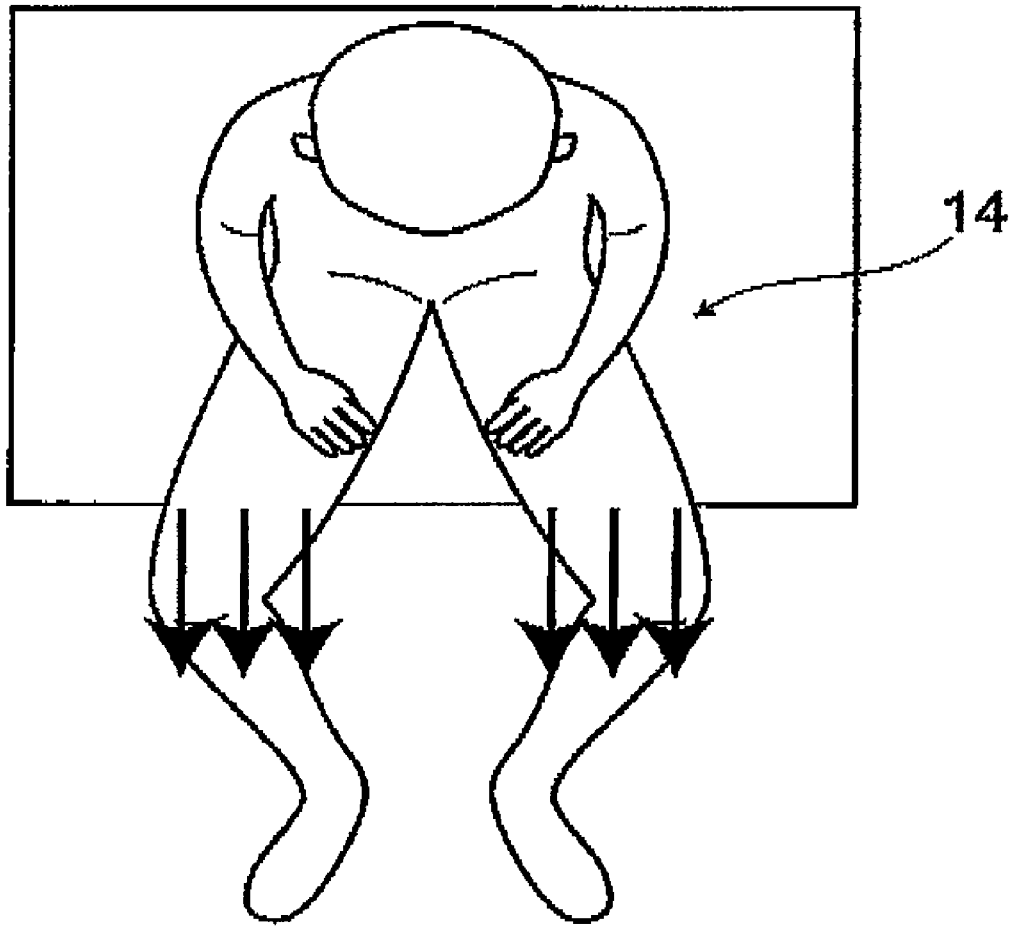
FIG. 27 is a schematic view showing a bow-legged position of a seat occupant.
Figure 28:
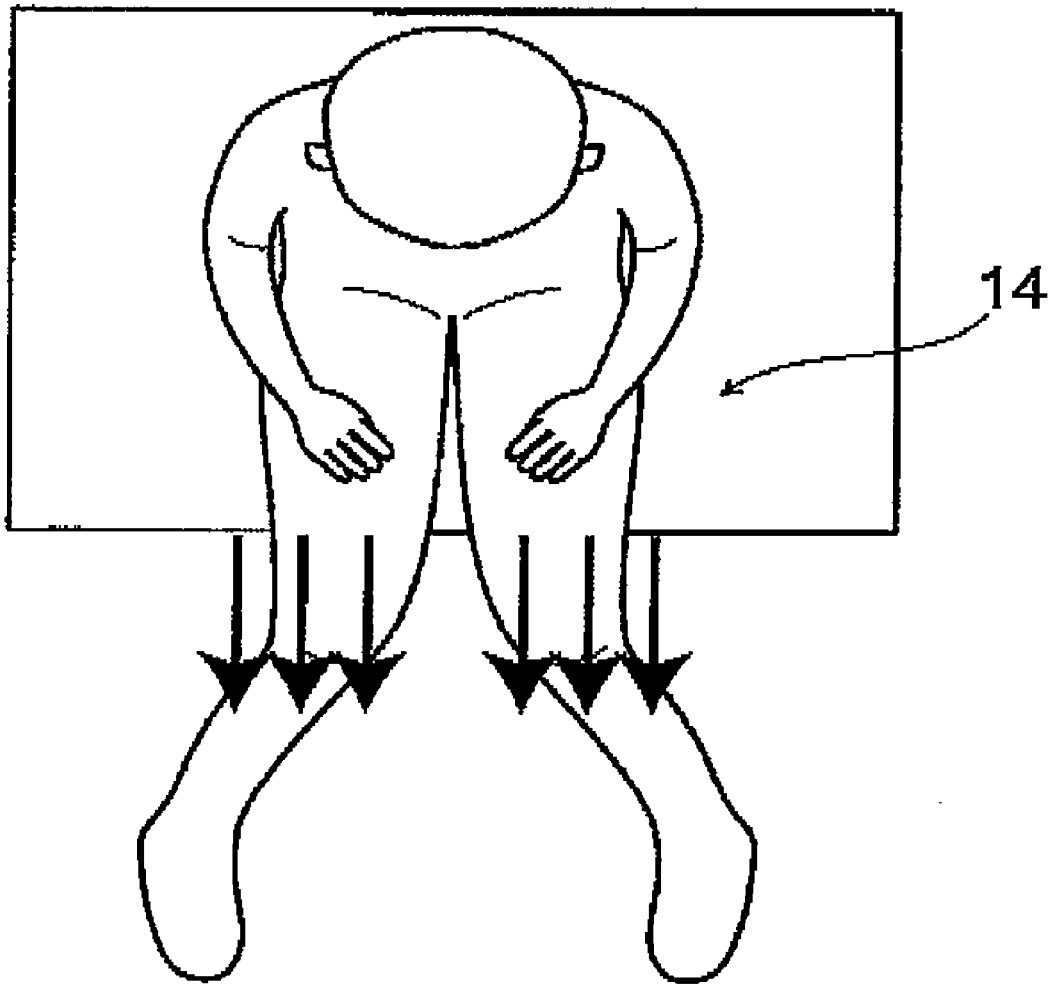
FIG. 28 is a schematic view showing a knock-kneed position of a seat occupant.

Each legback water discharger 33 has a plurality of water discharge ports 33*a* and discharges a diffuse shower flow. Thus various sitting postures can be supported. For example, typically, men sit in a bow-legged position where the legs are opened outward at the knees as shown in FIG. 27, whereas women sit in a knock-kneed position where the calves are diverged as shown in FIG. 28. In this respect, a plurality of legback water dischargers 33 arranged in a lateral direction discharge a diffuse shower flow, which allows a seat occupant to receive water at the legback not in a forced position but in a natural sitting position.

Figure 29:
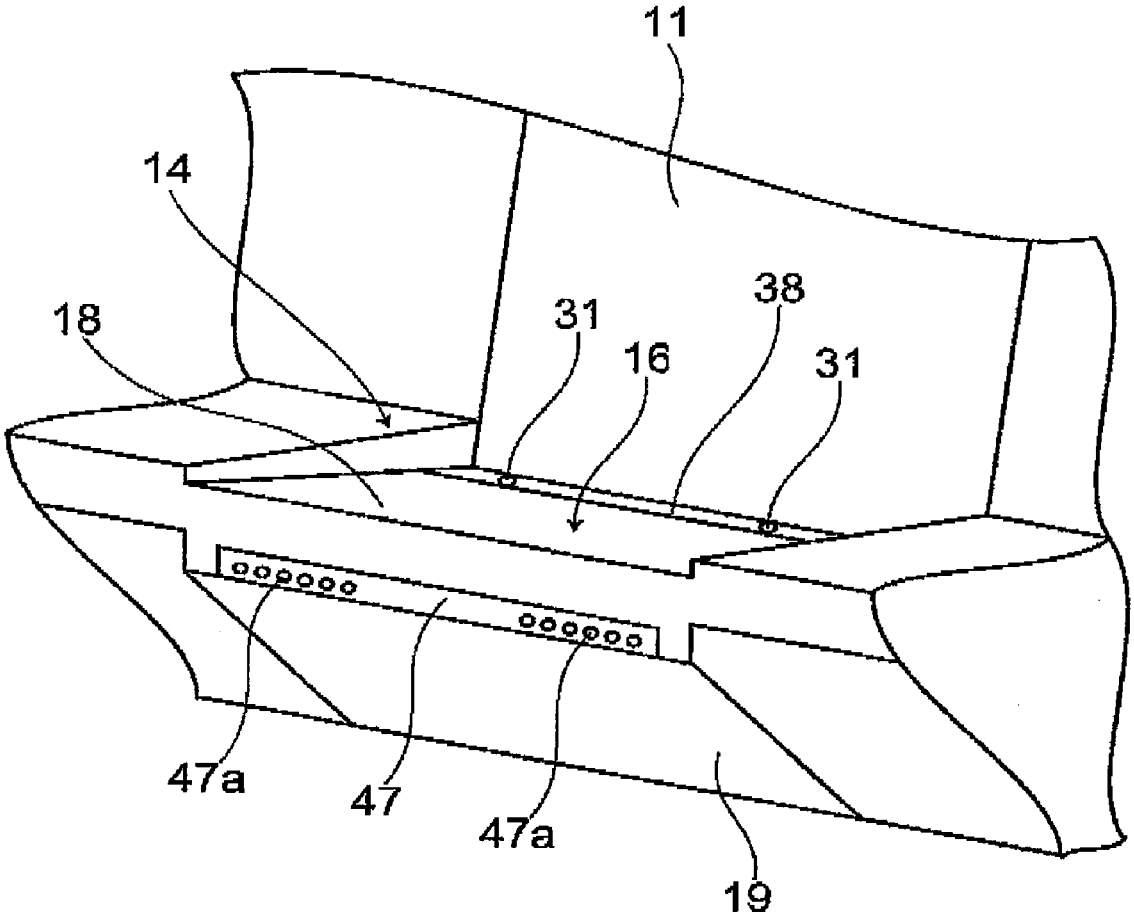
FIG. 29 is a schematic view showing another example of the legback water discharger in the embodiment of the invention.

The legback water discharger is not limited to a circular head configuration. As shown in FIG. 29, it is also possible to use a horizontally oriented legback water discharger 47 having a plurality of water discharge ports 47*a* that are aligned laterally.

As described above, according to this embodiment, in a sitting position while soaking in the water pooled in the pool portion 16, a user can take a shower flow from the water dischargers 21-23, 33 throughout the body except upward to the neck. Thus the user can enjoy a sense of soaking in water (a sense of bathing), and a high hyperthermic effect is achieved despite shower bathing. Furthermore, water pressure applied to the body is lower than that for soaking in a bathtub and places less strain on the body. Moreover, because the difference between the standing and sitting position is smaller than for bathtub bathing, the blood pressure variation is further decreased, which improves safety. Furthermore, because the apparatus can be used in a seated position without the need to move into and out of the bathtub, elderly and physically challenged users can also easily enjoy a high hyperthermic effect. Furthermore, because the user can take a shower simultaneously throughout the body rather than separately on each part of the body, the user can warm the body by taking a shower in a short time with saving water.

The "shower flow" described above includes both a shower flow that is discharged in a linear continuous flow and a shower flow that is discharged in droplets (mist flow) at the moment of being discharged from the water discharger 21-23, 33. Each water discharger 21-23, 33 discharges a continuous shower flow of water rather than mist. Hence the ambient space is not filled with an atmosphere of high temperature and humidity as in the case of spraying mist, and dizziness can be prevented. Furthermore, because the shower flow has a smaller temperature decrease of discharged water due to heat of vaporization than mist, there is no need to set the shower flow temperature higher than needed, achieving greater economy.

The water discharged from the water dischargers 21-23 for warming the portions other than the legback and pooled in the pool portion 16 of the seat 14 is reused as the water for warming the legback, thus achieving greater economy.

The bottom face of the pool portion 16 is sloped down backward on the back portion 11 side from the front on the bathroom side. The opening 31 is provided on the back portion 11 side of the bottom face of the pool portion 16. Hence, after use, the water remaining in the pool portion 16 can be drained away through the opening 31, the legback feedwater channel 32, and the legback water discharger 33. Thus no water is left in the pool portion 16 after use, achieving good cleanability and avoiding water stain.

The bottom face of the pool portion 16 having the opening 31 also serves as a seat surface 18. Hence the opening 31 is preferably provided near the boundary between the seat surface 18 and the back portion 11 so as to prevent the opening 31 from being occluded by the buttocks or the rear side of the thigh of the seat occupant. In this case, the above slope of the seat surface 18 can be used to guide the water remaining in the pool portion 16 to the opening 31, which facilitates drainage.

As shown in FIG. 29, a laterally extending gutter 38 can be provided in the seat surface 18 near the boundary with the back portion 11, and the opening 31 can be formed in the gutter 38. Then, even if the buttocks of the seat occupant are placed upwardly to the opening 31, the water pooled in the pool portion 16 can be guided through the gutter 38 to the opening 31. In this case, the opening 31 and the gutter 38 may be provided other than on the back portion 11 side.

Ninth Embodiment

In the shower apparatus according to this embodiment, the water discharge direction of the legback water discharger 33 is adjustable. By suitable configuration of the water discharge direction, it is possible to warm the legback depending on the user preference.

Figure 30:
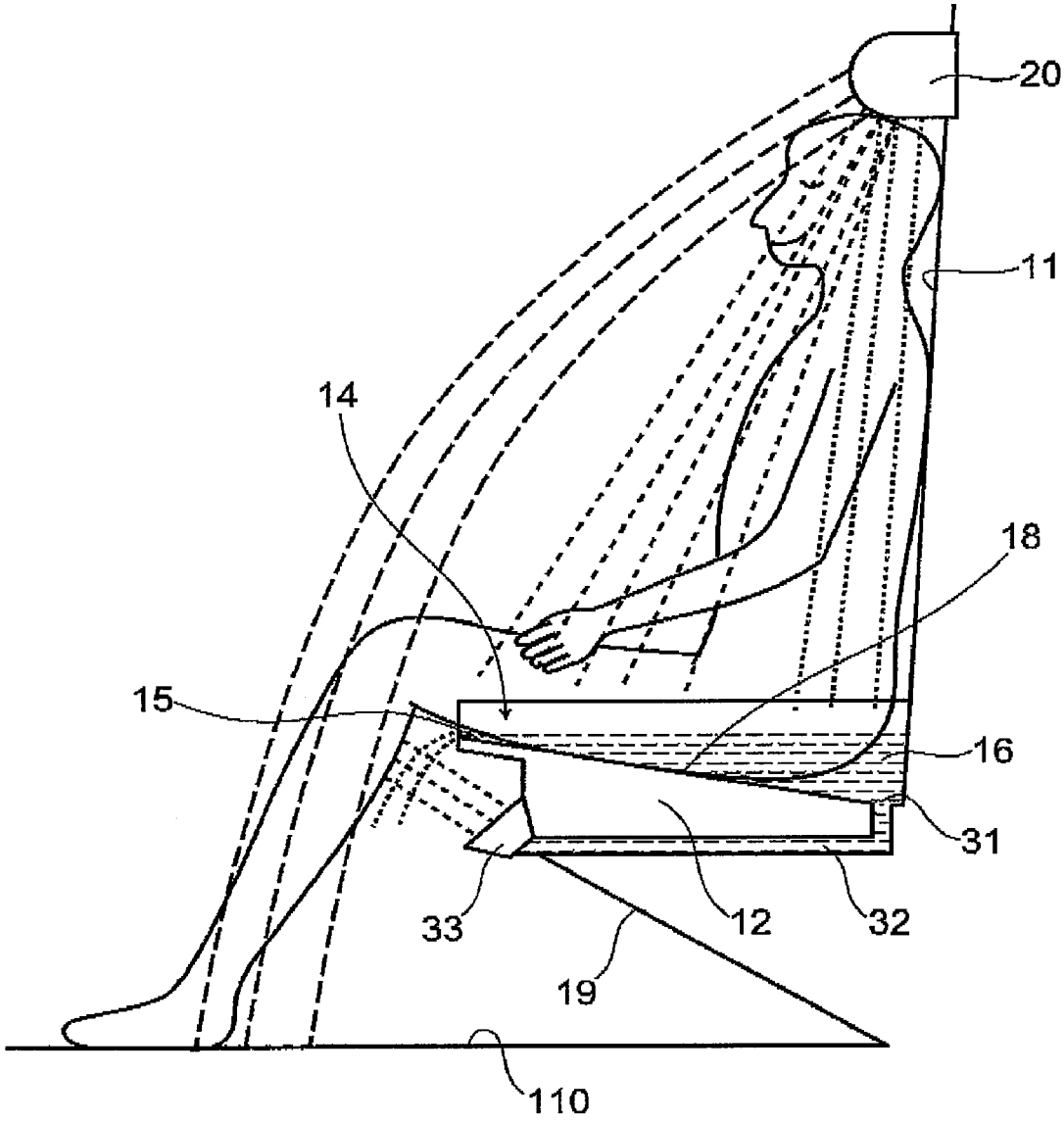
FIG. 30 is a schematic view of a shower apparatus according to a ninth embodiment of the invention where the legback water discharger is directed obliquely upward.

For example, as shown in FIG. 30, the water discharge surface having the water discharge ports of the legback water discharger 33 can be directed obliquely upward. This allows the shower flow discharged from the legback water discharger 33 to easily reach the vicinity of the kneeback of the seat occupant and to reliably warm the kneeback. Because the kneeback has little fat and muscle, the water discharge flow directly applied to the kneeback easily promotes blood circulation and provides a high hyperthermic effect.

Figure 31:
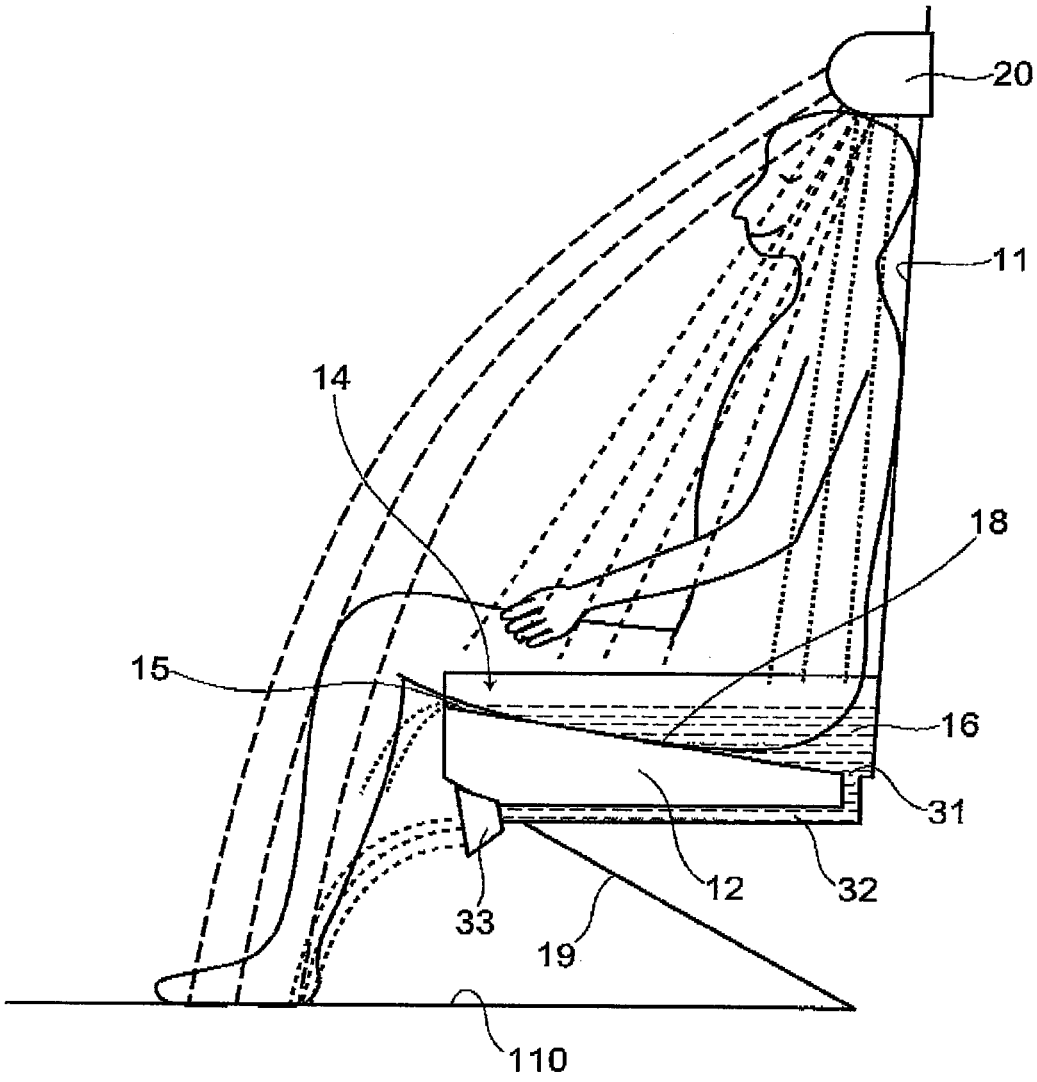
FIG. 31 is a schematic view of a shower apparatus according to the ninth embodiment where the legback water discharger is directed obliquely downward.

Furthermore, as shown in FIG. 31, for example, the water discharge surface of the legback water discharger 33 can be directed obliquely downward to intensively warm the calves and the feet therebelow.

If the user does not desire to directly receive the shower flow from the legback water discharger 33, the water discharge direction of the legback water discharger 33 is directed to the bathroom floor 110. Then the sole, calf, and kneeback can be indirectly warmed by the water falling on the bathroom floor 110 and flowing to the toes and by the steam rising from the bathroom floor 110. In this case, the flow of water concentrates on the vicinity of the toes, and hence the soles can be also warmed.

Figure 32:
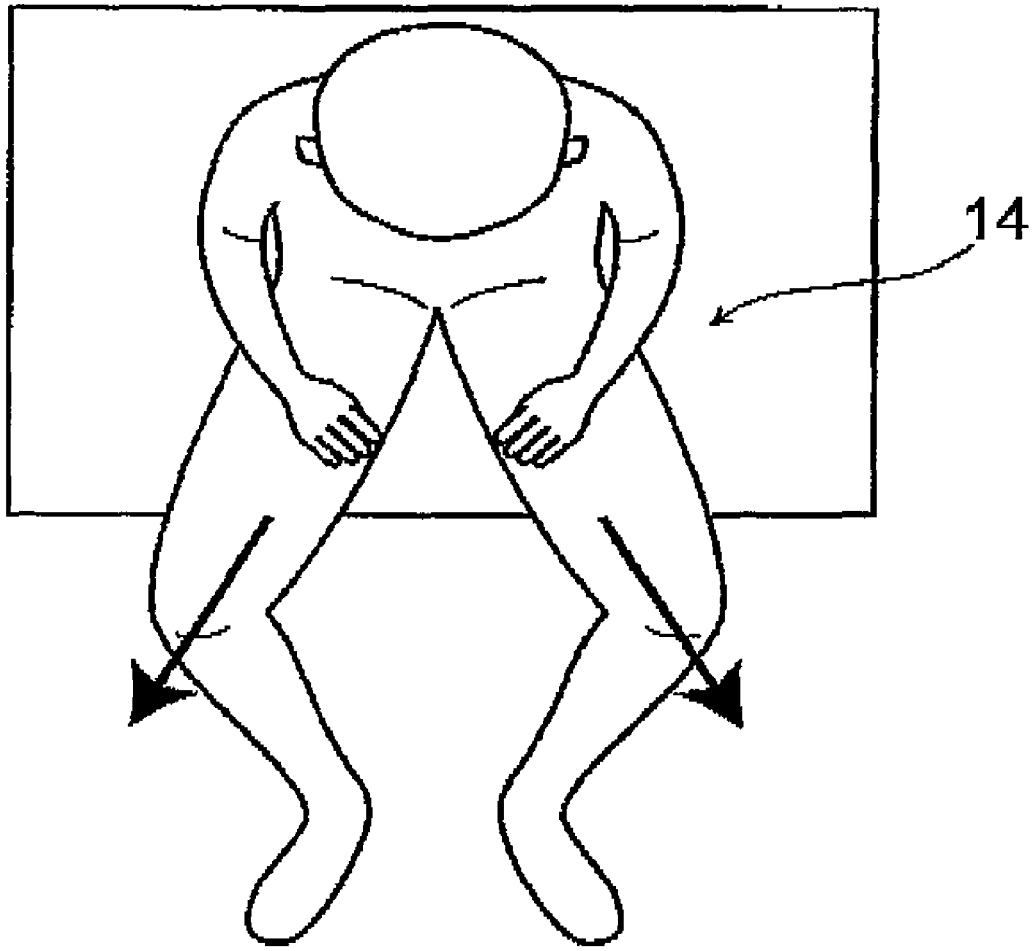
FIG. 32 is a schematic view showing the direction of water discharge from the legback water discharger adapted to a seat occupant sitting in a bow-legged position.
Figure 33:
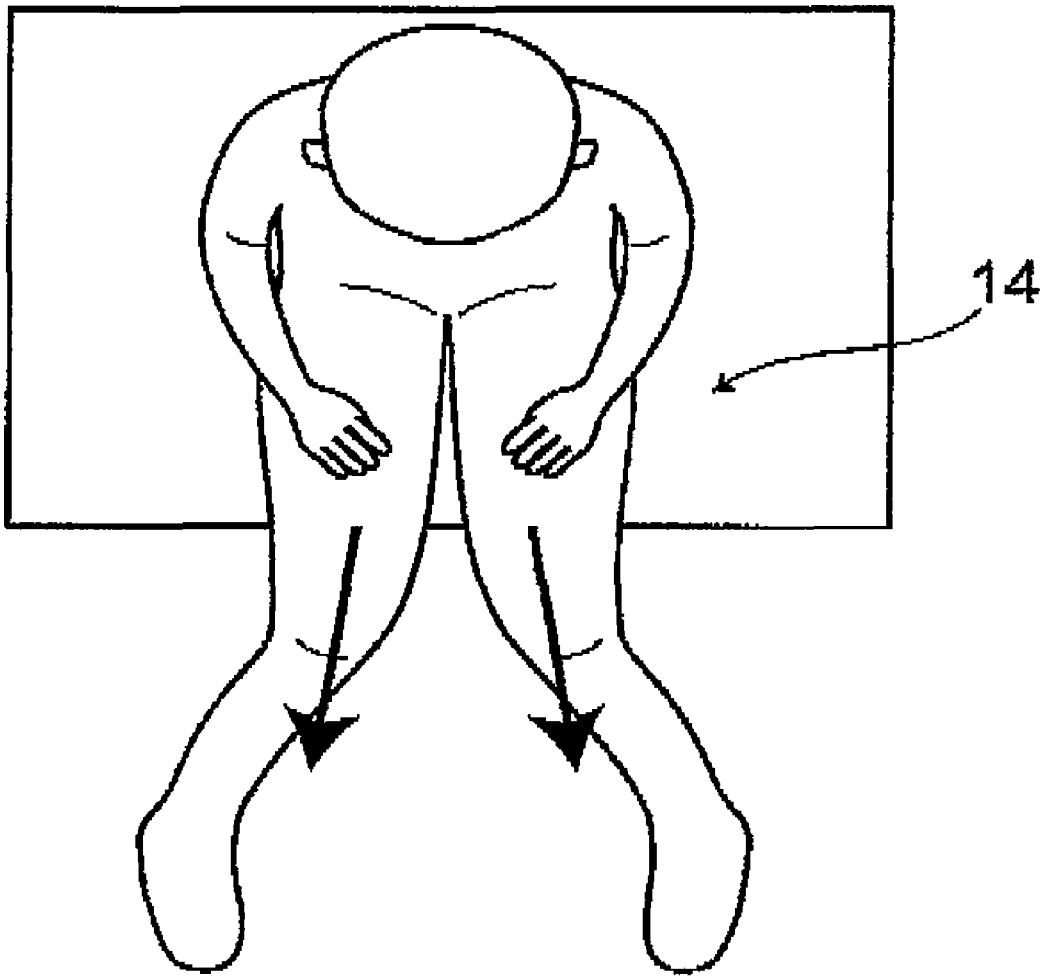
FIG. 33 is a schematic view showing the direction of water discharge from the legback water discharger adapted to a seat occupant sitting in a knock-kneed position.

The water discharge direction of the legback water discharger 33 is adjustable not only vertically but also laterally. For example, the lateral divergence of the water discharge direction can be adjusted to users sitting in a bow-legged position shown in FIG. 32 and to users sitting in a knock-kneed position shown in FIG. 33. Thus the water discharge flow can be efficiently applied to the legback of the seat occupant.

Tenth Embodiment

In the shower apparatus according to this embodiment, the position of the legback water discharger 33 is adjustable. By adjusting the front-back and lateral position of the legback water discharger 33, the shower apparatus can be flexibly adapted to the difference in the user's physique, sitting style, and placement of legs, and the water discharge flow can be reliably applied to the legback of the seat occupant.

Figure 34:
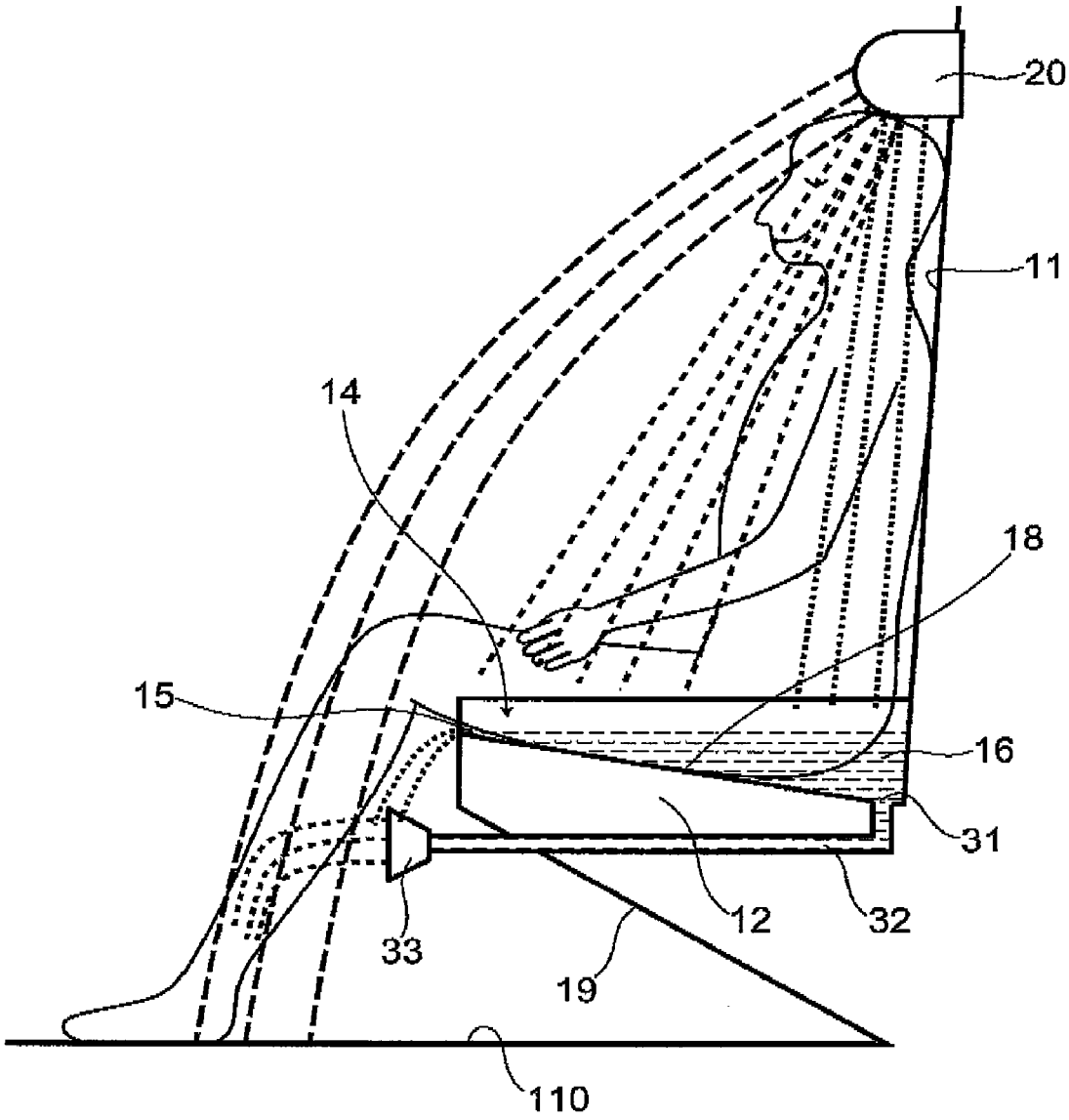
FIG. 34 is a schematic view of a shower apparatus according to a tenth embodiment of the invention where the legback water discharger protrudes forward of the seat front edge.

For example, it is anticipated that the legback is spaced forward from the seat 14 (base portion 12) when the seat occupant sits with the body leaned backward, sits shallow, and sits with the legs stretched forward. In this case, as shown in FIG. 34, the legback water discharger 33 can be caused to protrude forward of the front edge of the seat 14 (base portion 12) to shorten the distance to the legback so that the water discharge flow can reach the legback.

Furthermore, by varying the front-back position of the legback water discharger 33, it is possible to vary the flying distance of the discharged shower flow to the legback of the seat occupant. Thus the temperature of the water discharge flow at the time of impinging on the legback can be varied desirably.

Figure 35A:
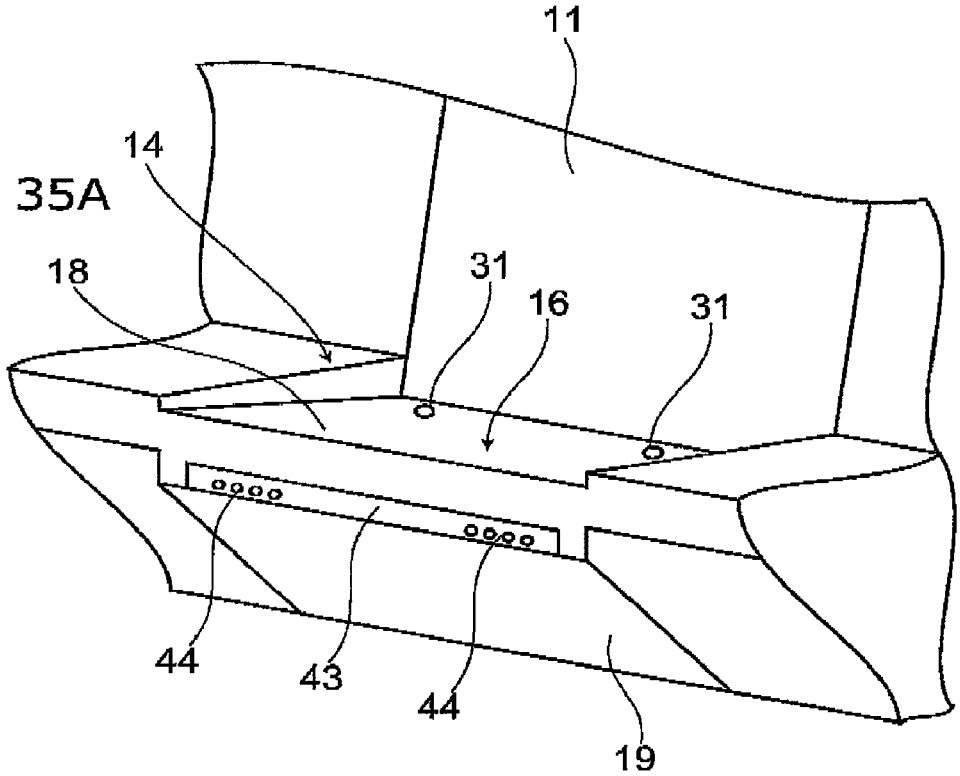
FIG. 35 is a schematic view of a shower apparatus according to the tenth embodiment of the invention where the legback water discharger is adjustable in its front-back position.

FIG. 35 is a schematic view showing the legback water discharger 43, which is adjustable in its front-back position, for example.

Figure 35B:
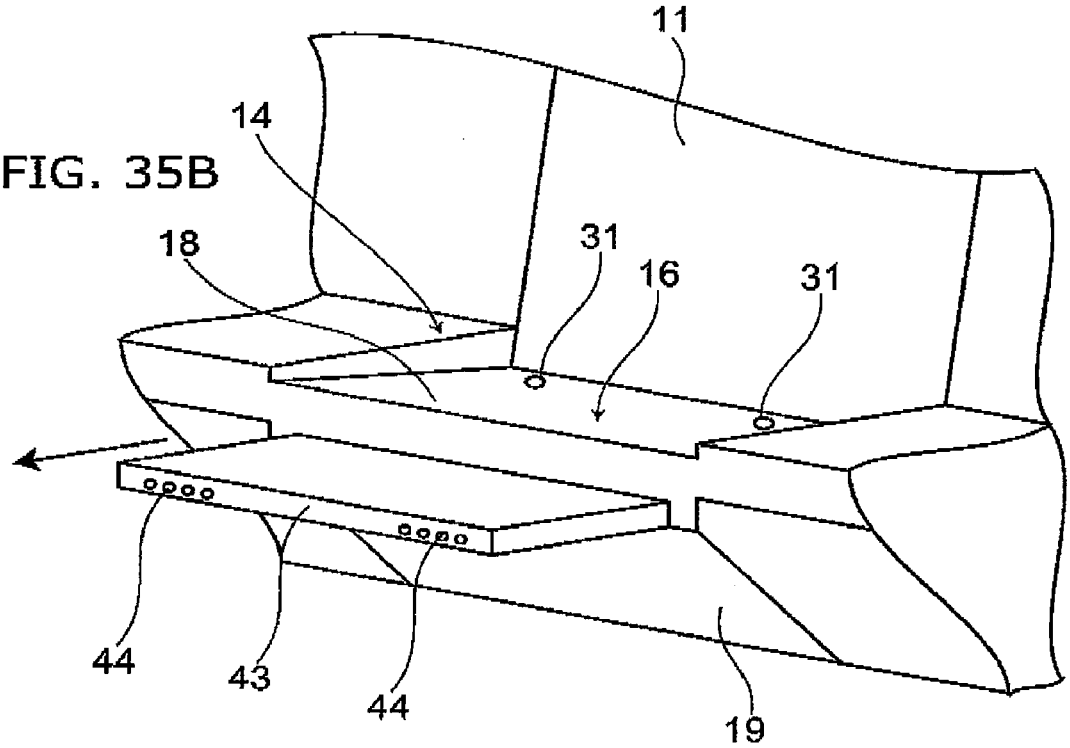

The horizontally oriented water discharge surface of the legback water discharger 43 facing the bathroom side has a plurality of water discharge ports 44 that are aligned laterally. The legback water discharger 43 can be housed below the seat 14 with the water discharge ports 44 facing the space on the bathroom side (FIG. 35A), and can be extracted forward from this housed position as shown in FIG. 35B. It is possible to adjust the front-back position of the legback water discharger 43 by adjusting the extracted position of the legback water discharger 43.

Eleventh Embodiment

By adjusting the flow rate of the water discharge flow from the legback water discharger 33, it is possible to adjust the feeling of stimulation at the legback caused by the water discharge flow and its water discharge direction.

Figure 36:
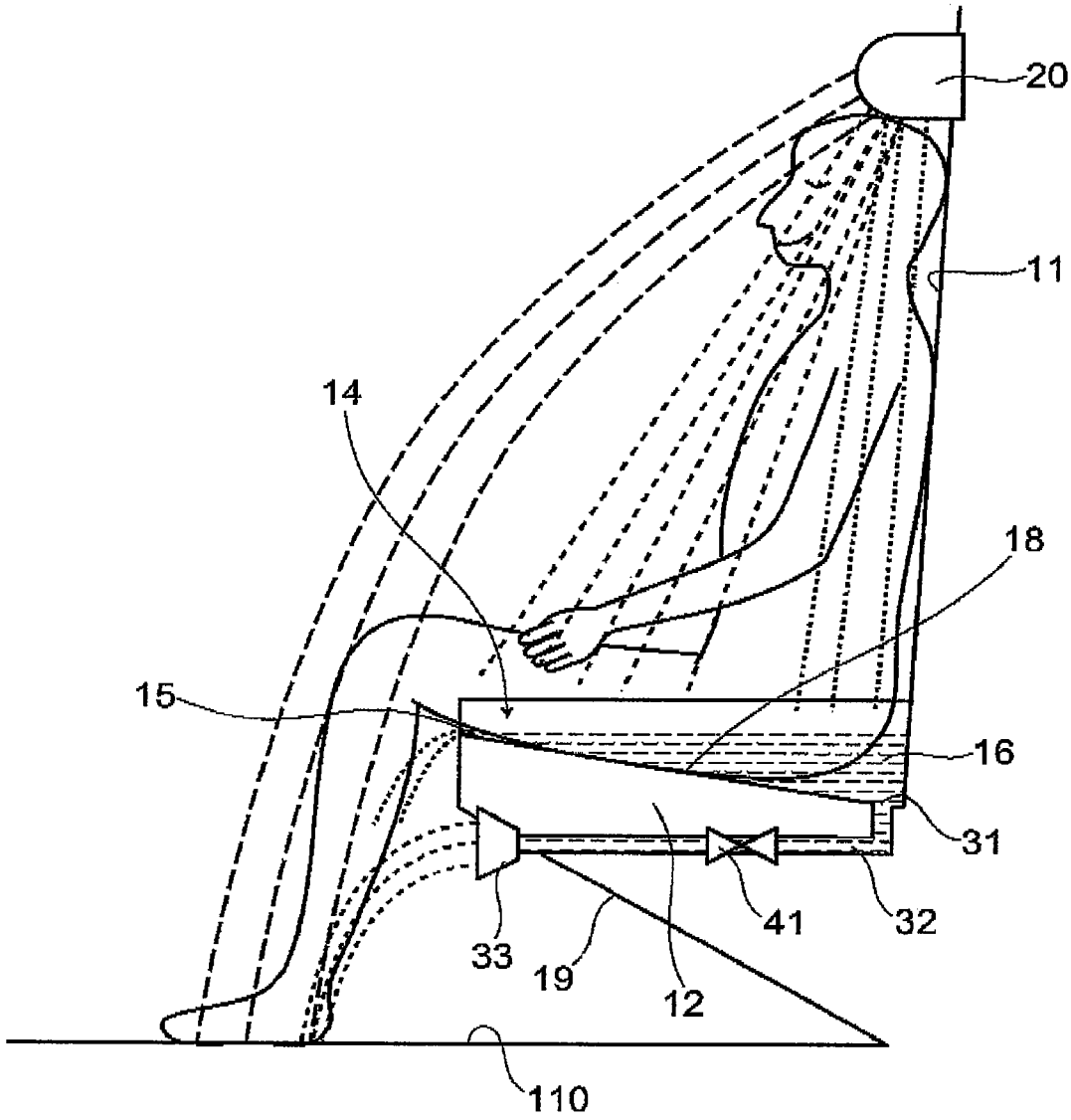
FIG. 36 is a schematic view of a shower apparatus according to an eleventh embodiment of the invention where the legback feedwater channel is provided with a flow rate regulation means.

For example, in an example shown in FIG. 36, a flow rate regulation means (e.g. valve) 41 is provided along the legback feedwater channel 32 extending from the opening 31 to the legback water discharger 33 to make adjustable the flow rate of the water discharge from the legback water discharger 33.

By adjusting the opening of the flow rate regulation means 41, it is also possible to adjust the amount of water pooled in the pool portion 16. For example, in summer, the pool portion 16 pools no water, or the amount of pooled water is decreased. On the other hand, in winter, the pool portion 16 pools water, or the amount of pooled water is increased. Thus the adjustment can be adapted to the user's preference.

Twelfth Embodiment

Figure 37:
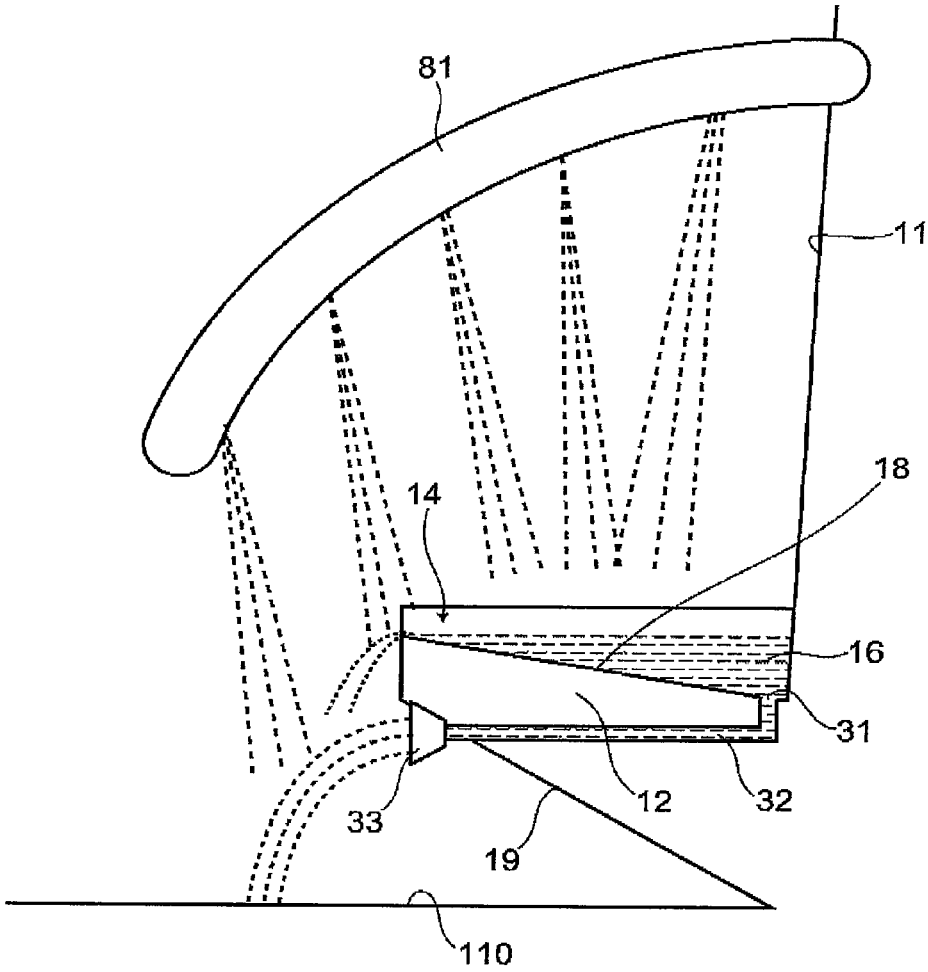
FIG. 37 is a schematic view of a shower apparatus according to a twelfth embodiment of the invention as viewed from the lateral side.

FIG. 37 is a schematic view of a shower apparatus according to a twelfth embodiment of the invention as viewed from the lateral side.

Figure 38:
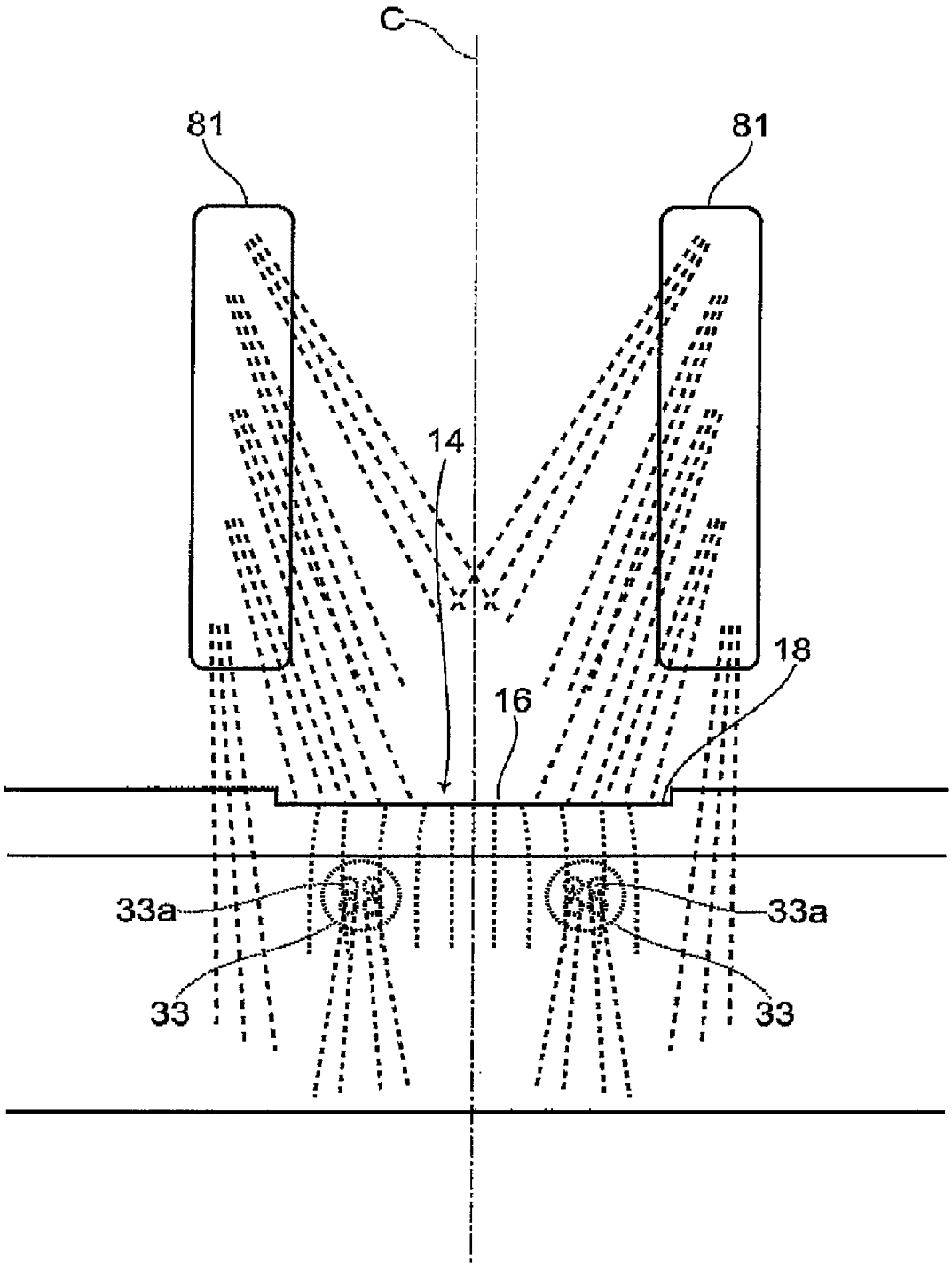
FIG. 38 is a schematic view of the shower apparatus as viewed from the frontside.

FIG. 38 is a schematic view of the shower apparatus as viewed from the frontside.

The shower apparatus according to this embodiment is different from the above embodiments in the water dischargers, which are provided upwardly to the seat 14 and apply a shower flow to the frontside of the body of the seat occupant.

More specifically, in this embodiment, an arm 81 extending forward is provided at the upper part of the back portion 11, and a plurality of water dischargers are provided in the arm 81. The plurality of water dischargers discharge a shower flow toward the shoulders, arms, chest, and legs of the seat occupant seated on the seat.

Also in this embodiment, in a sitting position while soaking in the water pooled in the pool portion 16, a user can take a shower flow from the water dischargers provided in the arm 81 and the legback water discharger 33 throughout the body except upward to the neck. Thus the user can enjoy a sense of soaking in water (a sense of bathing), and a high hyperthermic effect is achieved despite shower bathing.

Thirteenth Embodiment

Figure 39:
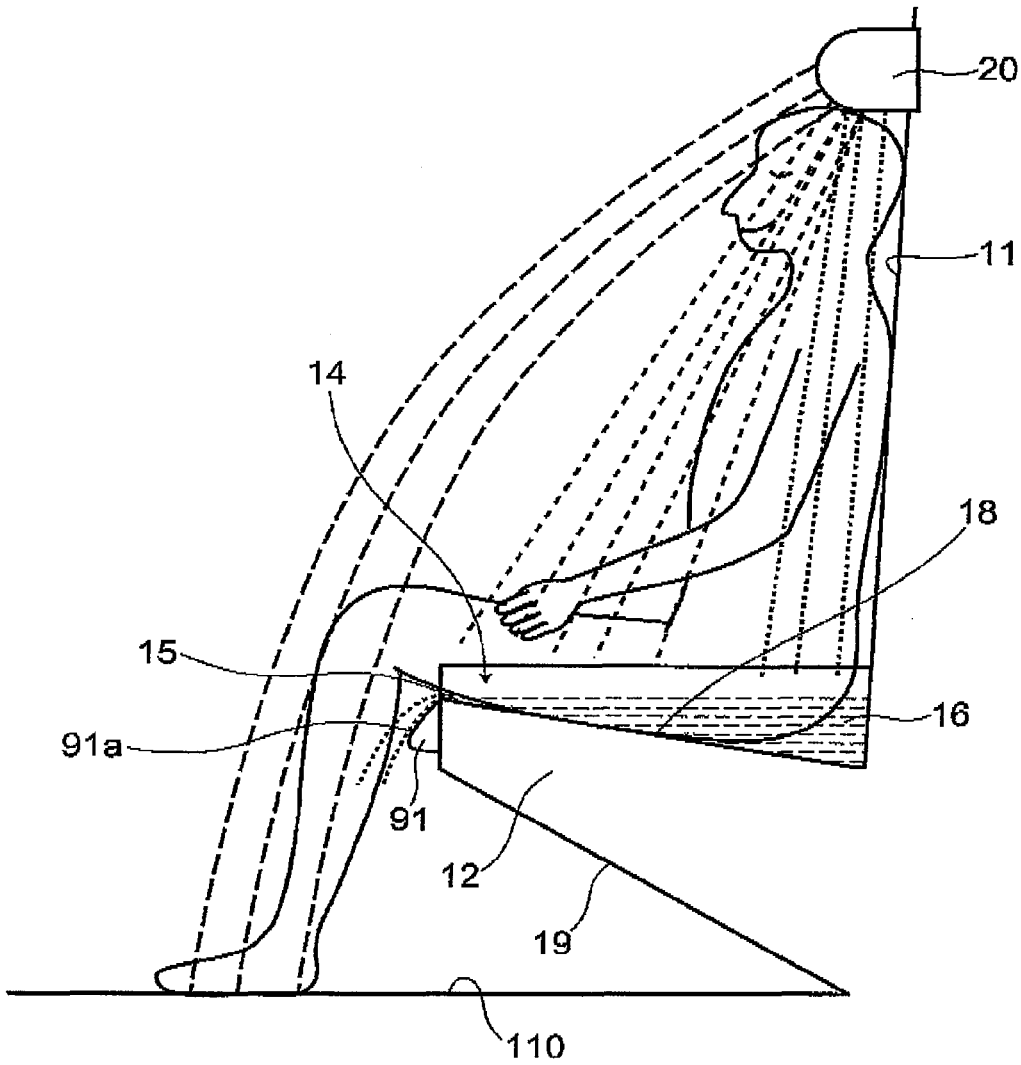
FIG. 39 is a schematic view of a shower apparatus according to a thirteenth embodiment of the invention as viewed from the lateral side.

FIG. 39 is a schematic view of a shower apparatus according to a thirteenth embodiment of the invention as viewed from the lateral side.

In this embodiment, a guide portion 91 protruding forward is provided as a legback warming means at the front edge 15 of the seat 14 (base portion 12). The guide portion 91 has a slope surface 91*a* sloped obliquely forward and downward from the front edge 15 of the seat 14.

The water overflowing the pool portion 16 of the seat 14 is guided from the front edge 15 to the slope surface 91*a* of the guide portion 91 and discharged toward the legback of the seat occupant. Thus, also in this embodiment, it is possible to reliably apply water to the legback for warming the legback that cannot be covered by the water discharger 20 provided upwardly to the seat 14.

Fourteenth Embodiment

Figure 40A:
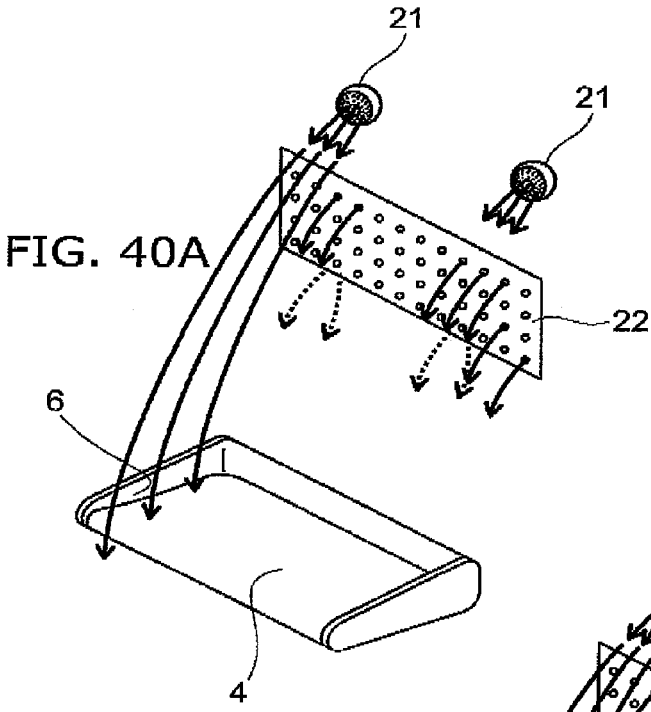
FIG. 40 is a schematic view of a shower bathing apparatus according to a fourteenth embodiment of the invention.
Figure 40B:
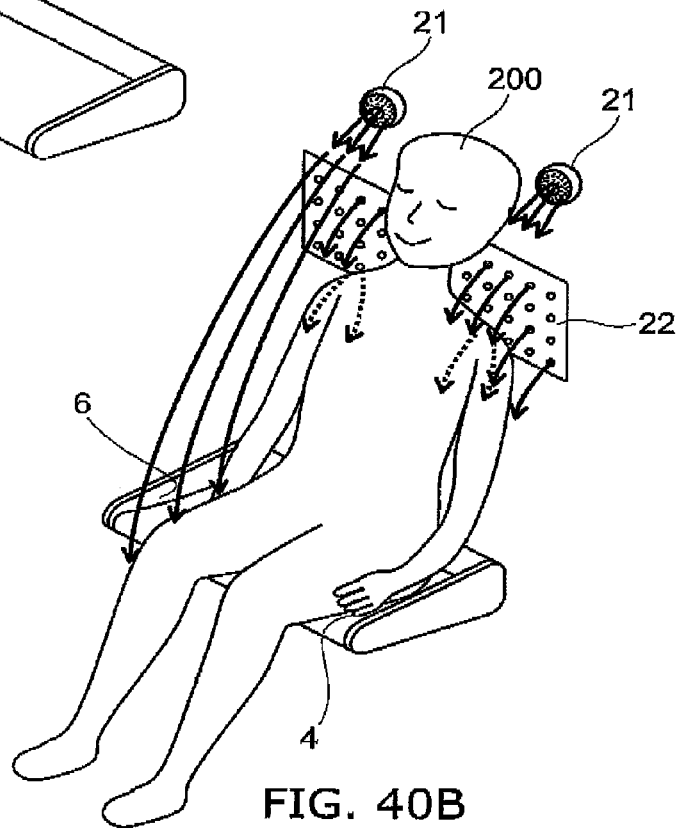

FIGS. 40A and 40B are schematic views of a shower bathing apparatus according to a fourteenth embodiment of the invention.

The shower bathing apparatus of this embodiment includes a pair of first water dischargers 21 provided at or upwardly to the head of a seat occupant 200 and a second water discharger 22 provided below the first water dischargers 21. The water discharge direction of the first water discharger 21 is configured to be a generally horizontal or obliquely downward direction. As shown in FIG. 40B, at least part of the discharged shower flow falls around the leg centering on the thigh of the seat occupant 200 seated on the seat 4.

On the other hand, the second water discharger 22 has a plurality of shower holes provided two-dimensionally rearwardly to the neck and shoulders of the seat occupant 200 seated on the seat 4. The direction of water discharge from these shower holes is also configured to be a generally horizontal or obliquely downward direction. As shown in FIG. 40B, the shower flow discharged from the second water discharger 22 covers the area including the neck, shoulders, and acromia (points of the shoulders) of the seat occupant 200. Because the second water discharger 22 extends also directly rearward to the seat occupant 200, the shower flow can be evenly applied also on the neck and back of the seat occupant 200 from directly rearward. Thus almost the entire body below the neck of the seat occupant 200 can be evenly warmed.

Also in this embodiment, weirs for pooling water formed around the seat 4. Among these weirs, the front weir is lower than the other three weirs. Hence the water pooled in the seat 4 falls toward the feet of a seat occupant 200 without leaking out laterally. As a result, the feet of the seat occupant 200 can be warmed more effectively.

The first water dischargers 21 may be integrated with the second water discharger 22. That is, the first water dischargers 21 and the second water discharger 22 may be formed in a common substrate (not shown). It is then possible to simultaneously adjust the water discharge direction and water discharge position of the first water dischargers 21 and the second water discharger 22 by changing the angle and position of the substrate.

Alternatively, as shown in FIGS. 40A and 40B, the first water dischargers 21 may be formed separately from the second water discharger 22. That is, the first water dischargers 21 and the second water discharger 22 may be formed in separate substrates, respectively. It is then possible to adjust the water discharge direction and water discharge position of the first water dischargers 21 independently of the water discharge direction and water discharge position of the second water discharger 22.

Fifteenth Embodiment

Figure 41A:
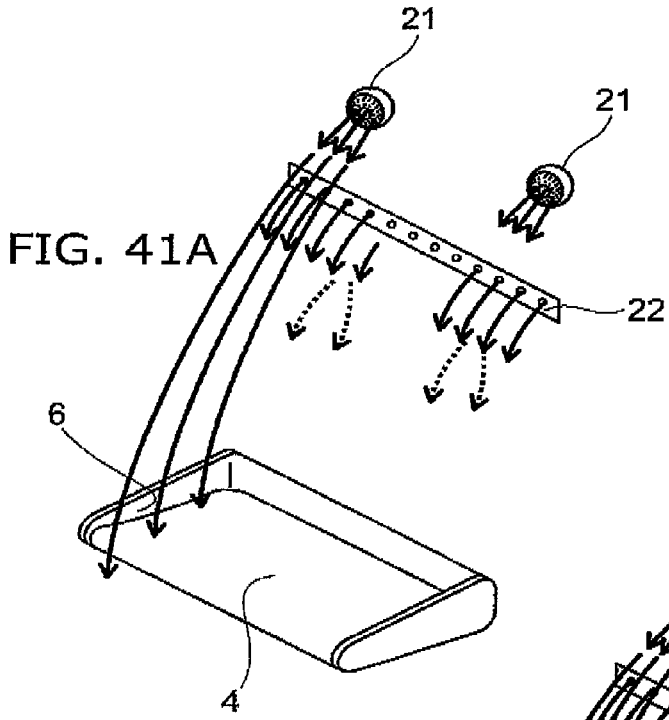
FIG. 41 is a schematic view of a shower bathing apparatus according to a fifteenth embodiment of the invention.
Figure 41B:
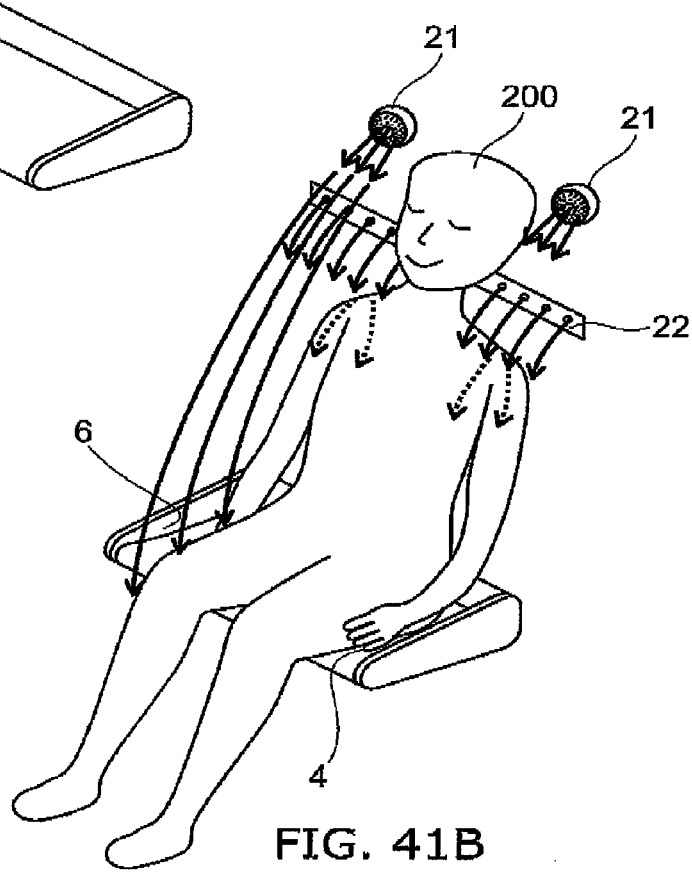

FIGS. 41A and 41B are schematic views of a shower bathing apparatus according to a fifteenth embodiment of the invention.

Like the shower apparatus of the fourteenth embodiment, the shower bathing apparatus of this embodiment also includes a pair of first water dischargers 21 provided at or upwardly to the head of a seat occupant 200 seated on the seat 4 and a second water discharger 22 provided below the first water dischargers 21. The water discharge direction of the first water discharger 21 is configured to be a generally horizontal or obliquely downward direction. As shown in FIG. 41B, at least part of the discharged shower flow falls around the leg centering on the thigh of the seat occupant 200.

On the other hand, the second water discharger 22 has a plurality of shower holes arranged in a horizontal line rearwardly to the neck and shoulders of the seat occupant 200 seated on the seat 4. The direction of water discharge from these shower holes is also configured to be a generally horizontal or obliquely downward direction. As shown in FIG. 41B, a row of shower flows discharged from the second water discharger 22 covers the area including the neck, shoulders, and acromia (points of the shoulders) of the seat occupant 200 seated on the seat 4. Furthermore, the shower flow can be applied also beyond the acromion toward the chest. Also in this embodiment, because the second water discharger 22 extends also directly rearward to the seat occupant 200, the shower flow can be evenly applied also on the neck and back of the seat occupant 200 from directly rearward. Thus almost the entire body below the neck of the seat occupant 200 can be evenly warmed.

Also in this embodiment, weirs for pooling water are formed around the seat 4. Among these weirs, the front weir is lower than the other three weirs. Hence the water pooled in the seat 4 falls toward the feet of a seat occupant 200 without leaking out laterally. As a result, the feet of the seat occupant 200 can be warmed more effectively.

Also in this embodiment, the first water dischargers 21 may be integrated with the second water discharger 22 so that the water discharge direction and water discharge position can be simultaneously adjusted. Alternatively, as shown in FIGS. 41A and 41B, the first water dischargers 21 and the second water discharger 22 may be formed separately so that the water discharge direction and water discharge position thereof can be independently adjusted.

Sixteenth Embodiment

Figure 42A:
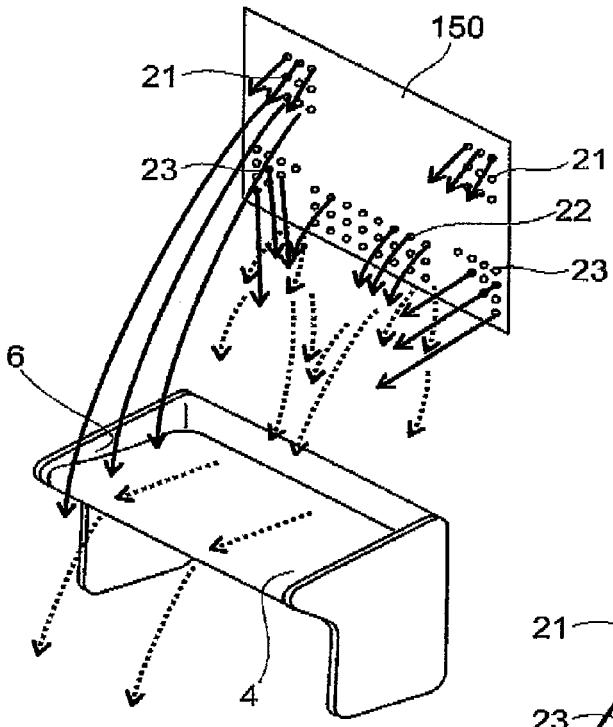
FIG. 42 is a schematic view of a shower bathing apparatus according to a sixteenth embodiment of the invention.
Figure 42B:
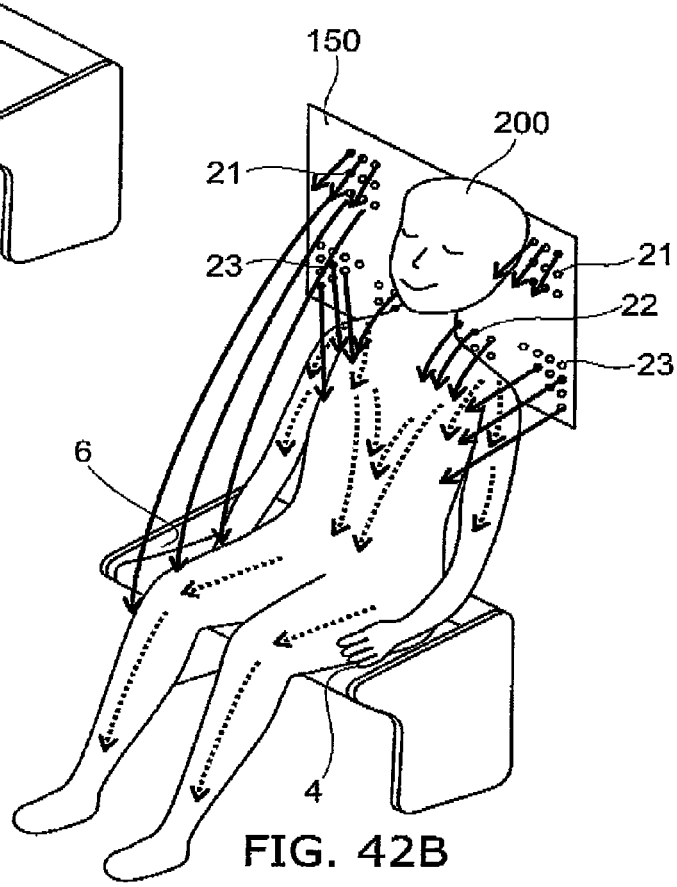

FIGS. 42A and 42B are schematic views of a shower bathing apparatus according to a sixteenth embodiment of the invention.

The shower bathing apparatus of this embodiment includes a pair of first water dischargers 21 provided at or upwardly to the head of a seat occupant 200 seated on the seat 4, a pair of third water dischargers 23 provided below the first water dischargers 21, and a second water discharger 22 provided between the third water dischargers 23. The water dischargers 21, 22, 23 have a plurality of shower holes provided two-dimensionally, respectively.

The water discharge direction of the first water discharger 21 is configured to be a generally horizontal or obliquely downward direction. As shown in FIG. 42B, at least part of the discharged shower flow falls around the leg centering on the thigh of the seat occupant 200. The shower flow discharged from the second water discharger 22 covers the area extending from the neck to the shoulders of the seat occupant 200. Because the second water discharger 22 extends also directly rearward to the seat occupant 200, the shower flow can be evenly applied also on the neck and back of the seat occupant 200 from directly rearward. The shower flow from the third water discharger 23 is discharged so as to enclose the seat occupant 200 from both sides and covers the area including the acromia (points of the shoulders) and the vicinity of the arms. Furthermore, the shower flow can be applied also beyond the acromion toward the chest. Thus almost the entire body below the neck of the seat occupant 200 can be evenly warmed.

Also in this embodiment, weirs for pooling water are formed around the seat 4. Among these weirs, the front weir is lower than the other three weirs. Hence the water pooled in the seat 4 falls toward the feet of a seat occupant 200 without leaking out laterally. As a result, the feet of the seat occupant 200 can be warmed more effectively.

Also in this embodiment, the first water dischargers 21 may be integrated with the second water discharger 22 so that the water discharge direction and water discharge position can be simultaneously adjusted. Alternatively, the first water dischargers 21 and the second water discharger 22 may be formed separately so that the water discharge direction and water discharge position thereof can be independently adjusted.

Also in this embodiment, as shown in FIGS. 42A and 42B, it is possible to simultaneously adjust the water discharge direction of the first to third water discharger(s) 21, 22, 23 by forming them in a common substrate 150 and changing the direction of the substrate 150.

Seventeenth Embodiment

Figure 43:
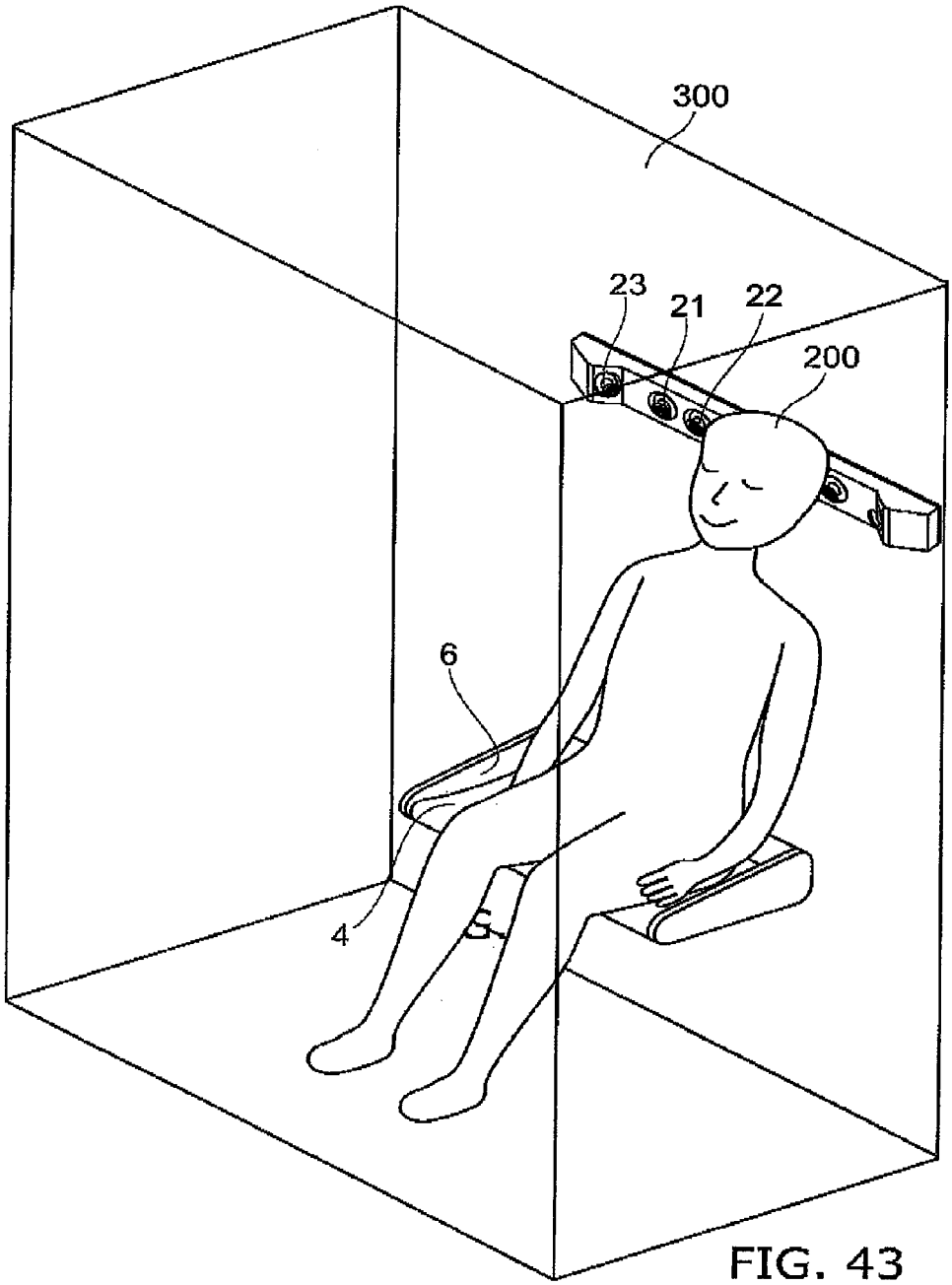
FIG. 43 is a schematic view of a shower bathing apparatus according to a seventeenth embodiment of the invention.

FIG. 43 is a schematic view of a shower bathing apparatus according to a seventeenth embodiment of the invention.

FIG. 44 is a schematic view of the seat 4 of this shower bathing apparatus.

Figure 44A:
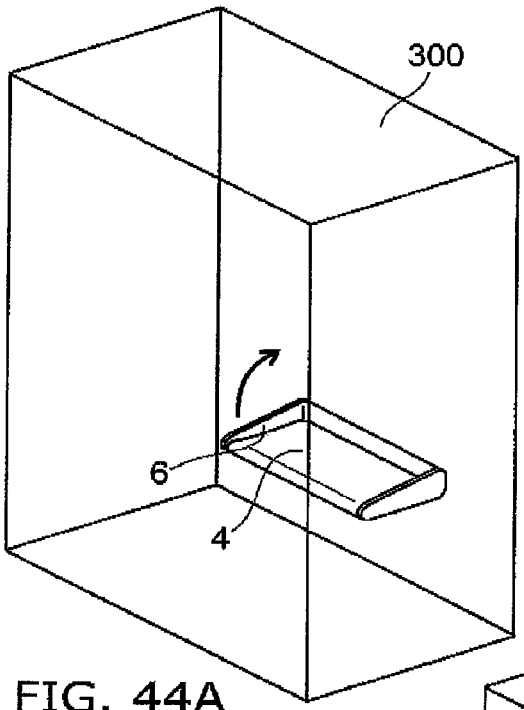
FIG. 44 is a schematic view of the seat 4 of the shower bathing apparatus shown in FIG. 40.
Figure 44B:
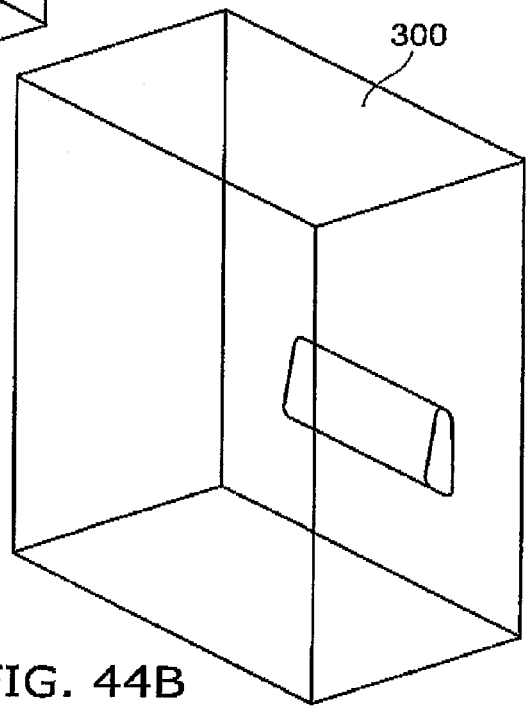
Figure 45:
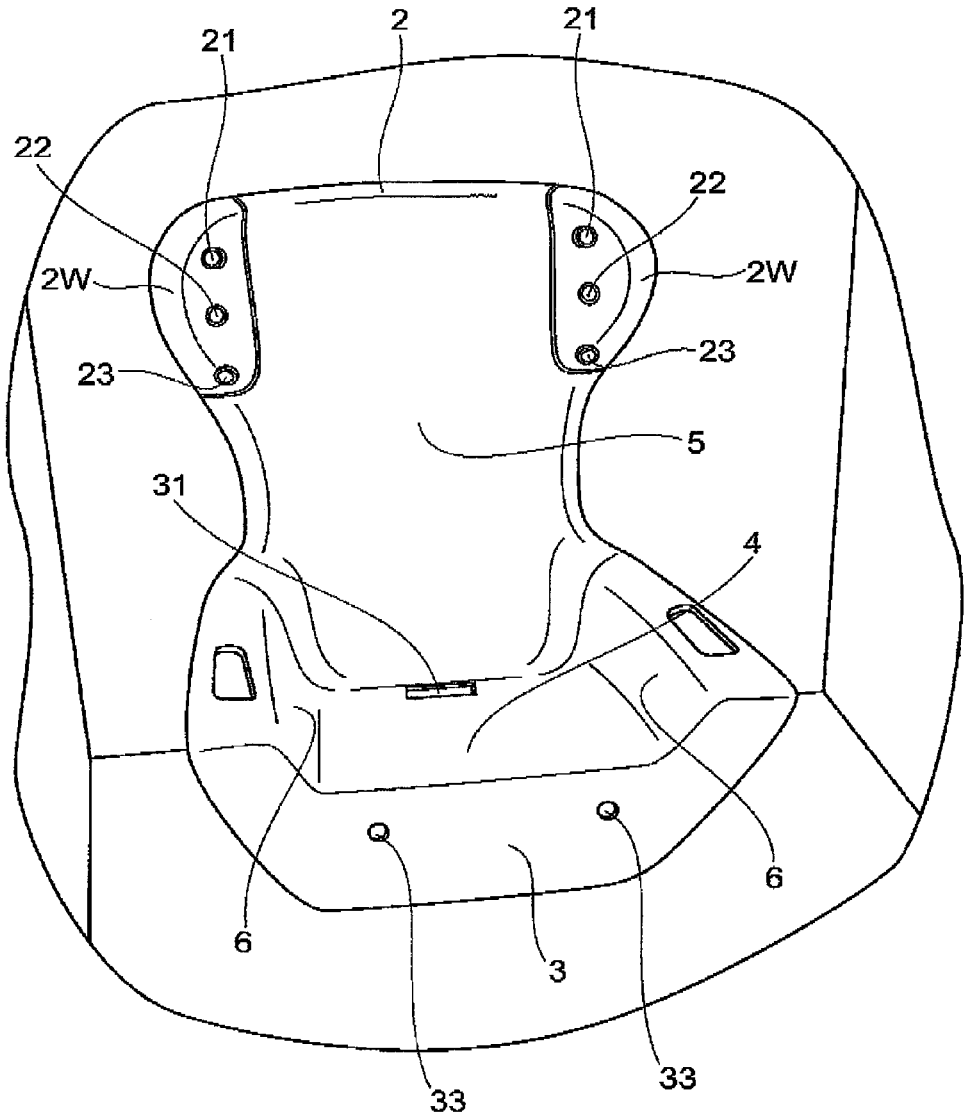
FIG. 45 is a schematic view of a shower bathing apparatus according to an eighteenth embodiment of the invention.

The shower bathing apparatus of this embodiment is installed in a shower booth 300. That is, the water dischargers 21, 22, 23 of each embodiment described above are installed on the wall of the shower booth 300. A seat 4 is provided below the water dischargers 21, 22, 23. FIG. 44A shows a situation where the seat 4 is in use, and FIG. 44B shows a situation where the seat 4 is retracted. Thus, because the seat 4 is retractable, the seat 4 is not obstructive when the user takes a shower in a standing position in the shower booth.

Also in this embodiment, weirs for pooling water are formed around the seat 4. Among these weirs, the front weir is lower than the other three weirs. Hence the water pooled in the seat 4 falls toward the feet of a seat occupant 200 without leaking out laterally. As a result, the feet of the seat occupant 200 can be warmed more effectively.

Eighteenth Embodiment

FIGS. 45 to 48 are schematic views of a shower bathing apparatus according to an eighteenth embodiment of the invention.

The shower bathing apparatus of this embodiment is configured as a chair having a back portion 2 and a base portion 3. The back portion 2 has a backrest 5, and the base portion 3 has a seat 4. At the upper part of the back portion 2, a pair of wings 2W extends obliquely forward from both sides of the backrest 5.

Figure 46:
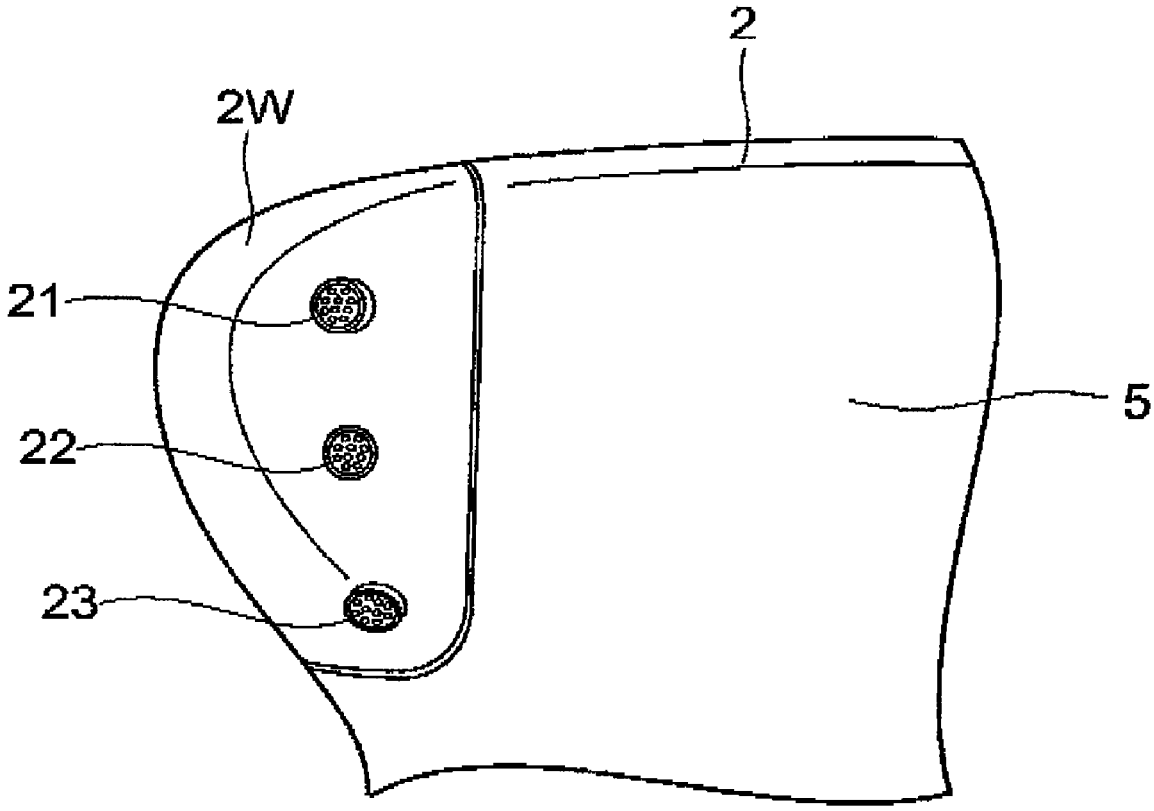
FIG. 46 is a schematic view of a shower bathing apparatus according to an eighteenth embodiment of the invention.
Figure 47:
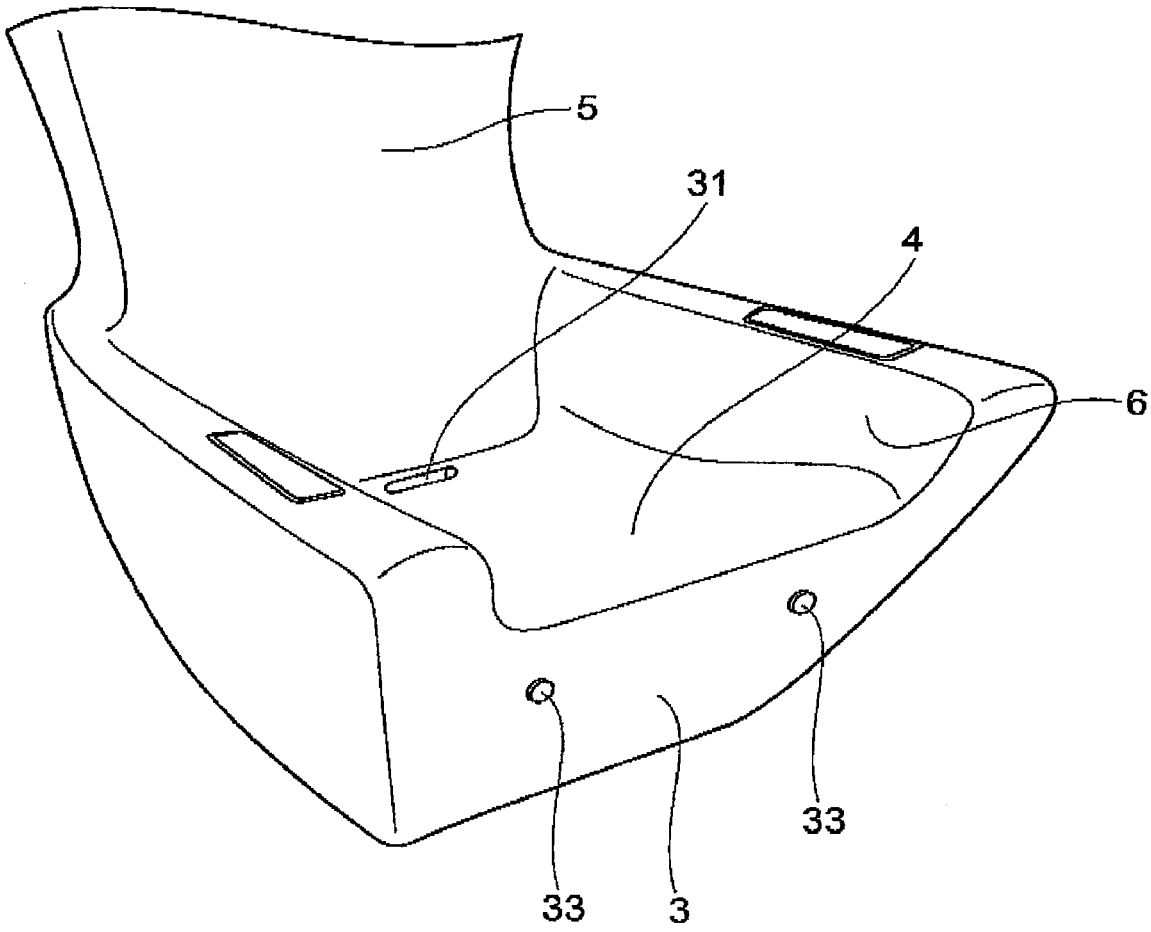
FIG. 47 is a schematic view of a shower bathing apparatus according to an eighteenth embodiment of the invention.

As shown in FIG. 46, the wing 2W has a first water discharger 21, a second water discharger 22, and a third water discharger 23. Each of the water dischargers 21, 22, 23 can discharge one or more shower flows. On the other hand, the seat 4 has a slope surface sloped downward from its front edge to the backrest 5. The seat 4 thus formed can pool water in cooperation with the wall portions 6 provided at both side edges thereof and the backrest 5.

Also in this embodiment, weirs for pooling water are formed around the seat 4. Among these weirs, the front weir is lower than the other three weirs. Hence the water pooled in the seat 4 falls toward the feet of a seat occupant 200 without leaking out laterally. As a result, the feet of the seat occupant can be warmed more effectively.

Furthermore, an opening 31 is provided at the vertical bottom of the seat 4. On the other hand, a pair of legback water dischargers 33 is provided on the front of the base portion 3. The legback water dischargers 33 are in communication with the opening 31. That is, the water discharged from the water dischargers 21, 22, 23 and falling on the seat 4 is guided through the opening 31 to the legback water dischargers 33 and discharged toward the rear side of the legs of the seat occupant seated on the seat 4 as shown by arrows D in FIG. 48. Thus the seat occupant can be warmed and enjoy a massage effect by the shower flow to the entire body including the rear side of the legs. Note that, instead of using the water falling on the seat 4 for water discharge from the legback water dischargers 33, water supplied from a water supply may be guided to the legback water dischargers 33 for water discharge.

Figure 48:
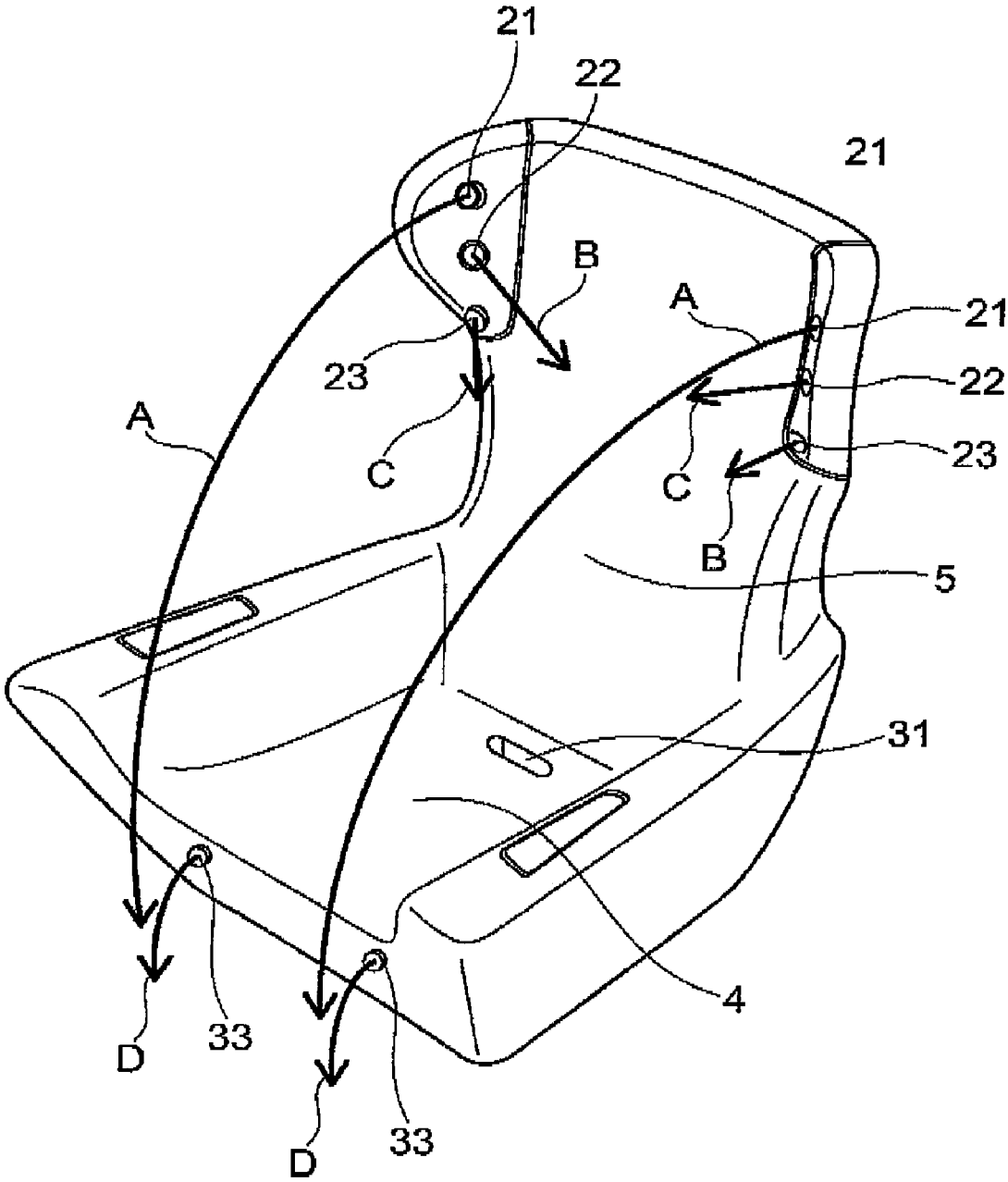
FIG. 48 is a schematic view of a shower bathing apparatus according to an eighteenth embodiment of the invention.

As shown by arrows A in FIG. 48, the water discharged from the first water dischargers 21 falls around the legs centering on the thighs of the seat occupant seated on the seat 4. As shown by arrows B in FIG. 48, the water discharged from the second water dischargers 22 reaches the area extending from the neck to the shoulders of the seat occupant seated on the seat 4. As shown by arrows C in FIG. 48, the water discharged from the third water dischargers 23 covers the area including the acromia (points of the shoulders) and the vicinity of the arms so as to enclose the seat occupant seated on the seat 4 from both sides. Furthermore, the shower flow can be applied also beyond the acromion toward the chest. Moreover, part of the discharged water is pooled in the seat 4. That is, the underside of the buttocks and thighs of the seat occupant seated on the seat 4 is warmed by the water pooled in the seat 4. Thus almost the entire body below the neck of the seat occupant 200 can be evenly warmed.

The shower bathing apparatus of this embodiment is configured as a stand-alone chair. Hence it can be easily installed without any work on the shower booth and the bathroom. Furthermore, it enables a user to comfortably take a full body shower in a relaxed sitting posture as in a sofa. Moreover, a vibrator can be installed on the rear side of the seat 4 and/or the backrest 5 of this shower bathing apparatus to provide a vibrating massage effect on the seat occupant. Then the relaxing and massage effect by shower bathing can be combined with the vibrating massage effect to provide greater advantage.

Working Example

Next, a working example implemented by the inventor is described.

The inventor performed experiments for measuring the warming effect of shower bathing in the shower bathing apparatus of the first embodiment, bathing in a bathtub filled with water, shower bathing with a conventional hand shower, and shower bathing in the shower bathing apparatus disclosed in Patent Document 1.

The experiment for the shower bathing apparatus of the first embodiment was performed in a case (case A) where the temperature of the water supplied to the water dischargers 21, 22, 23 was set to 43° C. and the total amount of water discharged from these water dischargers was set to 10 liters per minute. Bathing in a bathtub filled with water (case C) was performed by filling the bathtub with 230 liters of water at 40° C. In the case of a conventional hand shower (case D), the temperature of the water supplied to the shower head was also set to 43° C., and the flow rate was set to 8 liters per minute. In the case of the shower bathing apparatus disclosed in Patent Document 1 (case E), shower bathing was performed by ejecting water as a mist at 10 liters per minute. In all these cases, the temperature variation on the body surface of a subject was measured using a radiation thermometer immediately before bathing and after bathing for 5 minutes.

Figure 49:
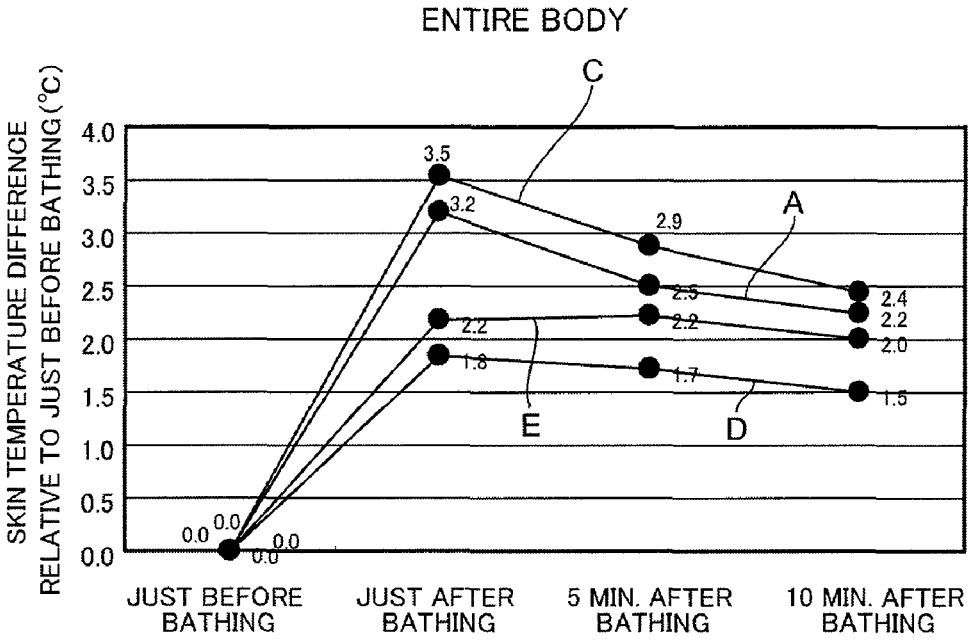
FIG. 49 is a graph showing the temperature variation of the entire body surface of a subject.

FIG. 49 is a graph showing the temperature variation of the entire body surface of a subject. The vertical axis represents the temperature increase with reference to the temperature immediately before bathing. Here, the average temperature of the body surface below the neck was used as the temperature of the entire body.

In comparison with immediately before bathing, the temperature increase immediately after 5 minutes' bathing was 3.5° C. for the bathtub (C), 3.2° C. for the shower bathing apparatus of this embodiment (A), 2.2° C. for the shower bathing apparatus of Patent Document 1 (E), and 1.8° C. for the conventional shower (D). That is, according to this result, the temperature is highest in the case of bathtub bathing (C), and a comparable temperature is achieved in this embodiment (A). In contrast, the temperature increase is small for the shower bathing apparatus disclosed in Patent Document 1 (E) and the conventional hand shower (D).

When 5 minutes elapsed after bathing, the temperature increase was 2.9° C. (C), 2.5° C. (A), 2.2° C. (E), and 1.7° C. (D). When 10 minutes elapsed after bathing, it was 2.4° C. (C), 2.2° C. (A), 2.0° C. (E), and 1.5° C. (D). That is, when 10 minutes elapsed after bathing, shower bathing in the shower bathing apparatus of this embodiment achieves the same temperature as bathtub bathing. This is presumably because the shower bathing apparatus of this embodiment provides not only a hyperthermic effect by water, but also a massage effect and an effect of promoting blood circulation by full body shower in a relaxed posture.

Figure 50:
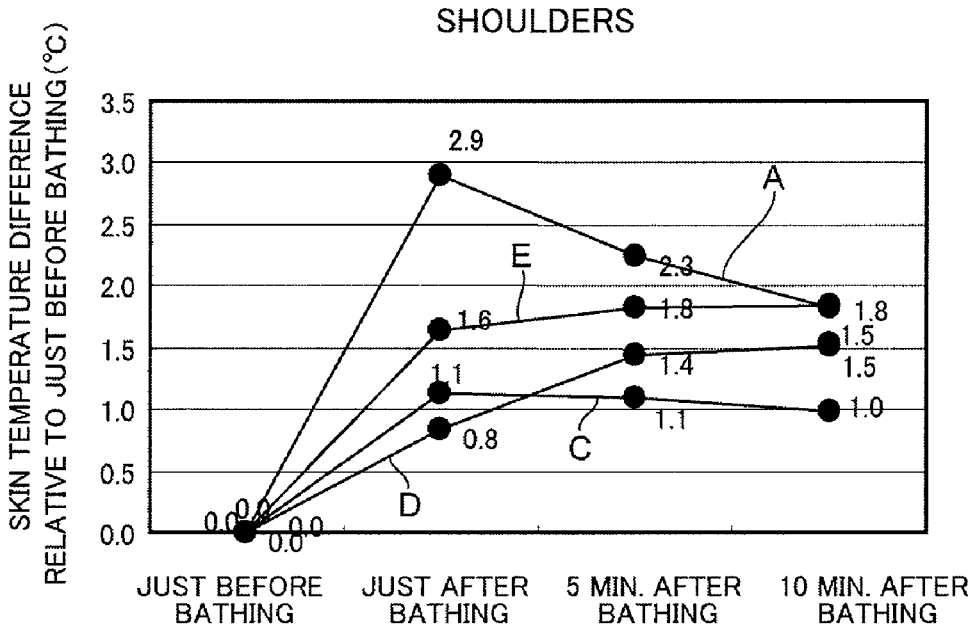
FIG. 50 is a graph showing the temperature variation of the body surface of the subject's shoulder.

FIG. 50 is a graph showing the temperature variation of the body surface of the subject's shoulder. Again, the vertical axis represents the temperature increase with reference to the temperature immediately before bathing.

In comparison with immediately before bathing, the temperature increase of the shoulders immediately after 5 minutes' bathing was 2.9° C. for the shower bathing apparatus of this embodiment (A), 1.6° C. for the shower bathing apparatus of Patent Document 1 (E), 1.1° C. for the bathtub (C), and 0.8° C. for the conventional shower (D). That is, according to this result, the temperature is prominently high for the shower bathing apparatus of this embodiment, but relatively low for the shower bathing apparatus disclosed in Patent Document 1 (E), the bathtub (C), and the conventional shower (D). This is presumably because, in the shower bathing apparatus of this embodiment, the shower flow from the second water dischargers 22 and the third water dischargers 23 (see FIG. 1) evenly reaches and can sufficiently warm the shoulders of the seat occupant. In contrast, in the shower bathing apparatus disclosed in Patent Document 1 (E), for example, the mist sprayed from the arm may fail to sufficiently warm the seat occupant including the shoulders. In the case of the bathtub (C), it is painful for the bather to keep the shoulders fully soaked in water for a long time, and inevitable to bathe with the shoulders being out of water. Hence it is difficult to warm the shoulders even if the body is warmed. Furthermore, in the case of the conventional hand shower (D), the shower flow from the shower head does not always reach the body of the bather, and it is not easy to evenly and efficiently warm the entire body of the bather.

When 5 minutes elapsed after bathing, the temperature increase was 2.3° C. (A), 1.8° C. (E), 1.4° C. (D), and 1.1° C. (C). When 10 minutes elapsed after bathing, it was 1.9° C. (A), 1.8° C. (E), 1.5° C. (D), and 1.0° C. (C). That is, even when 10 minutes elapsed after bathing, shower bathing in the shower bathing apparatus of this embodiment (A) achieves the highest temperature. In the case of the conventional hand shower (D) and the shower bathing apparatus disclosed in Patent Document 1 (E), the temperature was gradually increased after 5 minutes and after 10 minutes with reference to the temperature immediately after bathing. This is presumably because, in these cases, the shoulders were particularly less warmed than the other parts of the body and received heat from the other parts of the body through blood flow after bathing.

Figure 51:
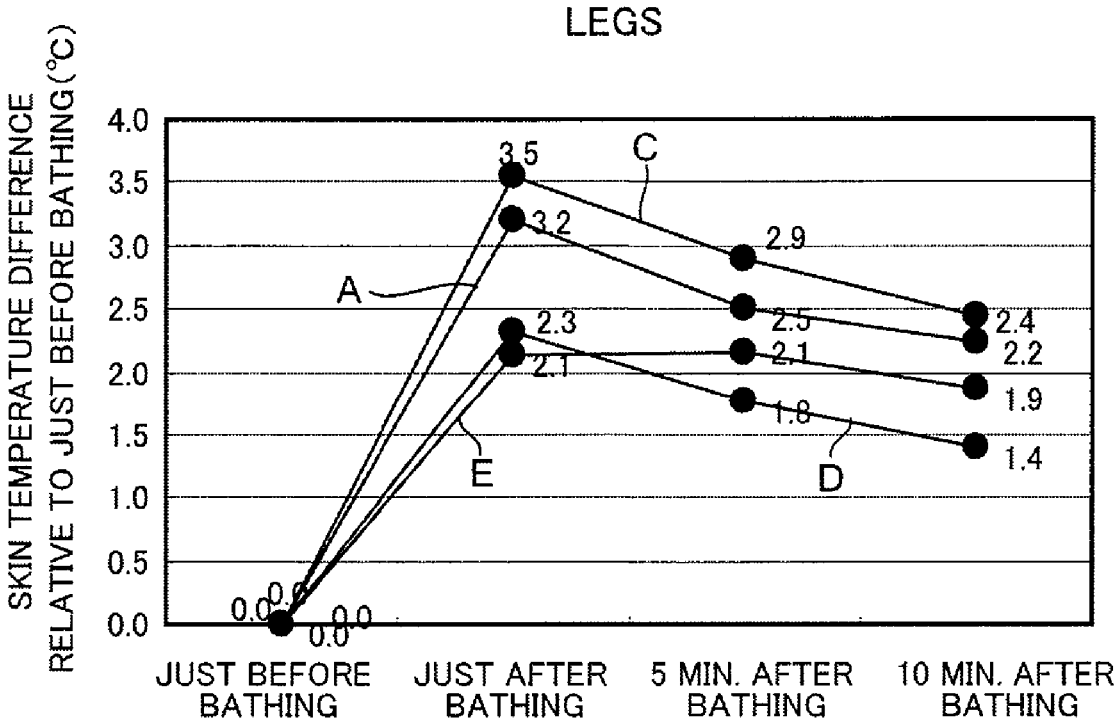
FIG. 51 is a graph showing the temperature variation of the body surface of the subject's leg.

FIG. 51 is a graph showing the temperature variation of the body surface of the subject's leg. Again, the vertical axis represents the temperature increase with reference to the temperature immediately before bathing.

In comparison with immediately before bathing, the temperature increase of the legs immediately after 5 minutes' bathing was 3.5° C. for the bathtub (C), which was the highest. However, it was 3.2° C. for the shower bathing apparatus of this embodiment (A), which was comparable to the temperature increase for the bathtub (C). That is, according to this embodiment, the water discharged from the first water dischargers 21 (see FIG. 1) and directly falling on the legs of the seat occupant and the water discharged from the second water dischargers 22 and the third water dischargers 23, impinging on the body of the seat occupant, and flowing down from the front edge of the seat 4 can sufficiently warm the seat occupant including the legs.

In contrast, in the case of the conventional hand shower (D) and the shower bathing apparatus of Patent Document 1 (E), the temperature increase immediately after bathing was as low as 2.3° C. and 2.1° C., respectively. In the case of the conventional hand shower (D), it is not easy to apply water evenly down to the legs of the bather. In the case of the shower bathing apparatus disclosed in Patent Document 1, it is not easy to entirely enclose the legs of the seat occupant with the mist sprayed from the arm. Furthermore, because the temperature of the mist sprayed from the arm decreases rapidly, it is considered difficult to evenly warm the entire legs of the seat occupant.

As described above, according to this working example, the shower bathing apparatus of this embodiment provides a high warming effect on the entire body, shoulders, and legs. For example, for the entire body and the legs, the shower bathing apparatus of this embodiment provides a warming effect comparable to that for bathtub bathing. Here, bathtub bathing needs about 230 liters of water, for example. However, this embodiment only needs a very small amount of water, e.g. 50 liters for 5 minutes' bathing (case A). That is, this embodiment also provides a high water-saving effect. Even successive use by four bathers only needs a smaller amount of water than bathtub bathing (case C) with a comparable warming effect.

With regard to the shoulders, this embodiment provides a greater warming effect than bathtub bathing. Furthermore, this embodiment also provides a massage effect by dropping the discharged water on the body of the seat occupant. Thus it is also possible to provide an effect of alleviating stiffness and pain in the shoulders, for example.

The first to eighteenth embodiment and the working example of the invention have been described.

In the above embodiments, the height of the water dischargers from the seat 4 is 400 to 1400 mm, for example. To ensure the above effects, it is preferably 500 to 1000 mm, and more preferably 650 to 900 mm.

The height of the seat 4 from the floor is 250 to 800 mm, for example. To ensure the above effects, it is preferably 300 to 500 mm, and more preferably 350 to 450 mm.

For use in a shower booth, the height of the seat 4 from the floor can be in the range of about 250 to 800 mm where a user can be seated thereon.

The distance (width) between the outermost third water dischargers paired across the center of the seat 4 is 340 to 1200 mm, for example. To ensure the above effects, it is preferably 500 to 800 mm, and more preferably 550 to 650 mm.

In the above examples, among the shower flows discharged from the water dischargers 21, 22, 23, the average droplet diameter of the water of the shower flow falling around the legs of the seat occupant can be larger than the average droplet diameter of the water discharged from the other water dischargers. For example, in the shower bathing apparatus described above with reference to FIG. 1, the average droplet diameter of the water discharged from the first water discharger 21 can be in the range of 1400 to 3000 micrometers, and the average droplet diameter of the water discharged from the second water discharger 22 and the third water discharger 23 can be in the range of 500 to 1400 micrometers. It is then possible to reduce the temperature decrease of the shower flow discharged from the first water discharger 21 and falling on the legs of the seat occupant and to apply water to the legs of the seat occupant. At the same time, the falling shower flow discharged from the first water discharger 21 can apply suitable stimuli to the legs of the seat occupant, thereby achieving a massage effect. It is possible to control the droplet diameter of the water by adjusting the size and shape of the water discharge port.

The embodiments of the invention have been described with reference to examples. However, the invention is not limited to the above examples.

For example, the above embodiments can be appropriately combined with each other as long as technically feasible, and such combinations are also encompassed within the scope of the invention. Furthermore, a flow rate regulation means and/or a pressure regulation means capable of regulating the flow rate and/or pressure of discharged water can also be provided in order to enable the discharged water to reach the legs and other parts constantly and stably irrespective of water supply pressure and its variation.

The structure, shape, function, positional relationship, and material of each element in the examples that are variously modified and/or added by those skilled in the art are also encompassed within the scope of the invention as long as they include the features of the invention.

The invention claimed is:

1. A shower bathing apparatus comprising:

a concave seat having a weir to pool water; and a water discharger solely provided rearwardly and upwardly to the seat and configured to discharge water in a forward direction of the concave seat, wherein the water discharger is configured to be located rearwardly and upwardly to the concave seat within a range where the seat is located, the water discharger is configured to discharge a first water flow and a second water flow, the first water flow is discharged from rearward of a seat occupant seated on the concave seat in an obliquely downward direction so that the discharged water impinges on an upper body of the seat occupant and flows down on a front and a back of the upper body of the seat occupant, the second water flow is discharged from rearward of a seat occupant in a horizontal direction to a front edge of the concave seat so that the discharged water does not impinge on the upper body of the seat occupant but passes over a shoulder of the seat occupant and directly impinges on a part of a leg of the seat occupant, the part being above the seat, the first and second water flows are pooled in the concave seat, and a height of the weir is minimized at a front of the seat so that the water pooled in the seat falls toward feet of the seat occupant without leaking out laterally.

2. The shower bathing apparatus according to claim 1, wherein the concave seat has a sloped portion sloping upwardly to a vertical direction from back to front.

3. The shower bathing apparatus according to claim 1, further comprising:

a backrest provided rearwardly to the concave seat.

4. The shower bathing apparatus according to claim 3, wherein the backrest includes a concave surface, and at least part of water discharged from the water discharger flows on the backrest and is guided to the concave seat.

5. The shower bathing apparatus according to claim 4, wherein at least a portion of a surface of the backrest has a non-planar surface in which at least one channel is formed by at least one recess in the non-planar surface, and the at least one recess is configured to guide water to the seat through the at least one channel formed by the at least one recess.

6. The shower bathing apparatus according to claim 1, further comprising:

a foot bathtub pooling water below the concave seat.

7. The shower bathing apparatus according to claim 1, further comprising:

a guide portion configured to guide forward water overflowing the concave seat.

8. The shower bathing apparatus according to claim 1, further comprising:

an opening configured to drain water pooled in the concave seat.

9. The shower bathing apparatus according to claim 1, further comprising:

legback warming means configured to discharge water pooled in the seat to warm the rear side of legs of the seat occupant seated on the concave seat.

10. The shower bathing apparatus according to claim 9, wherein the legback warming means includes:

an opening facing the concave seat below a level of water pooled in the concave seat, and a legback water discharger in communication with the opening.

11. A shower bathing apparatus comprising:

a concave seat having a weir to pool water; and a water discharger solely provided above and rearward of the concave seat and configured to discharge water from rearward of a seat occupant seated on the concave seat in a forward direction of the concave seat, wherein the water discharger is configured such that part of the water discharged from the water discharger impinges on a shoulder and flows on a chest of a seat occupant seated on the concave seat and is pooled in the concave seat, the water discharger is configured such that another pail of the water is discharged in a horizontal direction to a front edge of the concave seat so that the another part of the discharged water does not impinge on the shoulder of the seat occupant but passes over the shoulder of the seat occupant and directly impinges on a part of a leg of the seat occupant, the another part of the discharged water being pooled in the concave seat, and a height of the weir is minimized at a front of the concave seat so that the water pooled in the concave seat falls on feet of the seat occupant without leaking out laterally.

* * * * *

UNITED STATES PATENT AND TRADEMARK OFFICE

CERTIFICATE OF CORRECTION

PATENT NO. : 7,900,293 B2
APPLICATION NO. : 11/694201
DATED : March 8, 2011
INVENTOR(S) : Minoru Sato et al.

It is certified that error appears in the above-identified patent and that said Letters Patent is hereby corrected as shown below:

Title page, item (30) Foreign Application Priority Data section:
Please insert -- Mar. 30, 2007 (WO) ..... PCT/JP2007/57201 --

Column 27, Line 4:
Please delete "pail" and insert -- part --

Signed and Sealed this
Twenty-seventh Day of March, 2012

David J. Kappos

David J. Kappos
*Director of the United States Patent and Trademark Office*